US010688005B2

(12) United States Patent
Conrad

(10) Patent No.: US 10,688,005 B2
(45) Date of Patent: Jun. 23, 2020

(54) CREMATION STORAGE DEVICE AND SYSTEM, METHODS OF FORMING CREMATION STORAGE DEVICE AND SYSTEM, AND METHODS OF OPERATION OF CREMATION STORAGE DEVICE AND SYSTEM

(71) Applicant: Scott S. Conrad, North Reading, MA (US)

(72) Inventor: Scott S. Conrad, North Reading, MA (US)

( * ) Notice: Subject to any disclaimer, the term of this patent is extended or adjusted under 35 U.S.C. 154(b) by 107 days.

(21) Appl. No.: 15/872,799

(22) Filed: Jan. 16, 2018

(65) Prior Publication Data

US 2018/0221233 A1 Aug. 9, 2018

Related U.S. Application Data

(60) Provisional application No. 62/446,288, filed on Jan. 13, 2017.

(51) Int. Cl.
*A61G 17/08* (2006.01)
*B65D 25/20* (2006.01)
(Continued)

(52) U.S. Cl.
CPC ..... *A61G 17/08* (2013.01); *B65D 25/20* (2013.01); *E04H 13/006* (2013.01); *E04H 13/008* (2013.01); *G09F 15/00* (2013.01)

(58) Field of Classification Search
CPC .... A61G 17/08; E04H 13/008; E04H 13/006; B65D 25/20; G09F 15/00; A47F 7/283
(Continued)

(56) References Cited

U.S. PATENT DOCUMENTS 3,529,730 A 9/1970 Thompson
3,754,805 A 8/1973 Pangburn et al.
(Continued)

FOREIGN PATENT DOCUMENTS

CN 1039282 1/1990
CN 202157572 3/2012
(Continued)

OTHER PUBLICATIONS

Eickhof Columbaria, Custom Interior Columbaria, Google & Wayback Timemachine, Jun. 10, 2016, https://web.archive.org/web/20160610215410/https:/eickhofcolumbaria.com/sites/default/files/Custom%20Interior%20Portfolio%20email.pdf.
(Continued)

*Primary Examiner* — William L Miller
(74) *Attorney, Agent, or Firm* — Onello & Mello, LLP

(57) ABSTRACT

A repository system includes a first repository side panel including a plurality of first memorial apertures and a second repository side panel including a plurality of second memorial apertures. The first and second repository side panels interfacing at a corner region. A first corner portion of the first memorial apertures of the first repository side panel and a second corner portion of the second memorial apertures of the second repository panel neighbor each other in the corner region. The first memorial apertures of the first corner portion and the second memorial apertures of the second corner portion have vertical positions that are offset in the vertical direction.

24 Claims, 43 Drawing Sheets

(51) Int. Cl.
*G09F 15/00* (2006.01)
*E04H 13/00* (2006.01)

(58) Field of Classification Search
USPC ..... 27/1, 35; 52/134, 136; 211/85.27
See application file for complete search history.

(56) References Cited

U.S. PATENT DOCUMENTS

| | | | | |
|---|---|---|---|---|
| 3,878,656 | A | 4/1975 | Duwe et al. | |
| 3,990,198 | A | 11/1976 | Ortutay | |
| 4,644,711 | A | 2/1987 | Eickhof | |
| 4,688,359 | A | 8/1987 | See | |
| 4,893,385 | A | 1/1990 | Schrag | |
| 4,989,382 | A | 2/1991 | Spronken | |
| 6,161,268 | A | 12/2000 | Joseph | |
| 6,167,600 | B1 | 1/2001 | Williams et al. | |
| 6,250,025 | B1 | 6/2001 | Darby | |
| 6,347,439 | B1 | 2/2002 | Bach Lahor | |
| 6,493,911 | B1 | 12/2002 | Troin et al. | |
| 6,553,727 | B2 | 4/2003 | Thomas et al. | |
| 6,944,921 | B1 * | 9/2005 | Gersten | A61G 17/08 27/1 |
| 8,782,969 | B2 | 7/2014 | Eickhof et al. | |
| 2002/0092247 | A1 | 7/2002 | Thomas et al. | |
| 2009/0199376 | A1 * | 8/2009 | Hume | E04H 13/006 27/1 |
| 2010/0234981 | A1 * | 9/2010 | Turner | B65D 77/048 700/215 |
| 2013/0199111 | A1 | 8/2013 | Eickhof et al. | |
| 2017/0211291 | A1 | 7/2017 | Eickhof et al. | |
| 2017/0298648 | A1 * | 10/2017 | Eickhof | E04H 13/008 |

FOREIGN PATENT DOCUMENTS

| | | |
|---|---|---|
| EP | 1365088 | 11/2003 |
| EP | 2896767 | 7/2015 |
| RU | 91590 | 2/2010 |
| WO | 2004093769 | 11/2004 |
| WO | 2008142196 | 11/2008 |

OTHER PUBLICATIONS

Trinity Presbyterian Church, Columbarium Brochure, Pinterest & Wayback Timemachine, Feb. 2, 2014, https://web.archive.org/web/20140202121646/http:/trinitypresbyterianchurchpalmcoast.us:80/columbarium/.

* cited by examiner

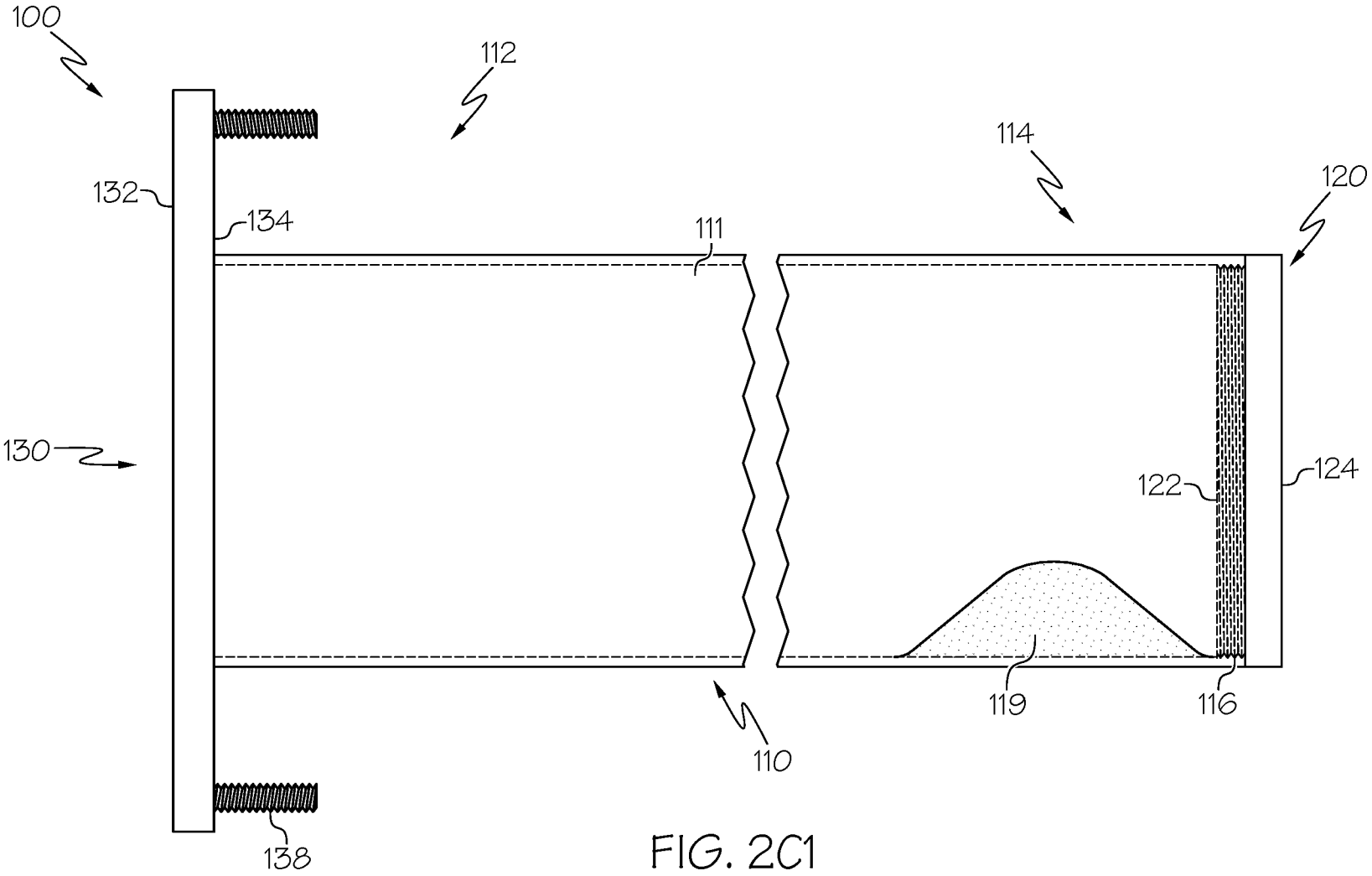
FIG. 2C1

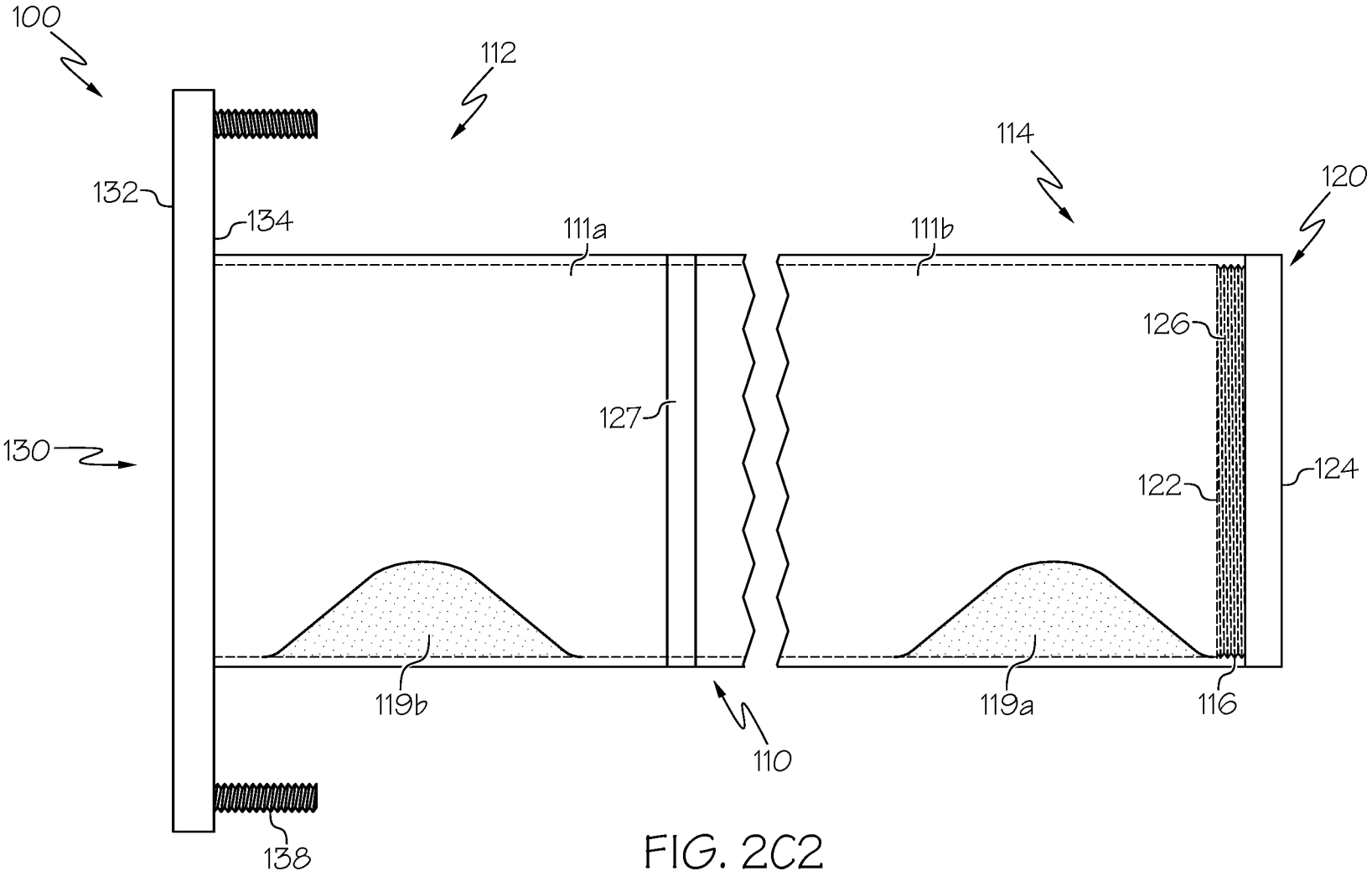
FIG. 2C2

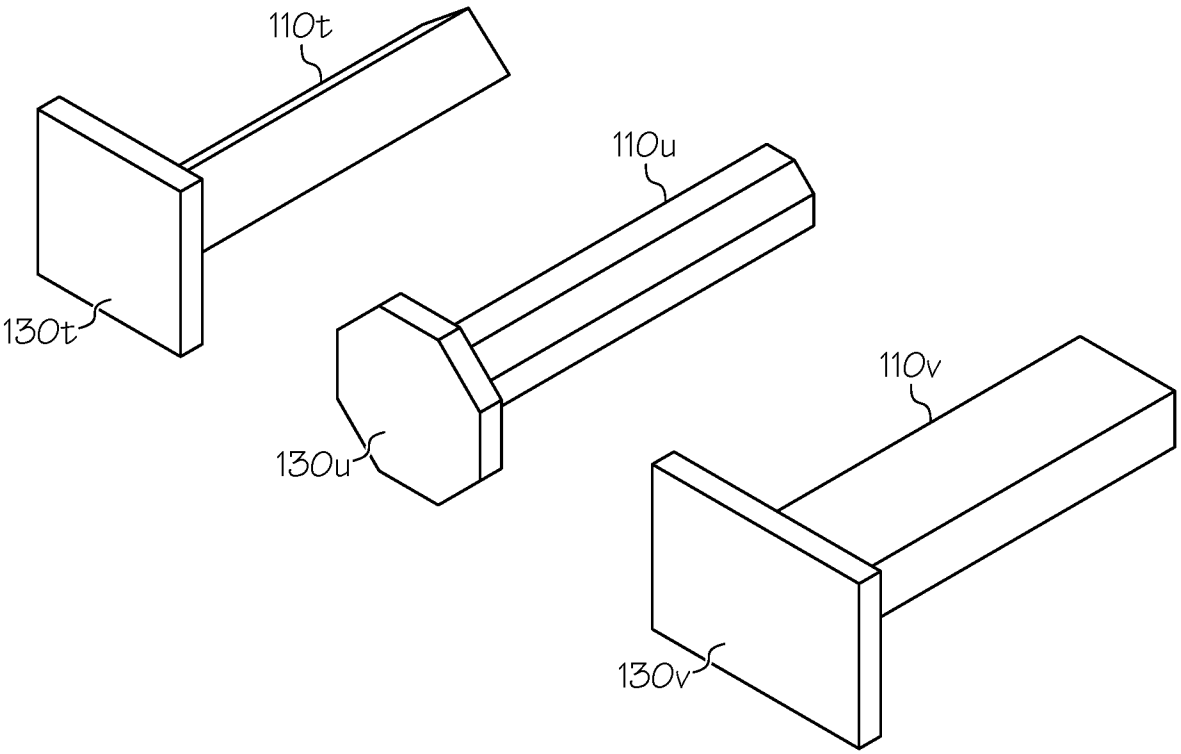
FIG. 2C3

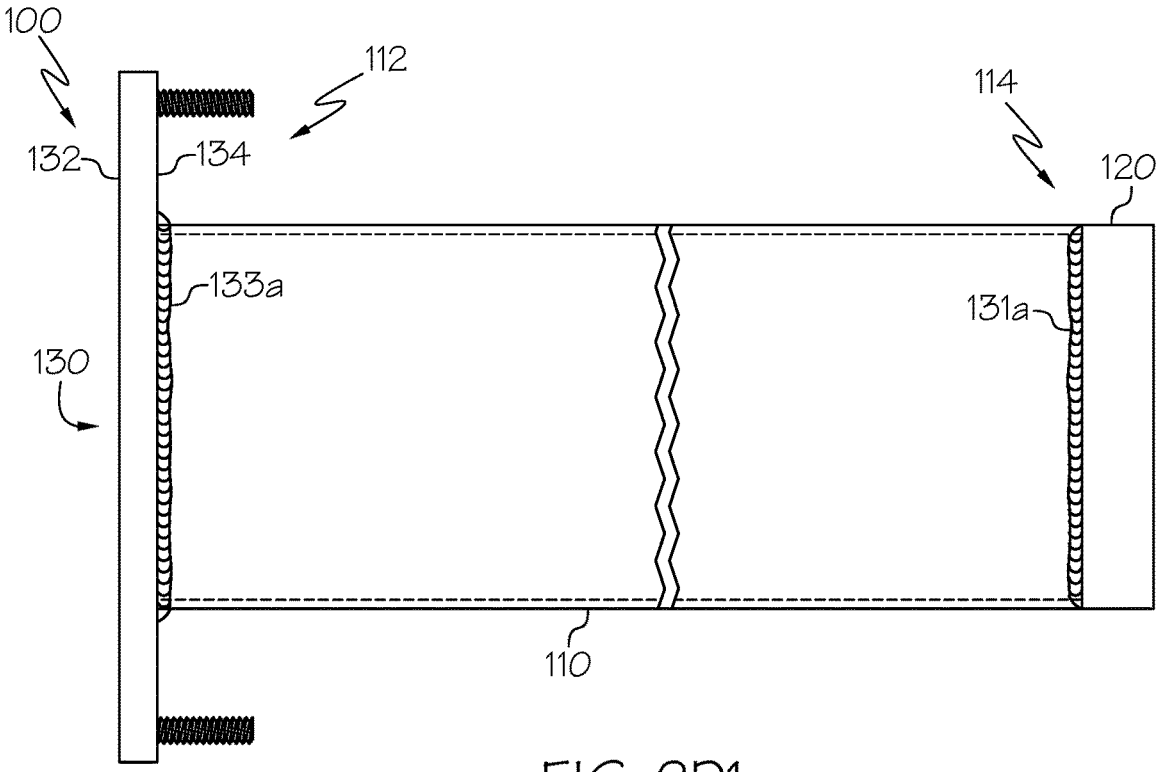
FIG. 2D1
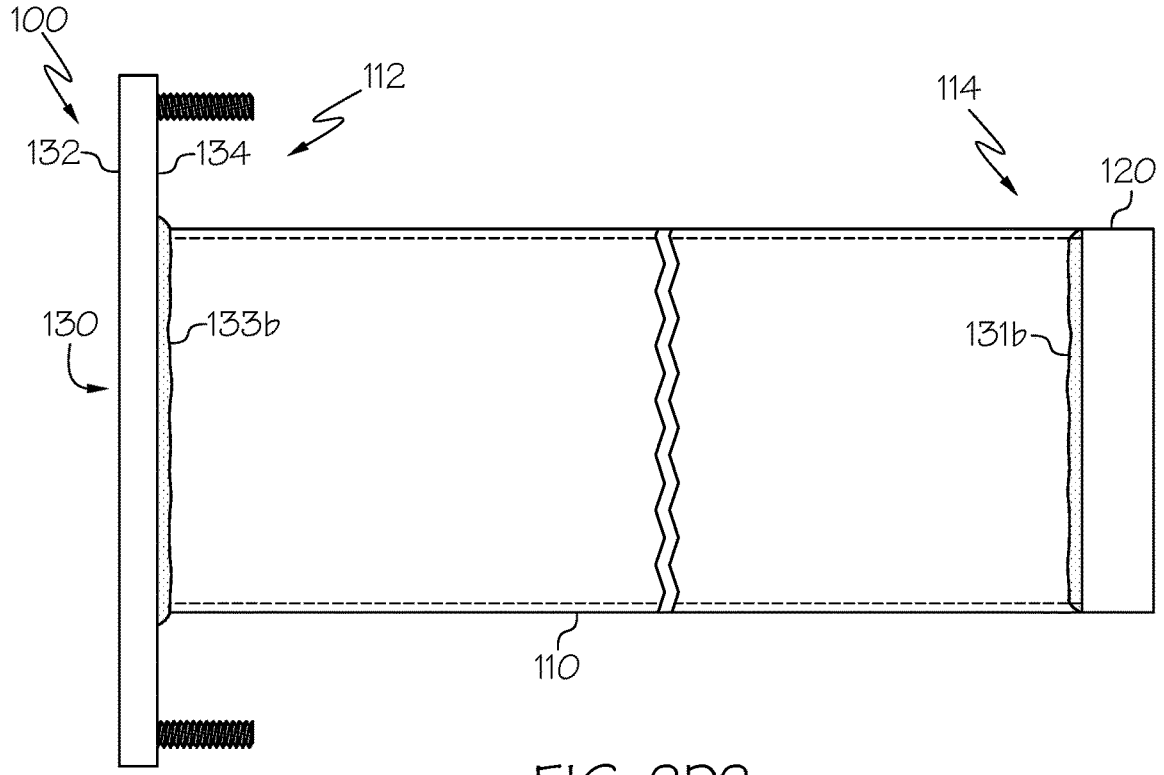
FIG. 2D2

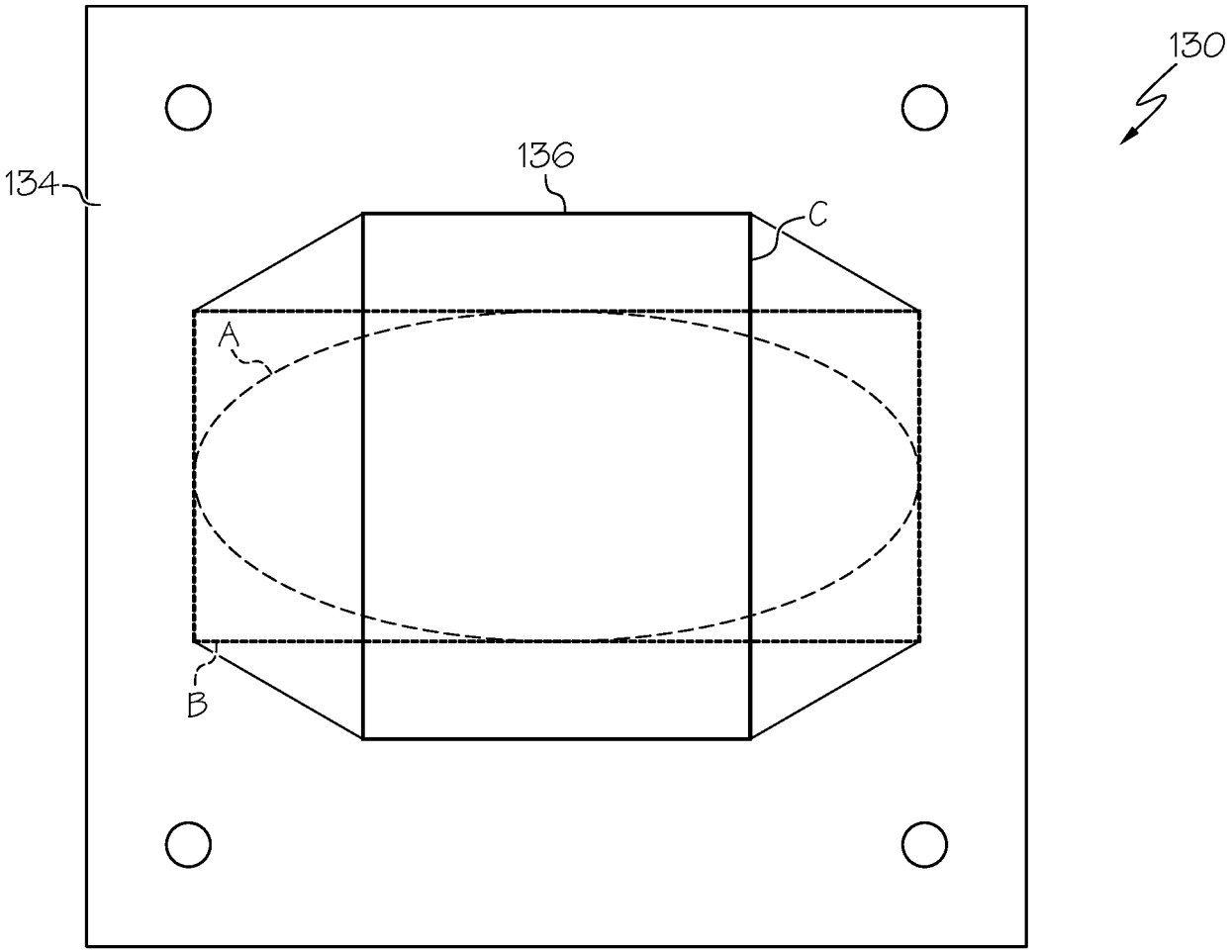
FIG. 2D3

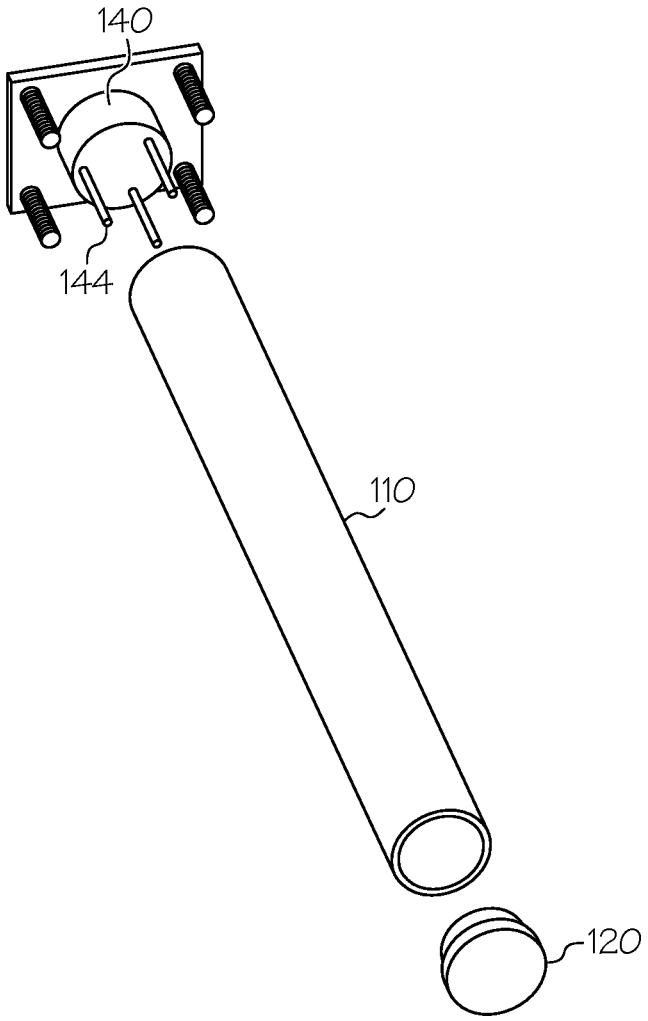
FIG. 2D4

CREMATION STORAGE DEVICE AND SYSTEM, METHODS OF FORMING CREMATION STORAGE DEVICE AND SYSTEM, AND METHODS OF OPERATION OF CREMATION STORAGE DEVICE AND SYSTEM

RELATED APPLICATION

This application claims the benefit of U.S. Provisional Application No. 62/446,288, filed Jan. 13, 2017, the content of which is incorporated herein by reference in its entirety.

BACKGROUND

Honoring of the deceased remains a historic ritual for people of all cultures. The dead are honored in a variety of ceremonies, memorials, sacraments, and traditions. For many cultures and beliefs, remembrance of the dead may be expressed by visiting the locations of the remains of the deceased. Typically, these locations include cemeteries, mausoleums, columbarium, crypts, memorial buildings, etc.

As some religions and cultures practice what may be considered "traditional" rituals involving burial of the dead, others are open to alternatives to these practices that may manifest in a variety of ever-evolving options. Perhaps the most common alternative to burial of a physical body is that of cremation. Due the cost of burials, the limited amount of burial space, the unfavorable environments for burials, weather conditions, and other factors, cremation has become a favorable practice in modern society.

Physical burial of the deceased may not be available to all families living in areas that are ravaged by hurricanes, earthquakes, or flooding. Cemeteries can be destroyed and, in severe instances, remains buried in a cemetery may be inadvertently released into the environment, creating a variety of health hazards to the surrounding areas. This presents enormous public health and sanitation issues for some localities affected by severe weather patterns.

Further, cremation is also a popular choice for pet remains. When a beloved pet dies, many individuals choose to have the body cremated and the ashes stored in an urn or spread in a memorable location. This provides many owners with the comfort of having a special item or place for reflection.

Cremation occurs when the corpse of the deceased is burned using significant heat sources. When burned at extremely high temperatures, the corpse is reduced to carbon-based ash and fragments. Once the cremation is complete, survivors have various options for storage of the cremains. In some cases, ashes are spread and distributed in a designated area such as a memorable place or location. Here, the cremains become part of the natural environment. In other cases, the cremains may be buried or made into objects such as jewelry. However, the most common handling of the ashes tends to come in the form of storing the remains in a container or urn that is placed in a designated location. The practice of storing cremation urns at personal residences is common. Sometimes, urns may also be stored in mausoleums.

SUMMARY

In an aspect, a repository system comprises: a first repository side panel including plurality of first memorial apertures; a second repository side panel including a plurality of second memorial apertures; the first and second repository side panels interfacing at a corner region; and a first corner portion of the first memorial apertures of the first repository side panel and a second corner portion of the second memorial apertures of the second repository panel neighboring each other in the corner region, wherein the first memorial apertures of the first corner portion and the second memorial apertures of the second corner portion have vertical positions that are offset in the vertical direction.

In an embodiment, the plurality of first memorial apertures of the first repository panel are arranged in horizontal rows and vertical columns, and wherein the second memorial apertures of the second repository panel are arranged in horizontal rows and vertical columns;

In an embodiment, the first memorial apertures and the second memorial apertures have vertical positions that correspond to their row heights, and wherein the first memorial apertures and the second memorial apertures have row heights that are offset in the vertical direction.

In an embodiment, a first one of the first memorial apertures of the first corner column is at a first vertical position, a second one of the first memorial apertures of the first corner column is at a second vertical position higher than the first vertical position, and a first one of the second memorial apertures of the second corner column is at a third vertical position, wherein the third vertical position is between the first vertical position and the second vertical position in the vertical direction.

In an embodiment, the repository system further comprises a storage receptacle comprising: a plaque having a front face and a rear face; and a capsule having a first end coupled to the rear face of the plaque.

In an embodiment, the capsule has an interior chamber constructed and arranged to store material.

In an embodiment, the material comprises cremains.

In an embodiment, the capsule further includes a sealing cap at a second end thereof.

In an embodiment, the rear face of the plaque further includes a seat and wherein the first end of the capsule is coupled to the seat.

In an embodiment, the seat comprises a recess positioned on the rear face.

In an embodiment, the seat comprises a raised portion extending from the rear face.

In an embodiment, the front face of the plaque includes a customizable memorial related to content of the capsule.

In an embodiment, the front face of the plaque includes a photograph.

In an embodiment, the front face of the plaque includes a window for viewing of a material positioned within an interior chamber of the capsule.

In an embodiment, the material positioned within the interior chamber of the capsule makes direct contact with the rear face of the plaque.

In an embodiment, the capsule coupled to plaque by at least one coupling taken form the group consisting of: bond, weld, threaded interface, and bolt and nut.

In an embodiment, the capsule comprises a plurality of compartments.

In an embodiment, the repository system further comprises multiple storage receptacles positioned through multiple corresponding ones of the first and second memorial apertures, wherein, for each of the multiple storage receptacles: the plaque is coupled to a first face of the corresponding first or second side panel; and the capsule extends through the corresponding memorial aperture.

In an embodiment, the capsule is coupled exclusively to the plaque.

In an embodiment, the capsule is coupled exclusively to the plaque and contacts at least a portion of the aperture through which the capsule extends.

In an embodiment, a portion of the capsule extending from the memorial aperture, and wherein the portion of the capsule extending from the memorial aperture is suspended above a neighboring capsule.

In an embodiment, a portion of the capsule extending from the memorial aperture, and wherein the portion of the capsule extending from the memorial aperture is cantilevered.

In an embodiment, capsules of the storage receptacles positioned in the corner region avoid contact with each other.

In an embodiment, the storage receptacle further comprise multiple capsules coupled to a common plaque.

In an embodiment, the multiple capsules comprise two, three, four, five, six, or more than six capsules coupled to the common plaque.

In an embodiment, the multiple capsules are positioned on the common plaque to correspond with multiple ones of the memorial apertures to which the storage receptacle is positioned.

In an embodiment, the first and second side panels further comprise recesses at a first face of side panel, wherein the recesses surround the apertures, and wherein the plaques are seated in the recesses.

In an embodiment, the capsule has a cross-sectional shape selected from the set of cross-sectional shapes consisting of: circle, oval, ellipse, triangle, square, rectangle, cross, pentagon hexagon, octagon, and polygon.

In an embodiment, the memorial apertures are spaced apart from each other.

In an embodiment, the memorial apertures have a shape selected from the set of shapes consisting of: circle, oval, ellipse, triangle, square, rectangle, cross, pentagon hexagon, octagon, polygon.

In an embodiment, the first and second side panels are positioned at an angle of 90 degrees relative to each other.

In an embodiment, the repository system further comprises at least one additional side panel, and wherein the at least one additional side panel forms a closed side panel structure with the first and second sidewalls.

In an embodiment, the repository system further comprises third and fourth side panels, and wherein the third and fourth side panels form a closed side panel structure with the first and second sidewalls.

In an embodiment, the repository system further comprises at least one hinge positioned on at least one of the first and second side panels to permit at least a portion of the at least one side panels to pivot relative to a remainder portion of the at least one side panels.

In an embodiment, the hinge is positioned on the at least one of the first and second side panels to permit a horizontal pivot of the at least one portion of the at least one side panels.

In an embodiment, the hinge is positioned on the at least one of the first and second side panels to permit a horizontal pivot of at least a portion of the corner region of the first and second side panels.

In an embodiment, the hinge is positioned on the at least one of the first and second side panels to permit a vertical pivot of the at least one portion of the at least one side panels.

In an embodiment, the hinge is positioned to permit an upward vertical pivot of the at least one portion of the at least one side panels.

In an embodiment, the hinge is positioned to permit a downward vertical pivot of the at least one portion of the at least one side panels.

In an embodiment, the hinge permits access to an interior region of the repository system.

In an embodiment, the repository system further comprises a top panel positioned to covers an interior region between the side panels.

In an embodiment, the top panel includes plurality of top memorial apertures.

In an embodiment, the top memorial apertures are arranged in rows and columns.

In an embodiment, at least one of the first and second side panels comprises multiple side panel segments that are coupled together and lie on a same plane.

In an embodiment, the repository system further comprises an anchor at least one of the multiple side panel segments to provide structural rigidity to the repository system.

In an embodiment, the anchor comprises an extension portion of the side panel segment that extends in a vertical downward direction.

In an aspect, a repository system, comprises: a first elongated capsule coupled to a first repository panel, the first elongated capsule extending in a first axis of extension; a second elongated capsule coupled to the first repository panel, the second elongated capsule extending in a second axis of extension; and a third elongated capsule coupled to a second repository panel, the third elongated capsule extending in a third axis of extension, wherein a portion of the third elongated capsule is positioned between a portion of the first elongated capsule and a portion of the second elongated capsule.

In an embodiment, the first axis of extension and the second axis of extension lie on a plane and wherein the third axis of extension intersects the plane.

In an embodiment, the portion of the third elongated capsule is positioned directly between the portion of the first elongated capsule and the portion of the second elongated capsule.

In an embodiment, the first repository panel and the second repository panel each comprise a side panel of the repository system.

In an embodiment, the first repository panel comprises a side panel of the repository system and wherein the second repository panel comprises a top panel of the repository system.

In an embodiment, the first repository panel includes a plurality of first memorial apertures and wherein the second repository panel includes a plurality of second memorial apertures In an embodiment, the plurality of first memorial apertures of the first repository panel are arranged in horizontal rows and vertical columns, and wherein the second memorial apertures of the second repository panel are arranged in horizontal rows and vertical columns.

In an embodiment, the repository system further comprises a storage receptacle comprising: a plaque having a front face and a rear face; and one of the capsules, having a first end coupled to the rear face of the plaque.

In an embodiment, the capsule has an interior chamber constructed and arranged to store material.

In an embodiment, the material comprises cremains.

In an embodiment, the capsule further includes a sealing cap at a second end thereof.

In an embodiment, the rear face of the plaque further includes a seat and wherein the first end of the capsule is coupled to the seat.

In an embodiment, wherein the seat comprises a recess positioned on the rear face.

In an embodiment, the seat comprises a raised portion extending from the rear face.

In an embodiment, the front face of the plaque includes a customizable memorial related to content of the capsule.

In an embodiment, the front face of the plaque includes a photograph.

In an embodiment, the front face of the plaque includes a window for viewing of a material positioned within an interior chamber of the capsule In an embodiment, the material positioned within the interior chamber of the capsule makes direct contact with the rear face of the plaque.

In an embodiment, the capsule is coupled to plaque by at least one coupling taken form the group consisting of: bond, weld, threaded interface, and bolt and nut.

In an embodiment, the capsule comprises a plurality of compartments.

In an embodiment, the repository system further comprises multiple storage receptacles positioned through multiple corresponding ones of the first and second memorial apertures, wherein, for each of the multiple storage receptacles: the plaque is coupled to a first face of the corresponding first or second repository panel; and the capsule extends through the corresponding memorial aperture.

In an embodiment, the capsule is coupled exclusively to the plaque.

In an embodiment, the capsule is coupled exclusively to the plaque and contacts at least a portion of the aperture through which the capsule extends.

In an embodiment, a portion of the capsule extending from the memorial aperture is suspended above a neighboring capsule.

In an embodiment, a portion of the capsule extending from the memorial aperture is cantilevered.

In an embodiment, capsules of the storage receptacles positioned in the corner region avoid contact with each other.

In an embodiment, the storage receptacle further comprise multiple capsules coupled to a common plaque.

In an embodiment, the multiple capsules comprise two, three, four, five, six, or more than six capsules coupled to the common plaque.

In an embodiment, the multiple capsules are positioned on the common plaque to correspond with multiple ones of the memorial apertures to which the storage receptacle is positioned.

In an embodiment, the first and second repository panels further comprise recesses at a first face of the repository panel, wherein the recesses surround the apertures, and wherein the plaques are seated in the recesses.

In an embodiment, the capsule has a cross-sectional shape selected from the set of cross-sectional shapes consisting of: circle, oval, ellipse, triangle, square, rectangle, cross, pentagon hexagon, octagon, and polygon.

In an embodiment, the memorial apertures are spaced apart from each other.

In an embodiment, the memorial apertures have a shape selected from the set of shapes consisting of: circle, oval, ellipse, triangle, square, rectangle, cross, pentagon hexagon, octagon, polygon.

In an embodiment, the first and second repository panels are positioned at an angle of 90 degrees relative to each other.

In an embodiment, the repository system further comprises at least one additional repository panel, and wherein the at least one additional repository panel forms a closed repository panel structure with the first and second repository panels.

In an embodiment, the repository system further comprises third and fourth repository panels, and wherein the third and fourth repository panels form a closed side panel structure with the first and second repository walls.

In an embodiment, the repository system further comprises at least one hinge positioned on at least one of the first and second repository panels to permit at least a portion of the at least one repository panels to pivot relative to a remainder portion of the at least one repository panels.

In an embodiment, the hinge is positioned on the at least one of the first and second repository panels to permit a horizontal pivot of the at least one portion of the at least one repository panels.

In an embodiment, the hinge is positioned on the at least one of the first and second repository panels to permit a horizontal pivot of at least a portion of the corner region of the first and second repository panels.

In an embodiment, the hinge is positioned on the at least one of the first and second repository panels to permit a vertical pivot of the at least one portion of the at least one repository panels.

In an embodiment, the hinge is positioned to permit an upward vertical pivot of the at least one portion of the at least one repository panels.

In an embodiment, the hinge is positioned to permit a downward vertical pivot of the at least one portion of the at least one repository panels.

In an embodiment, the hinge permits access to an interior region of the repository system.

In an embodiment, the repository system further comprises a top panel positioned to cover an interior region between the repository panels.

In an embodiment, the top panel includes plurality of top memorial apertures.

In an embodiment, the top memorial apertures are arranged in rows and columns.

In an embodiment, at least one of the first and second repository panels comprises multiple repository panel segments that are coupled together and lie on a same plane.

In an embodiment, the repository system further comprises an anchor at least one of the multiple repository panel segments to provide structural rigidity to the repository system (extension of panel)

In an embodiment, the anchor comprises an extension portion of the repository panel segment that extends in a vertical downward direction.

In an aspect, a repository system, comprises: a repository panel including a plurality of memorial apertures, the repository panel including a front face and a rear face, wherein the plurality of memorial apertures pass through the front face to the rear face of the repository panel; and a storage receptacle coupled to the repository panel at one of the memorial apertures, the storage receptacle comprising: a plaque having a front face and a rear face; and a capsule having a first end coupled to the rear face of the plaque; the rear face of the plaque of the storage receptacle contacting the front face of the repository panel, the capsule extending through the corresponding memorial aperture to extend from the rear face of the repository panel, wherein the capsule is coupled exclusively to the rear face of the plaque.

In an embodiment, the plurality of first memorial apertures of the first repository panel are arranged in horizontal rows and vertical columns.

In an embodiment, the capsule has an interior chamber constructed and arranged to store material.

In an embodiment, the material comprises cremains.

In an embodiment, the capsule further includes a sealing cap at a second end thereof.

In an embodiment, the rear face of the plaque further includes a seat and wherein the first end of the capsule is coupled to the seat.

In an embodiment, the seat comprises a recess positioned on the rear face.

In an embodiment, the seat comprises a raised portion extending from the rear face.

In an embodiment, the front face of the plaque includes a customizable memorial related to content of the capsule.

In an embodiment, the front face of the plaque includes a photograph.

In an embodiment, the front face of the plaque includes a window for viewing of a material positioned within an interior chamber of the capsule In an embodiment, the material positioned within the interior chamber of the capsule makes direct contact with the rear face of the plaque.

In an embodiment, the capsule coupled to plaque by at least one coupling taken form the group consisting of: bond, weld, threaded interface, and bolt and nut.

In an embodiment, the capsule comprises a plurality of compartments.

In an embodiment, the capsule is coupled exclusively to the plaque and contacts at least a portion of the memorial aperture through which the capsule extends.

In an embodiment, a portion of the capsule extending from the memorial aperture is suspended above a neighboring capsule.

In an embodiment, a portion of the capsule extending from the memorial aperture is cantilevered.

In an embodiment, the storage receptacle further comprise multiple capsules coupled to a common plaque.

In an embodiment, the multiple capsules comprise two, three, four, five, six, or more than six capsules coupled to the common plaque.

In an embodiment, the multiple capsules are positioned on the common plaque to correspond with multiple ones of the memorial apertures to which the storage receptacle is positioned.

In an embodiment, the repository panel further comprises recesses at a first face of side panel, wherein the recesses surround the apertures, and wherein the plaque of the storage receptacle is seated in the recesses.

In an embodiment, the capsule has a cross-sectional shape selected from the set of cross-sectional shapes consisting of: circle, oval, ellipse, triangle, square, rectangle, cross, pentagon hexagon, octagon, and polygon.

In an embodiment, the memorial apertures are spaced apart from each other.

In an embodiment, the memorial apertures have a shape selected from the set of shapes consisting of: circle, oval, ellipse, triangle, square, rectangle, cross, pentagon hexagon, octagon, polygon.

In another aspect, a novel and improved receptacle for cremains is provided. A novel urn system provides safe and secure storage for cremains.

In another aspect, a storage repository provides for the efficient storage of a plurality of receptacles.

In another aspect, a repository system provides for the storage of cremated remains in an efficient, inexpensive, and convenient manner. Further, the repository system provides for the storage receptacles to be readily installed, stored, secured, removed and transported. The repository system provides for a storage site for convenient visitation. The storage receptacles can be readily removed and transported to a new location.

In another aspect, a repository system provides for the storage of cremated remains, which can be readily and inexpensively fabricated and assembled, and efficiently positioned in a variety of settings, including small, limited-space areas, while still providing suitable interment for a large number of individual urns or storage receptacles.

In another aspect, a repository system is provided that is structurally strong to secure and safely store the cremated remains during severe weather, natural disaster, and other environmental hardships.

BRIEF DESCRIPTION OF THE DRAWINGS

The foregoing and other objects, features and advantages of embodiments of the present inventive concepts will be apparent from the more particular description of embodiments, as illustrated in the accompanying drawings in which like reference characters refer to the same elements throughout the different views. The drawings are not necessarily to scale, emphasis instead being placed upon illustrating the principles of the embodiments.

FIGS. 2C, 2C1, 2C2, and 2C3 are side views of various storage receptacles in accordance with embodiments of the present inventive concepts.

FIGS. 2D1 and 2D2 are side views of various storage receptacles in accordance with embodiments of the present inventive concepts. FIG. 2D3 is a back view of the plaque in accordance with embodiments of the present inventive concepts. FIG. 2D4 is a perspective view of the storage receptacle comprising a seat a one or more alignment pins that mate with one or more similarly arranged alignment receptacles of the capsule in accordance with embodiments of the present inventive concepts.

DETAILED DESCRIPTION

Figure 1:
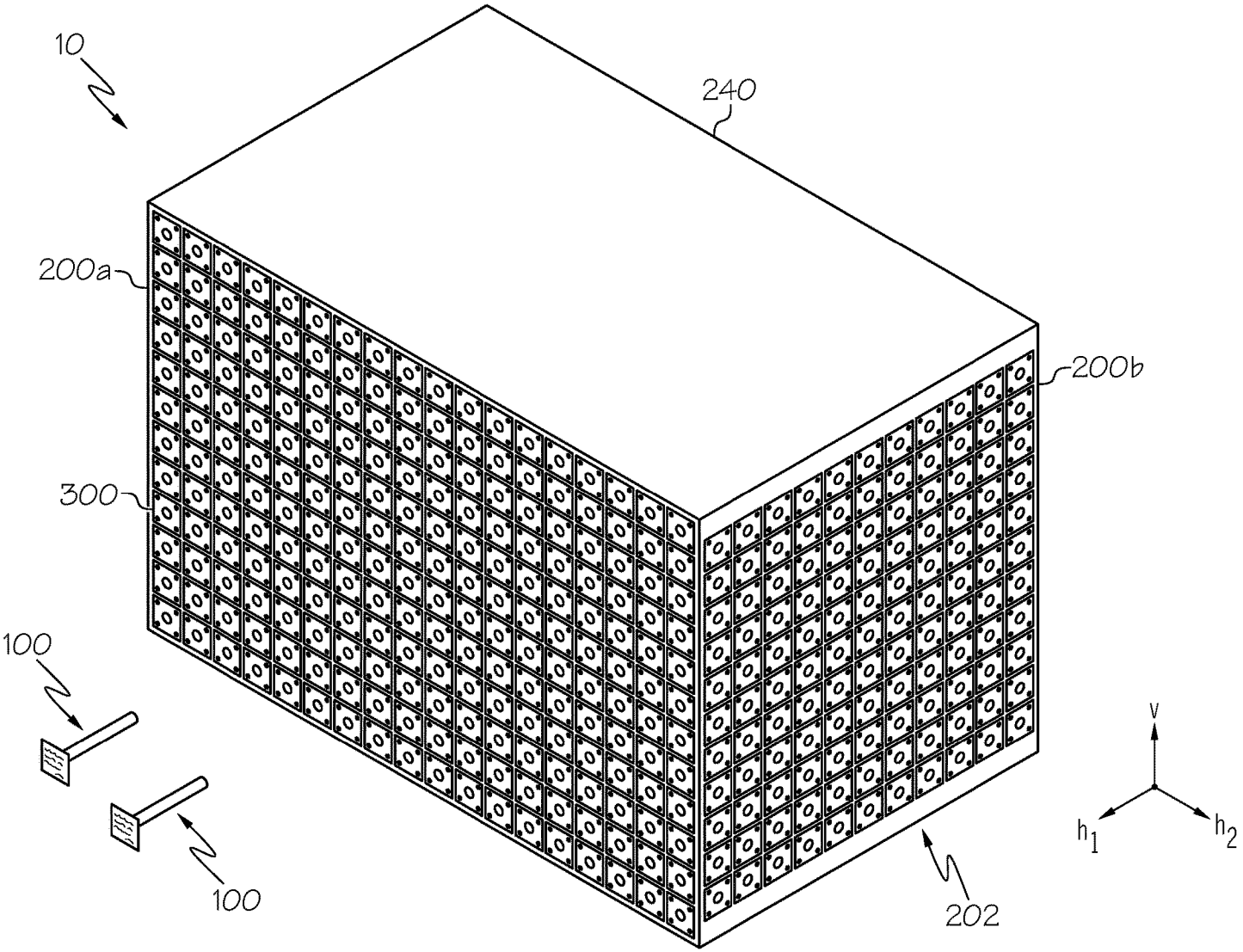
FIG. 1 is a perspective view of a repository system in accordance with embodiments of the present inventive concepts.

Reference will now be made in detail to the present embodiments of the technology, examples of which are illustrated in the accompanying drawings. Similar reference numbers may be used to refer to similar components. However, the description is not intended to limit the present disclosure to particular embodiments, and it should be construed as including various modifications, equivalents, and/or alternatives of the embodiments described herein.

It will be understood that the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") when used herein, specify the presence of stated features, integers, steps, operations, elements, and/or components, but do not preclude the presence or addition of one or more other features, integers, steps, operations, elements, components, and/or groups thereof.

It will be further understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on", "attached", "connected" or "coupled" to another element, it can be directly on or above, or connected or coupled to, the other element, or one or more intervening elements can be present. In contrast, when an element is referred to as being "directly on", "directly attached", "directly connected" or "directly coupled" to another element, there are no intervening elements present. Other words used to describe the relationship between elements should be interpreted in a like fashion (e.g. "between" versus "directly between," "adjacent" versus "directly adjacent," etc.).

It will be further understood that when a first element is referred to as being "in", "on" and/or "within" a second element, the first element can be positioned: within an internal space of the second element, within a portion of the second element (e.g. within a wall of the second element); positioned on an external and/or internal surface of the second element; and combinations of one or more of these.

As used herein, the term "proximate" shall include locations relatively close to, on, in and/or within a referenced component, anatomical location, or other location.

Spatially relative terms, such as "beneath," "below," "lower," "above," "upper" and the like may be used to describe an element and/or feature's relationship to another element(s) and/or feature(s) as, for example, illustrated in the figures. It will be further understood that the spatially relative terms are intended to encompass different orientations of the device in use and/or operation in addition to the orientation depicted in the figures. For example, if the device in a figure is turned over, elements described as "below" and/or "beneath" other elements or features would then be oriented "above" the other elements or features. The device can be otherwise oriented (e.g. rotated 90 degrees or at other orientations) and the spatially relative descriptors used herein interpreted accordingly.

The terms "reduce", "reducing", "reduction" and the like, where used herein, are to include a reduction in a quantity, including a reduction to zero. Reducing the likelihood of an occurrence shall include prevention of the occurrence.

The term "and/or" where used herein is to be taken as specific disclosure of each of the two specified features or components with or without the other. For example, "A and/or B" is to be taken as specific disclosure of each of (i) A, (ii) B and (iii) A and B, just as if each is set out individually herein.

In this specification, unless explicitly stated otherwise, "and" can mean "or," and "or" can mean "and." For example, if a feature is described as having A, B, or C, the feature can have A, B, and C, or any combination of A, B, and C. Similarly, if a feature is described as having A, B, and C, the feature can have only one or two of A, B, or C.

The expression "configured (or set) to" used in the present disclosure may be used interchangeably with, for example, the expressions "suitable for", "having the capacity to", "designed to", "adapted to", "made to" and "capable of" according to a situation. The expression "configured (or set) to" does not mean only "specifically designed to" in hardware. Alternatively, in some situations, the expression "a device configured to" may mean that the device "can" operate together with another device or component.

It is appreciated that certain features of the disclosure, which are, for clarity, described in the context of separate embodiments, may also be provided in combination in a single embodiment. Conversely, various features of the disclosure which are, for brevity, described in the context of a single embodiment, may also be provided separately or in any suitable sub-combination. For example, it will be appreciated that all features set out in any of the claims (whether independent or dependent) can be combined in any given way.

It is to be understood that at least some of the figures and descriptions of the disclosure have been simplified to focus on elements that are relevant for a clear understanding of the disclosure, while eliminating, for purposes of clarity, other elements that those of ordinary skill in the art will appreciate may also comprise a portion of the disclosure. However, because such elements are well known in the art, and because they do not necessarily facilitate a better understanding of the disclosure, a description of such elements is not provided herein.

Terms defined in the present disclosure are only used for describing specific embodiments of the present disclosure and are not intended to limit the scope of the present disclosure. Terms provided in singular forms are intended to include plural forms as well, unless the context clearly indicates otherwise. All of the terms used herein, including technical or scientific teal's, have the same meanings as those generally understood by an ordinary person skilled in the related art, unless otherwise defined herein. Terms defined in a generally used dictionary should be interpreted as having meanings that are the same as or similar to the contextual meanings of the relevant technology and should not be interpreted as having ideal or exaggerated meanings, unless expressly so defined herein. In some cases, terms defined in the present disclosure should not be interpreted to exclude the embodiments of the present disclosure.

FIG. 1 is a perspective view of a repository system 10 in accordance with embodiments of the present inventive concepts. The repository system 10 may comprise at least one repository panel 200. The at least one repository panel 200 may comprise at least one memorial position 300. Each memorial position 300 is constructed and arranged to receive at least one storage receptacle 100. In some embodiments, the repository system 10 comprises four side panels 200, a top panel 240, and a bottom panel 202. The bottom panel 202 may be constructed and arranged to provide system rigidity and seal the enclosure.

Figure 2B:
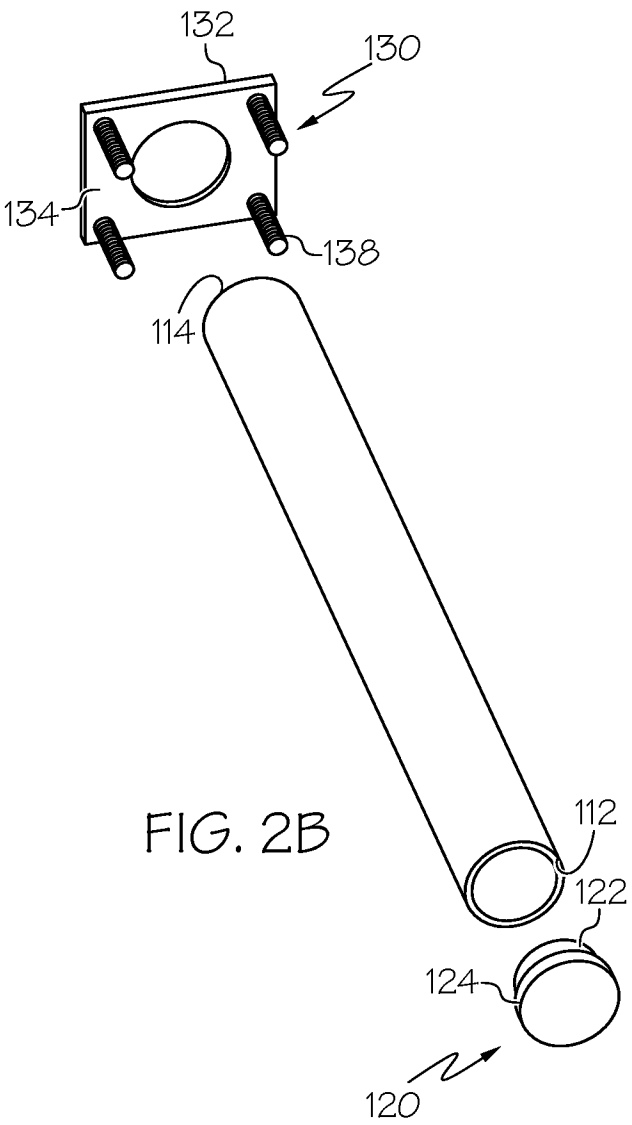
FIGS. 2A and 2B are disassembled perspective views of a storage receptacle in accordance with embodiments of the present inventive concepts.
Figure 2A:
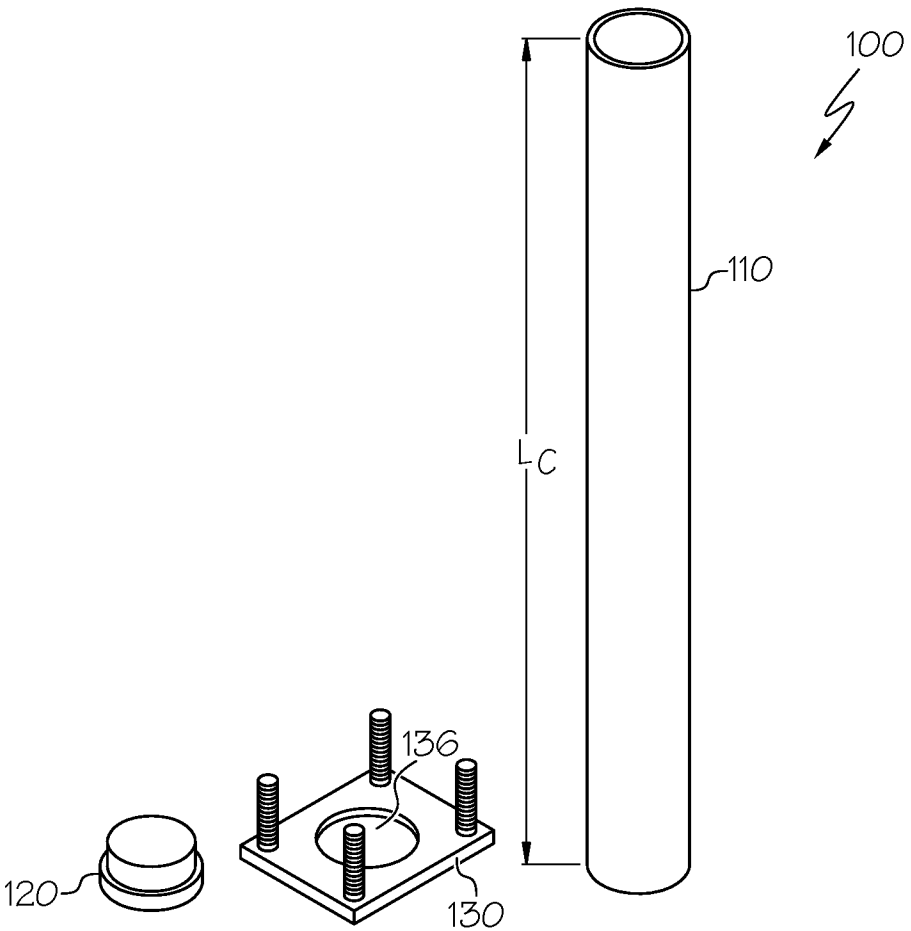
Figure 2C:
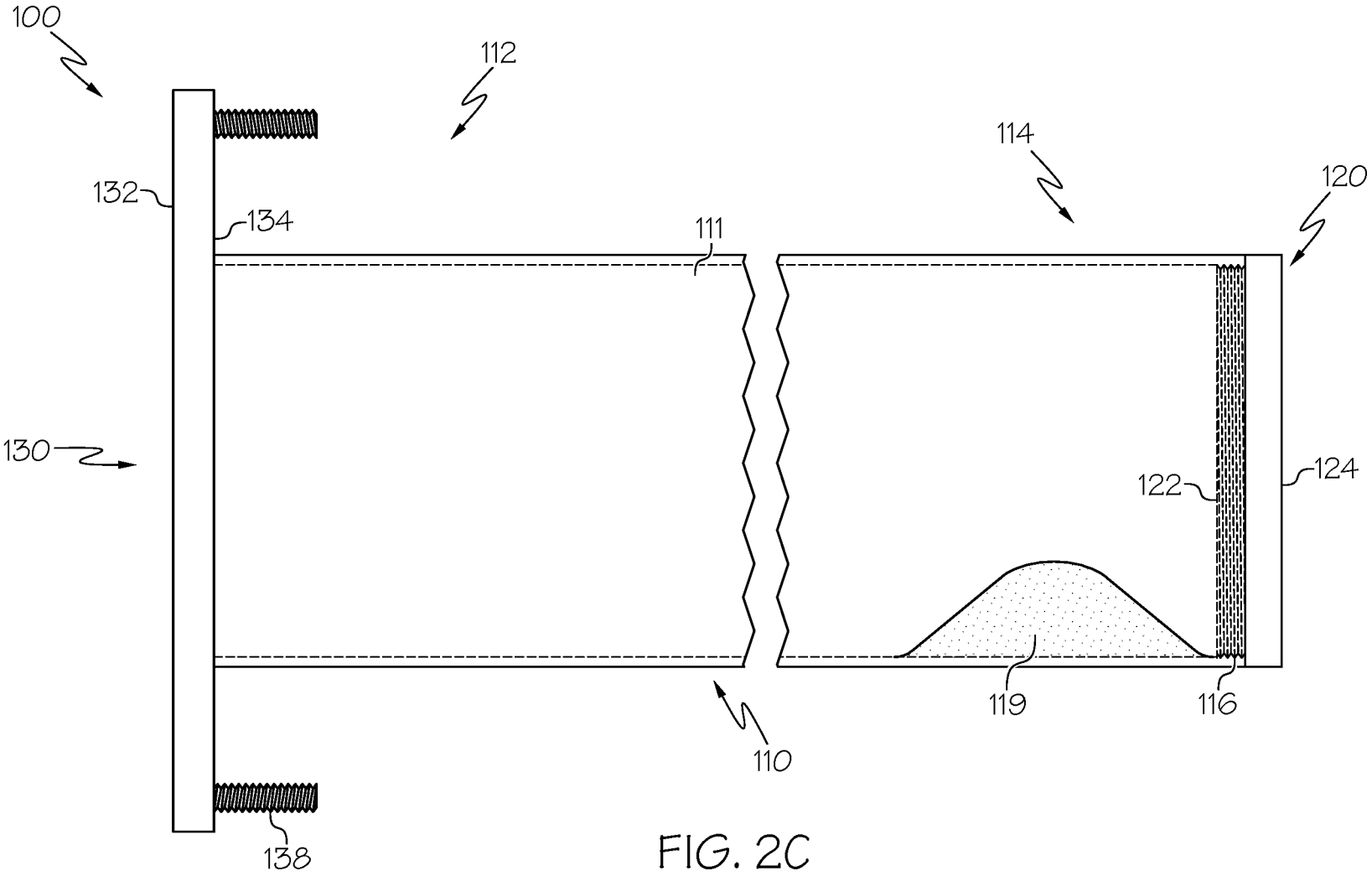
Figure 2E:
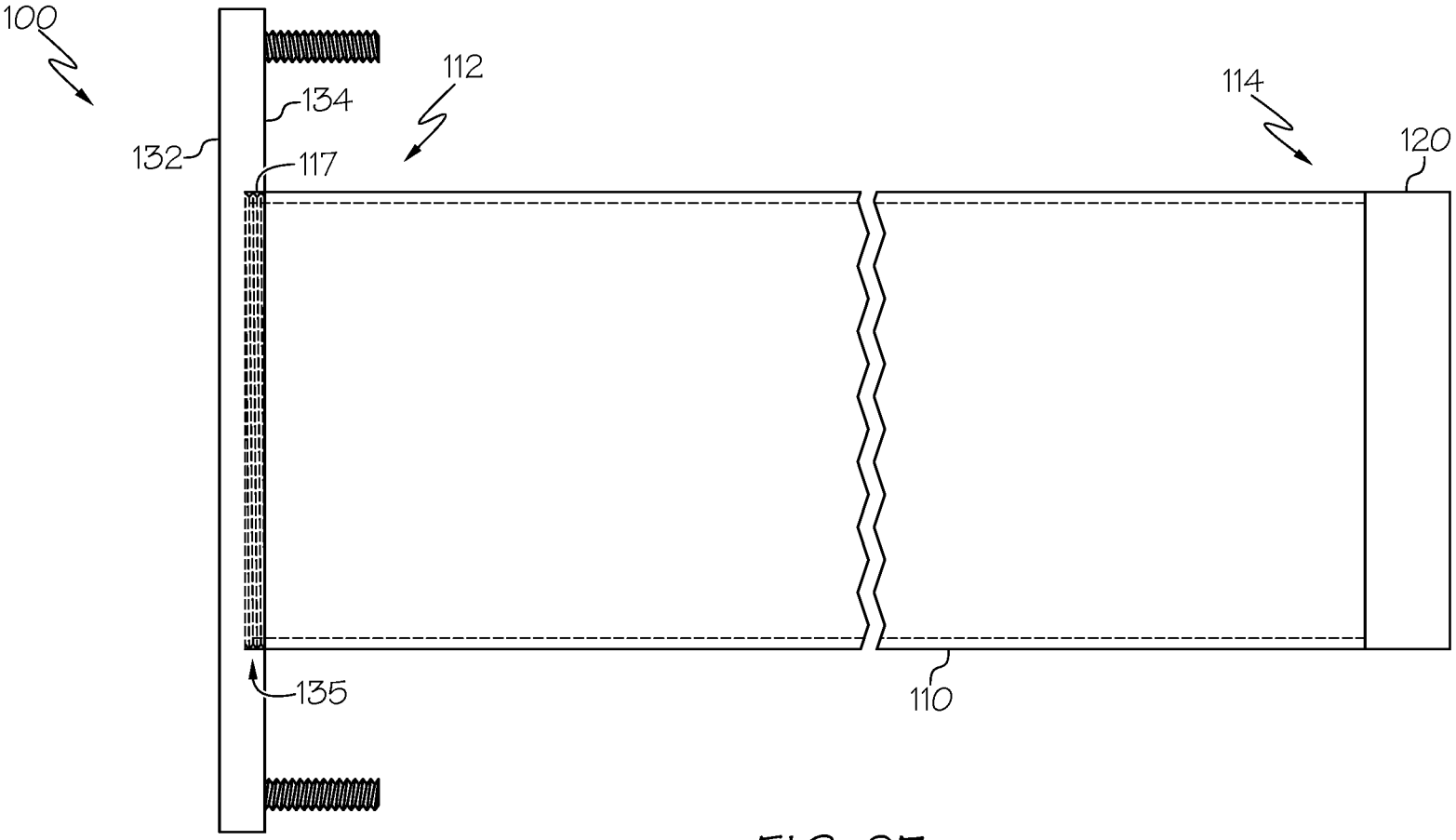
FIGS. 2E, 2F, and 2G are side views of various storage receptacles in accordance with embodiments of the present inventive concepts.

FIGS. 2A and 2B are disassembled perspective views of a storage receptacle 100 in accordance with embodiments of the present inventive concepts. FIGS. 2C, 2C1 and 2C2 are side views of various storage receptacles 100 in accordance with embodiments of the present inventive concepts. In some embodiments, the storage receptacle 100 is constructed and arranged to store cremated remains (also referred to as cremains), or other remains, or mementos. In some embodiments, the storage receptacle 100 comprises a capsule 110 and a plaque 130. In some embodiments, the storage receptacle 100 comprises a capsule 110, a sealing cap 120, and a plaque 130.

Referring to FIG. 2C1, the capsule 110 may comprise an interior chamber 111 that is constructed and arranged to store cremated remains, other remains, or momentos. Referring to FIG. 2C2, in some embodiments, the capsule 110 comprises a plurality of interior chambers 111*a*, 111*b*. The plurality of chambers 111*a*, 111*b* can be separated from each other by an inner wall 127. A proximal end 112 of the capsule 110 may be coupled to the plaque 130. A distal end 114 of the capsule 110 may be coupled to the sealing cap 120.

In the embodiment shown in FIGS. 2A and 2B, the capsule 110 has a cylindrical shape. In other embodiments, the capsule 110 may have a different shape. In some embodiments, the outer cross-section of the capsule 110 may take on different shapes including, but not limited to, a rectangle, an oval, a cross, a triangle, a pentagon, a hexagon, an octagon, or any suitable geometric shape. Referring to FIG. 2C3, a triangular 110*t*, octagonal 110*u*, and rectangular 110*v* capsule cross-sections are shown. Similarly, referring to FIG. 2C3, a square 130*t*, octagonal 130*u*, and rectangular 130*v* plaques are shown. Many shape configurations are possible. In some embodiments, the shape of the cross-section of the capsule may be customized by the client. Returning back to FIGS. 2A and 2B, the length Lc of the capsule 110 may vary, depending on the application. In some embodiments, the capsule 110 is 12 inches long and has a diameter of 2 ½ inches. The capsule 110 may be constructed from a variety of different sturdy materials, such as, but not limited to, stainless steel, brass, bronze, acrylic, ceramic, composite, graphite, plastic, stone, metal, alloy, wood, etc.

In some embodiments, the sealing cap 120 is constructed and arranged to couple with the distal end 114 of the capsule 110 such that the remains are sealed within the capsule 110. In some embodiments, the sealing cap 120 comprises an inner region 122 and an outer region 124. The inner region 122 of the sealing cap 120 may be constructed and arranged to fit inside the capsule 110 to allow the outer dimensions of the outer region 124 of the sealing cap 120 to be the same as the outer dimensions of the capsule 110. In this manner, the outer perimeter of the sealing cap 120 and the outer perimeter of the capsule 110 align.

Referring to FIG. 2D1, in some embodiments, the sealing cap 120 is glued or bonded to the capsule 110 at bond 131*a*. Referring to FIG. 2D2, in some embodiments, the sealing cap 120 is welded to the capsule 110 at weld 131*b*. In some embodiments, the sealing cap 120 is coupled to the capsule 110 using magnets. In some embodiments, a threaded region 126 at the sealing cap 120 couples with a first threaded region 116 at the diatal end 114 of capsule 100, as shown in FIG. 2C for securing the sealing cap 120 to the capsule 100. The sealing cap 120 may be constructed from a variety of different suitable sturdy materials, such as, but not limited to, stainless steel, brass, bronze, acrylic, ceramic, composite, graphite, plastic, stone, metal, alloy, wood, etc.

In some embodiments, the plaque 130 comprises a front face 132 and a rear face 134. In some embodiments, the front face 132 may be customized to include engravings, etchings, artwork, pictures, and the like. In some embodiments, the rear face of the plaque 134 may comprise at least one threaded rod 138. Examples of the at least one threaded rod may include, but are not limited to, a screw or a threaded bolt, etc. In the embodiment of FIG. 2B, the storage receptacle 100 includes four threaded rods 138. In other embodiments, the storage receptacle 100 may include less than four or greater than four threaded rods 138. In some embodiments, the plaque 130 includes a customizable memorial related to content of the capsule. In some embodiments, the plaque 130 includes a window for viewing of a material positioned within an interior chamber of the capsule 110.

In the embodiment shown in FIGS. 2A and 2B, the plaque 130 has a substantially square shape. In other embodiments, the plaque 130 may have a different shape, for example, possible shapes include, but are not limited to, a circle, a rectangle, a cross, for example, as shown and described in connection with FIG. 2C3. In some embodiments, the plaque 130 may be constructed and arranged to secure a photograph. In some embodiments, the plaque 130 may be constructed and arranged to secure a drawing or other artwork. The embodiment shown in FIGS. 2A and 2B shows the plaque 130 of a square size. In some embodiments, the plaque 130 may be five inches in width by five inches in height. In other embodiments, the plaque 130 may be of a different size. In some embodiments, different plaques 130 positioned in the repository system 10 may have different respective sizes.

FIG. 2D3 is a back view of the plaque 130 in accordance with embodiments of the present inventive concepts. In some embodiments, the capsule 110 may rest against the plaque 130 and be sufficiently sealed against the plaque 130. In some embodiments, the rear face 134 of the plaque 130 may comprise a recess 136. In some embodiments, the recess 136 provides a designated location for positioning the capsule 110 at the rear face of the plaque 134. In this manner, the capsule 110 can be sealed to the rear face 134, resulting in the configuration depicted and described herein in connection with the embodiment of FIG. 2H.

In the embodiment shown in FIG. 2D3, the recess 136 is constructed and arranged so that it may couple with different types of capsules 110. The recess 136 that is shown may accommodate a capsule 110 that has differently shaped cross-sections including, but not limited to, an oval A, a horizontal rectangle B, or a vertical rectangle C. The shapes shown in FIG. 2D are only examples and the recess 136 shown can also couple with capsules 110 with differently shaped cross-sections. In other embodiments, the recess 136 may have a different shape, for example, possible shapes include, but are not limited to, a circle, a square, a rectangle, a cross, etc.

In some embodiments, rather than a recess 136, the plaque 130 may include a seat 140 for mating with the capsule 110. In some embodiments, the seat 140 comprises a raised surface that extends from the rear face 134 of the plaque 130. The seat 140 may be coupled to the plaque different ways including, but not limited to, welded, bonded, threaded, etc. In some embodiments, the seat 140 comprises a recess positioned on the rear face 134 of the plaque 130.

Referring to the embodiment of FIG. 2D4, in some embodiments, the seat 140 may comprise one or more alignment pins 144 that mate with one or more similarly arranged alignment receptacles of the capsule 110. In some embodiments, the seat 140 may comprise one or more receptacles that mate with one or more alignment pins of the main capsule chamber 110. Any of a number of coupling mechanisms for coupling the capsule 110 to the plaque 130 are equally applicable to the principles of the present inventive concepts. In some embodiments, the capsule 110 and the plaque 130 comprise a unitary structure that is formed as a result of molding.

Figure 2F:
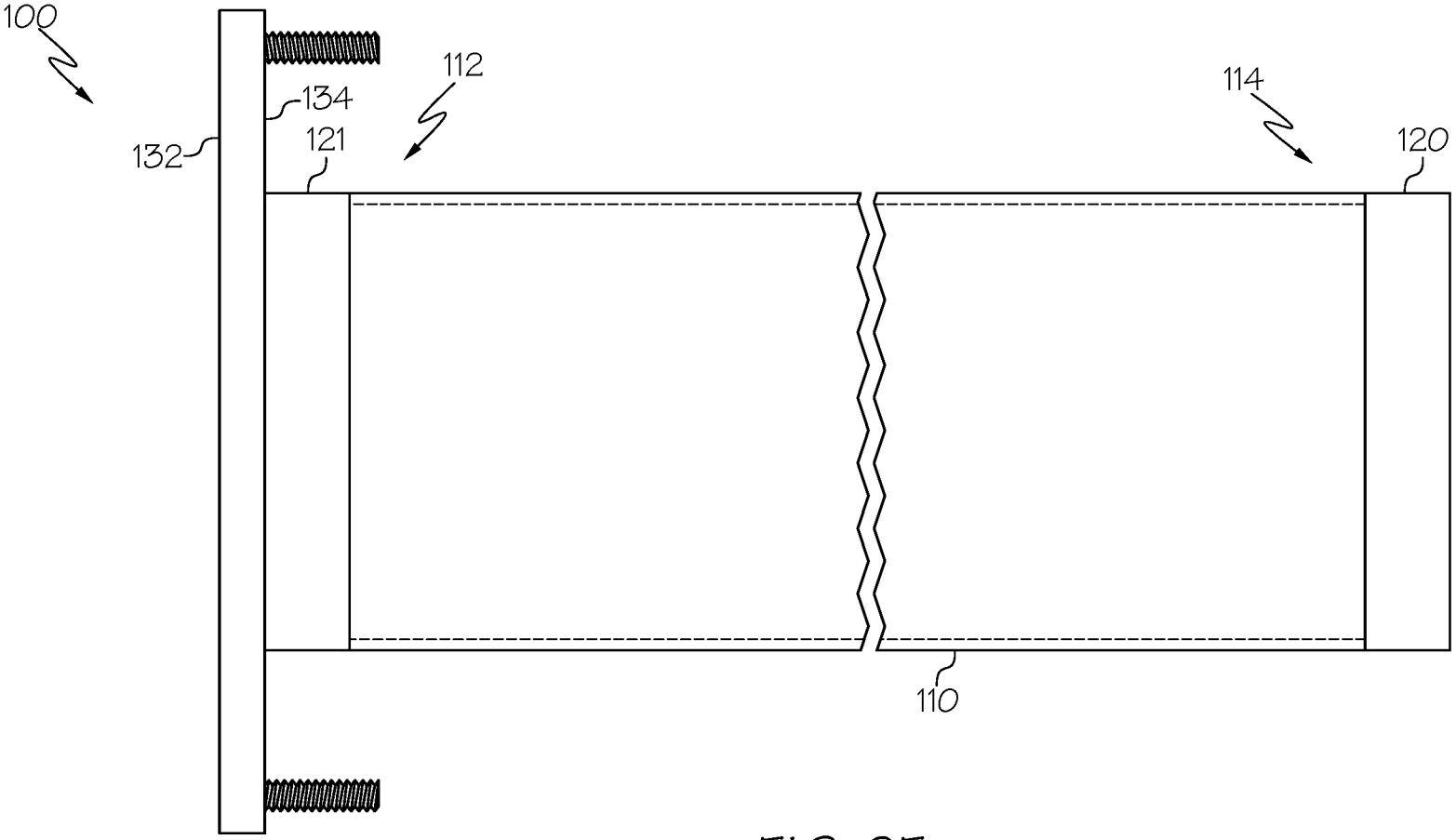
Figure 2G:
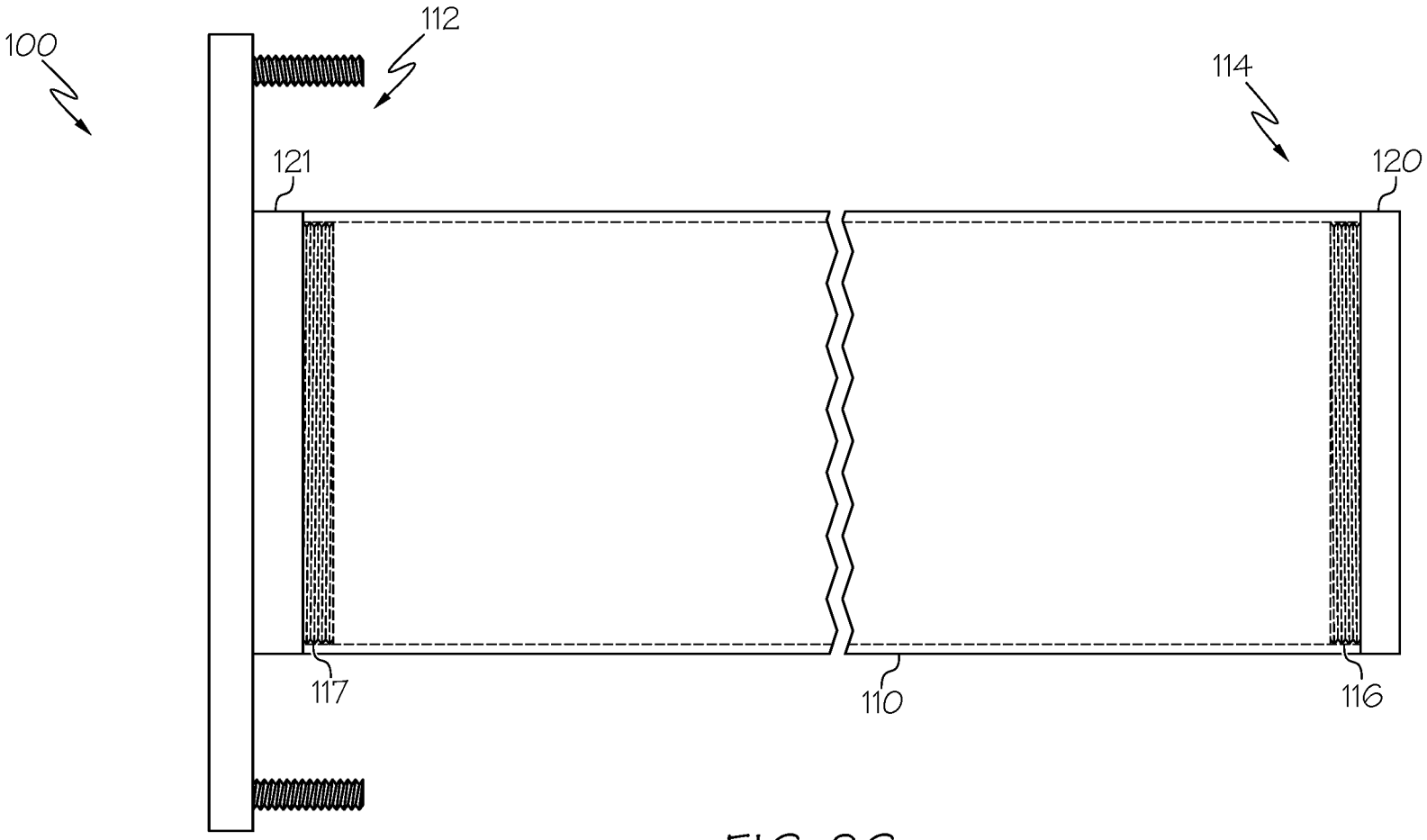

In the embodiment of FIG. 2D1, a proximal end of the capsule 110 is bonded to the rear face 134 of the plaque 130 at bond 133*a*. In the embodiment of FIG. 2D2, a proximal end of the capsule 110 is welded to the rear face 134 of the plaque 130 at weld 133*a*. In some embodiments, the plaque 130 is coupled to the capsule 110 using magnets. Referring to the embodiment of FIG. 2E, in some embodiments, a threaded region 135 at the plaque 130 couples with a second threaded region 117 at the proximal end 112 of the main capsule chamber 110. Referring to FIG. 2F, 2G, in some embodiments, a second sealing cap 121 is coupled to the proximal end 112 of the main capsule chamber 110. In embodiments including a second sealing cap 121, the second sealing cap 121 may couple to the plaque 130 via any of the coupling approaches described herein.

In some embodiments, the plaque 130 may be made of materials similar to those of the main capsule chamber 110. In some embodiments, the plaque 130 is made from one or more materials that may be engraved to provide customizable designs for the user. Such materials may include, but are not limited to stainless steel, brass, bronze, acrylic, ceramic, composite, graphite, plastic, stone, metal, alloy, wood, etc.

Figure 2H:
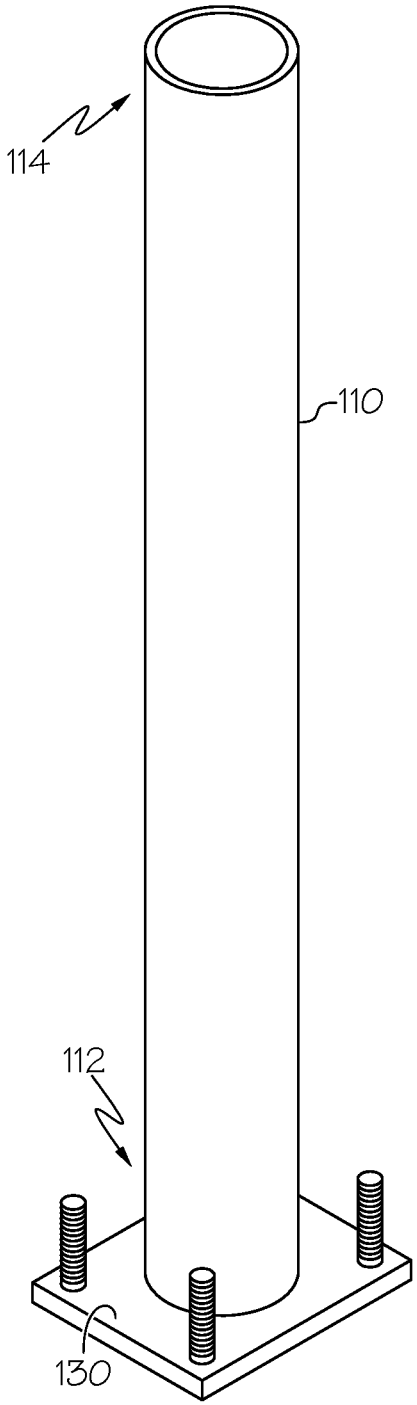
FIG. 2H is an enlarged view of one embodiment of the capsule having its proximal end sealed and secured to the plaque in accordance with embodiments of the present inventive concepts.

FIG. 2H is an enlarged view of one embodiment of the capsule 100 having its proximal end 112 sealed and secured to the plaque 130 in accordance with embodiments of the present inventive concepts.

In some embodiments, several capsules 110 may be grouped together behind one common plaque 130 to correspond with multiple ones of the memorial apertures to which the storage receptacle is positioned. This design allows for a family plot-like scenario, where the remains of families, spouses, siblings, etc. may be grouped together. This presents a more intimate burial system and convenient visitation of loved ones in one respectful, memorial setting.

Figure 2I:
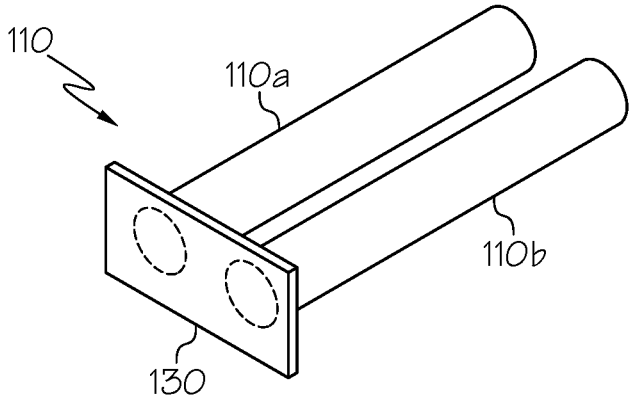
FIG. 2I is a perspective view of the storage receptacle with two capsules in accordance with embodiments of the present inventive concepts.

FIG. 2I is a perspective view of the storage receptacle 100 with two capsules 110*a*, 110*b* in accordance with embodiments of the present inventive concepts.

Figure 2J:
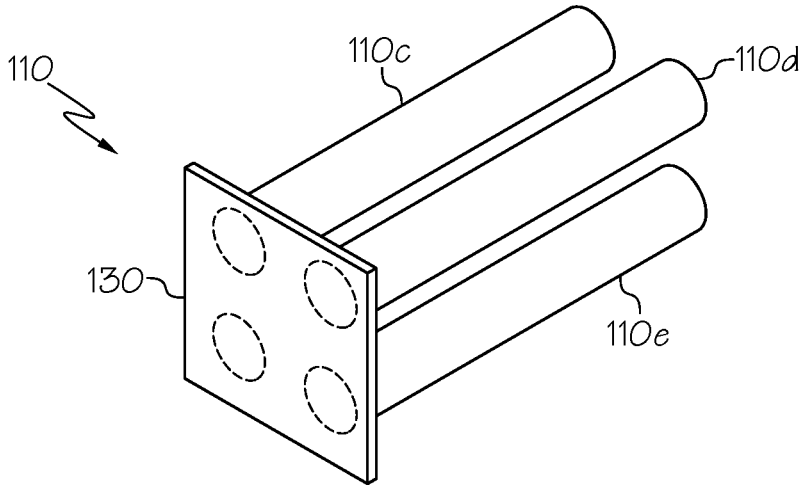
FIG. 2J is a perspective view of a storage receptacle with four capsules in accordance with embodiments of the present inventive concepts.

FIG. 2J is a perspective view of a storage receptacle 100 with four capsules 110*c*, 110*d*, 110*e* (the fourth capsule is not visible) in accordance with embodiments of the present inventive concepts.

Different storage receptacles 100 may have differently sized plaques 130. In some embodiments, a plaque 130 coupled to one capsule 110 may have a cross-section that is five inches by five inches. In some embodiments, a plaque 130 coupled to two capsules 110 may have a cross-section that is eleven inches across by five inches high or eleven inches high by five inches across. In some embodiments, a plaque 130 coupled to four capsules 110 may have a cross-section that is eleven inches by eleven inches. In other embodiments, the plaque 130 has dimensions that are different than those listed above.

Figure 2K:
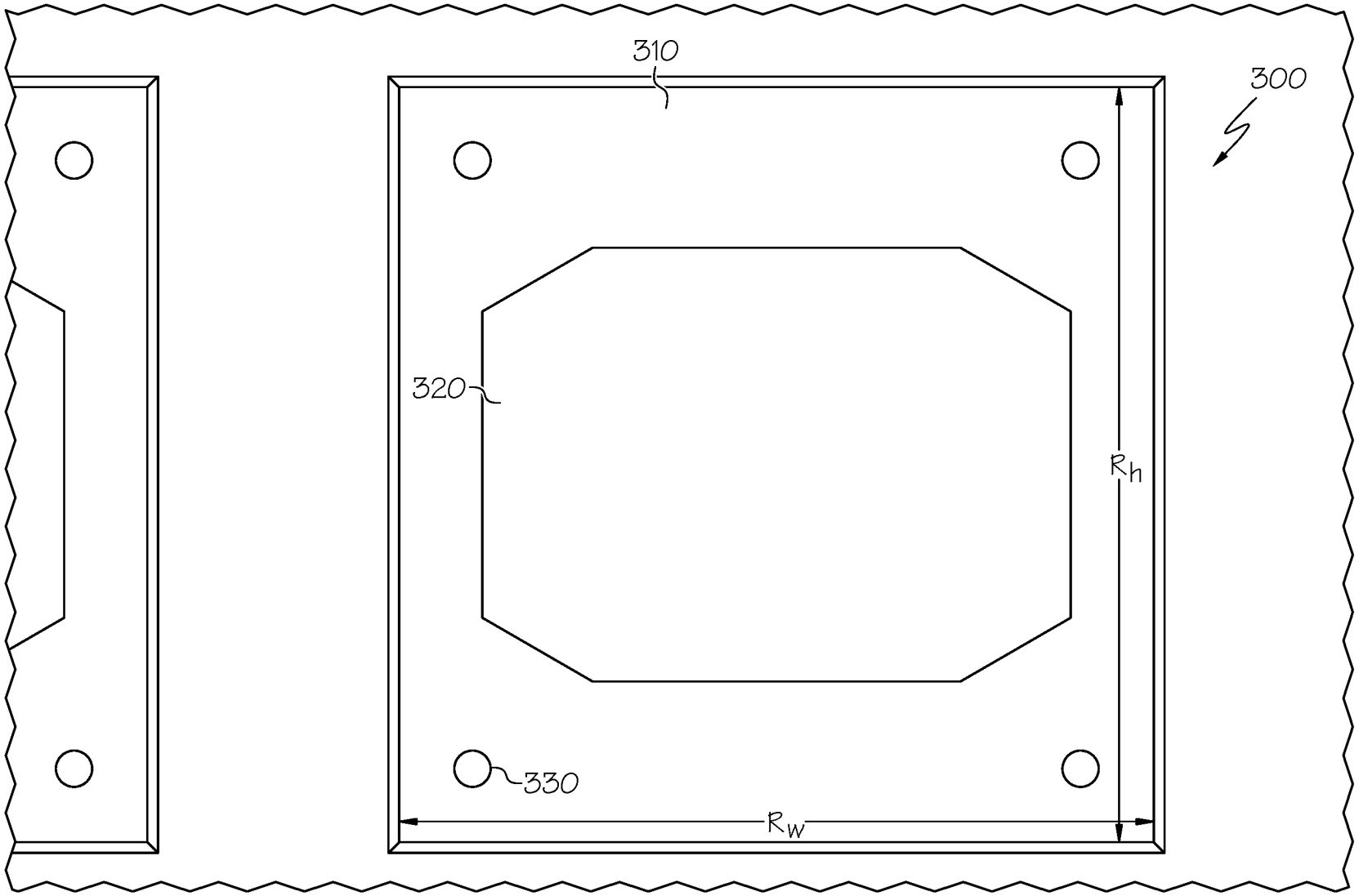
FIG. 2K is a front view of a memorial position in accordance with embodiments of the present inventive concepts.

FIG. 2K is a front view of a memorial position 300 in accordance with embodiments of the present inventive concepts.

In some embodiments, the at least one memorial position 300 comprises a recessed region 310 provided in the repository panel 200. In some embodiments, the memorial position 300 comprises at least one memorial aperture 320. The memorial aperture 320 allows for the storage receptacle 110 to be readily inserted into and applied to a repository 10. In some embodiments, for mounting of the storage receptacle 100 in the repository 10, the capsule 110 is inserted through the aperture 320 and the rear face 134 of the plaque 130 is positioned to interface with, or otherwise be applied against a front surface 312 of the recessed region 310. In some embodiments, the depth of the recessed region 310 is constructed and arranged such that, when the storage receptacle 100 is inserted, the front side 132 of the plaque 130 is flush with a front surface 210 of the repository panel 200. Ensuring that the storage receptacle is flush within the front surface of the panel can mitigate vandalism and tampering. Accordingly, in such an embodiment, the outer thickness of the repository side panel 200 is greater than the outer thickness of the plaque 130, so that the recessed region 310 can accommodate the thickness of the plaque 130.

In the embodiment shown in FIG. 2K, the recessed region 310 has a height $R_h$ and a width $R_w$ that are the same so that the recessed region is substantially square in shape. In some embodiments, the height $R_h$ and a width $R_w$ of the square recessed region 310 are approximately five inches by four inches. In some embodiments, the recessed region 310 is recessed into the repository panel to a depth of approximately ¼ inch relative to the front surface 210 of the repository panel. In some embodiments, the recessed region 310 has a height $R_h$ and a width $R_w$ that are different so that the recessed region is substantially rectangular in shape. In other embodiments, the recessed region 310 may have other shapes including square or rectangular with rounded corners, hexagon, octagon, circular, oval, or other suitable, visually appealing shapes. In other embodiments, the recessed region 310 may have other sizes that are less than or greater than five inches by four inches.

In some embodiments, the recessed region 310 comprises at least one bolt hole 330. The at least one bolt hole 330 allows for accessibility to the threaded rods 138 of the storage receptacles 100 from a region within the repository system 10. In some embodiments, when the storage receptacle 100 is inserted, the position of each of the at least one bolt hole 330 may be aligned with the position of each of the at least one threaded rods 138 of the storage receptacle 100. In the embodiment depicted in FIG. 2K, four bolt holes 330 are arranged to receive four threaded rods. In some embodiments, the positioning of the bolt holes 330 are keyed or otherwise positioned on the recessed region 310 to ensure that the storage receptacle 100 is place in an upright position when installed. In some embodiments, the storage receptacle 100 may be secured in place behind the repository panel 200. For example, in some embodiments, after the at least one threaded rod 138 passes through the at least one bolt hole 330 a nut is positioned at an inner surface of the repository panel and tightened on the at least one threaded rod 138. In some embodiments, a gasket may be positioned between the rear face 134 of the plaque 130 and the front surface 312 of the recessed region 310. In some embodiments, the at least one bolt hole 330 is threaded and may be constructed and arranged to couple with the at least one threaded rod 138.

The embodiment shown in FIG. 2K shows the recessed region 330 with four bolt holes 330. In other embodiments, the recessed regions 310 may have a different number of bolt holes 330. In some embodiments, with multiple memorial positions 300, different recessed regions 310 may have a different number of bolt holes 330.

In some embodiments, the storage receptacle 100 is bonded or glued to the memorial position 300. In some embodiments, storage receptacle 100 is welded to the memorial position 300. In some embodiments, the storage receptacle 100 is coupled to the memorial position 300 using magnets. In some embodiments, the storage receptacle is coupled to the memorial position using a locked arrangement or lock-and-key arrangement.

In the embodiment shown in FIG. 2K, the recessed region 310 has one memorial aperture 320. In other embodiments, the recessed region 310 may include more than one memorial aperture 320. In some embodiments, some recessed regions 310 may have one memorial aperture 320 while other recessed regions may have more than one memorial aperture 320. In some embodiments, all the recessed regions may have more than one memorial aperture 320. In some embodiments, the memorial apertures are arranged in horizontal rows and vertical columns at the repository panels 200.

In some embodiments, the memorial aperture 320 is large enough so that the capsule 110 of the storage receptacle 100 may pass through the memorial aperture 320 and into the interior of the repository system 10. In some embodiments, when the capsule 110 is installed, the entire capsule 110 is positioned within an interior region of the repository system 10. In some embodiments, when the storage receptacle 100 is installed at a memorial position 300, the capsule 110 is cantilevered such that it is coupled exclusively to the rear face 134 of the plaque 130 at its proximal end 112 and it is not supported at its distal end 114, the distal end being the end that is projected furthest inside the repository system 10.

In the embodiment shown in FIG. 2K, the memorial aperture 320 has a cross-section that is constructed and arranged to allow differently shaped storage receptacles 100 to pass through and into the repository system 10. Compatible capsules 110 may have differently shaped cross-sections including, but not limited to, a square, rectangle, a cross, a circle, an oval, etc., as described herein.

Figure 2L:
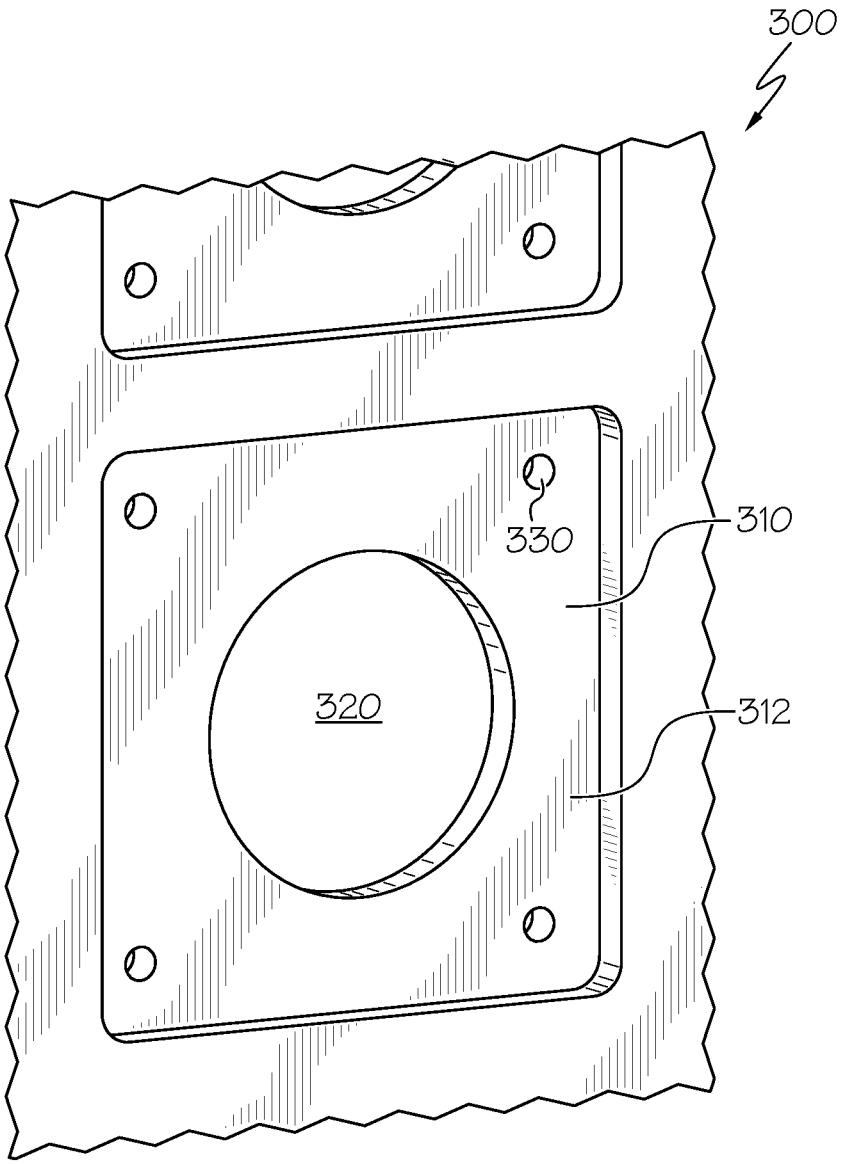
FIG. 2L is a front view of a memorial position in accordance with embodiments of the present inventive concepts.

FIG. 2L is a front view of a memorial position 300 in accordance with embodiments of the present inventive concepts. In the embodiment shown in FIG. 2L, the recessed region 310 has a cross-section that is substantially square. The embodiment shown includes four bolt holes 330.

In the embodiment depicted in FIG. 2L, the recessed region 310 has a memorial aperture 320 that has a circular cross-section. In other embodiments, some recessed regions 310 may have at least one memorial aperture 320 that has a circular cross-section and other memorial apertures 320 can be shaped differently. For example, memorial apertures 320 may have different shapes, including, but not limited to, a rectangle, a triangle, a cross, etc. as described herein. In some embodiments, the client may be able to customize the shape of the memorial aperture 320 cross-section. In some embodiments, two memorial apertures 320 in the same recessed region 310 may be shaped differently. In some embodiments, the aperture may be constructed and arranged such that it will accommodate any storage receptacle 100 of a number of different cross-sectional shapes suitable for mounting in the repository system 10.

Figure 2M:
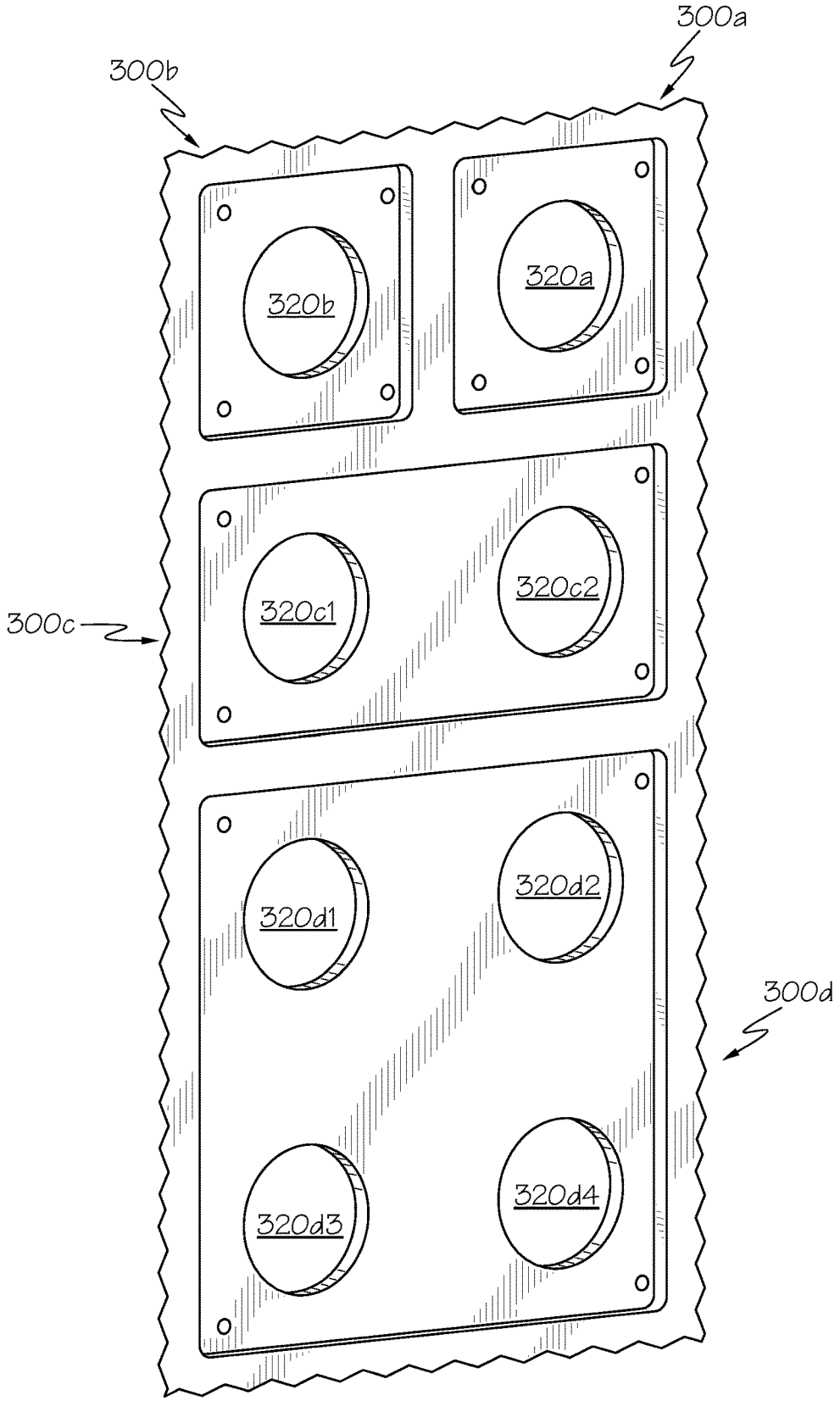
FIG. 2M is a front view of four memorial positions in accordance with embodiments of the present inventive concepts.

FIG. 2M is a front view of four memorial positions 300 in accordance with embodiments of the present inventive concepts. A first memorial position 300*a* has one recessed region 310 of a primarily square shape, four bolt holes 330, and one circular memorial aperture 320*a*. A second memorial position 300*b* has one recessed region 310 that is substantially square, four bolt holes 330, and one circular memorial aperture 320*b*. A third memorial position 300*c* has one recessed region 310 that is substantially rectangular, four bolt holes 330, and two circular memorial apertures 320*c*1, 320*c*2. A fourth memorial position 300*d* has one recessed region 310, four bolt holes 330, and four circular memorial apertures 320*d*1, 320*d*2, 320*d*3, 320*d*4.

Figure 3B:
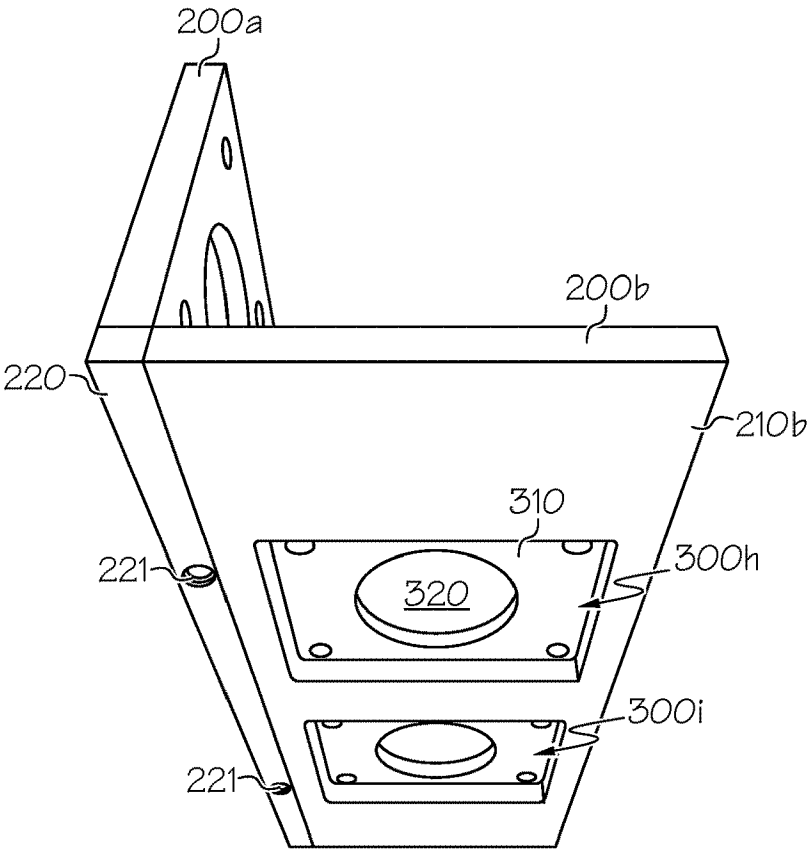
FIGS. 3A and 3B are perspective views of first and second repository panels in accordance with embodiments of the present inventive concepts.
Figure 3A:
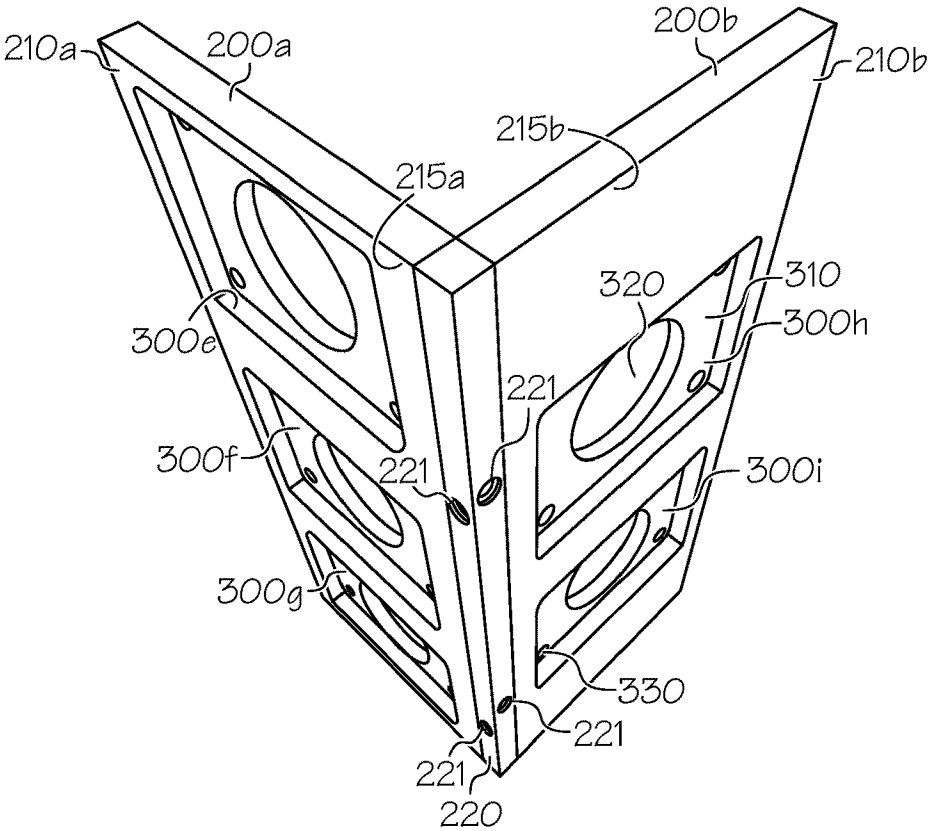

FIGS. 3A and 3B are perspective views of first and second repository panels 200*a* and 200*b*, respectively, in accordance with embodiments of the present inventive concepts. In some embodiments, the repository panels 200 are constructed and arranged to receive at least one storage receptacle 100. In some embodiments, each repository panel 200 comprises a front surface 210*a*, 210*b* with an end 215*a*, 215*b*, and at least one memorial position 300. In some embodiments, the recessed region 310 of the memorial position 300 is recessed with respect to the front surface 210 of the repository panel 200. The recessed region 310 of each repository panel 200 may comprise any suitable material including, but not limited to, stainless steel, brass, bronze, acrylic, ceramic, composite, graphite, plastic, metal, alloy, stone, wood, etc.

FIGS. 3A and 3B show a first repository panel 200*a* and a second repository panel 200*b* that are positioned at approximately right angles relative to each other. The first repository panel 200*a* has three memorial positions 300*e*, 300*f*, and 300*g*. The second repository panel 200*b* has two memorial positions 300*h* and 300*i*. In different embodiments, the repository panels 200 may have a different number of memorial positions 300. In other embodiments, the first and second repository panels 200*a*, 200*b* may be positioned at angles relative to each other that are less than ninety degrees or greater than ninety degrees.

The repository panels shown in FIGS. 3A and 3B comprise a metal material. In different embodiments, the repository panels 200 may be composed of one or more different materials including, but not limited to stainless steel, brass, bronze, acrylic, ceramic, composite, graphite, plastic, metal, alloy, stone, wood, etc.

In the embodiment shown in FIGS. 3A and 3B, the recessed regions 310 are similar sizes and substantially square in shape. In other embodiments, the recessed regions 310 may have different sizes and/or different shapes. For example, in some embodiments, one repository panel 200 may have recessed regions of a certain size and shape, while a different repository panel 200 may have recessed regions of a different size and shape. In some embodiments, there may be recessed regions with different sizes and/or shapes on the same repository panel 200.

In some embodiments, two repository panels are connected using at least one connector 220 at the ends 215*a*, 215*b*. The at least one connector 220 may be secured to a repository panel with different types of fasteners 221 including, but is not limited to, a screw, a bolt, etc.

Figure 3C:
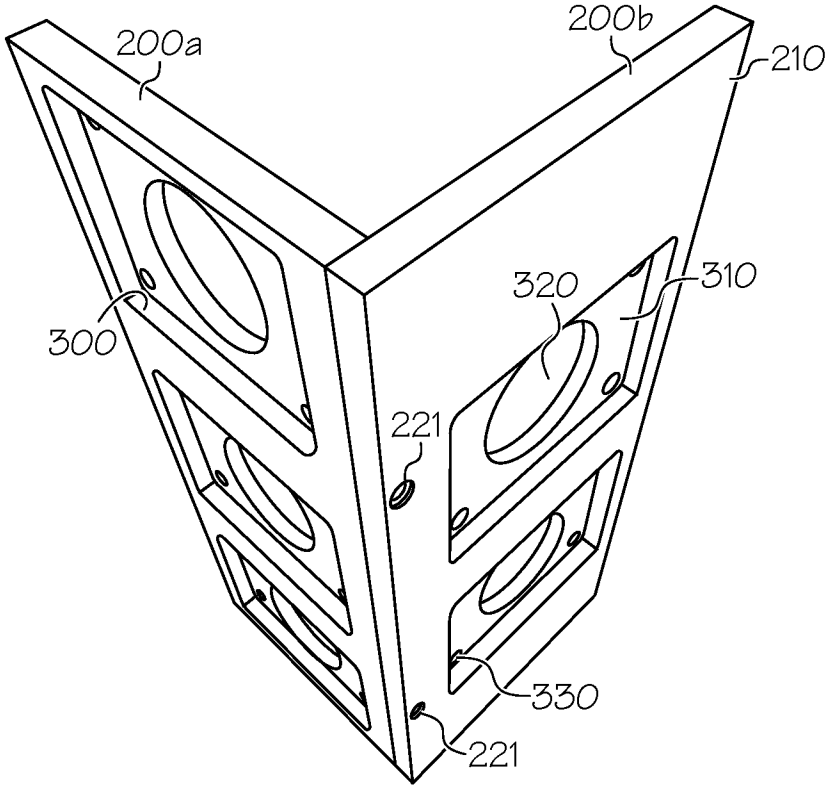
FIG. 3C is a perspective view of the first and second repository panels directly coupled to each other in accordance with embodiments of the present inventive concepts.

FIG. 3C is a perspective view of the first and second repository panels 200*a* and 200*b*, respectively, directly coupled to each other in accordance with embodiments of the present inventive concepts. In the embodiment shown in FIG. 3C, the second repository panel 200*b* is coupled directly to the first repository panel 200*a* with screws 221. In other embodiments, neighboring repository panels may be directly bonded together with a bonding material such as glue. In some embodiments, neighboring repository panels 200 are welded together. In some embodiments, neighboring repository panels 200 are connected with magnets. In some embodiments, neighboring repository panels 200 are connected with one or more brackets. In some embodiments, neighboring repository panels may be directly coupled together using threaded bolts, screws, etc.

Referring to the embodiment of FIG. 3A, a corner column of the first repository panel 200*a* shown in FIG. 3A has three memorial positions and the second repository panel 200*b* has two memorial positions. In other embodiments, repository panels 200 have a different number of memorial positions 300. The repository panels shown in FIGS. 3A and 3B have a certain height. In other embodiments, one or more repository panels 200 may be a different height.

FIGS. 4A-4D illustrate a variety of perspective views of the repository panels 200, including storage receptacles 100 mounted to certain ones of the memorial positions 300 of the repository 10 in accordance with embodiments of the present inventive concepts. In the embodiments depicted FIGS. 4A-4D only the end columns 201*a*, 201*b* of the memorial positions 300 of the first and second panels 200*a*, 200*b* are shown, for the purpose of illustration of the corner regions of the repository system 10. Similarly, only three rows 203*e*, 203*f*, 203*g* of memorial positions 300 of the first panel 200*a* and only two rows 203*h*, 203*i* of memorial positions 300 of the second panel 200*b* are depicted. It will be well understood that more columns and more rows may very well be present.

Figure 4A:
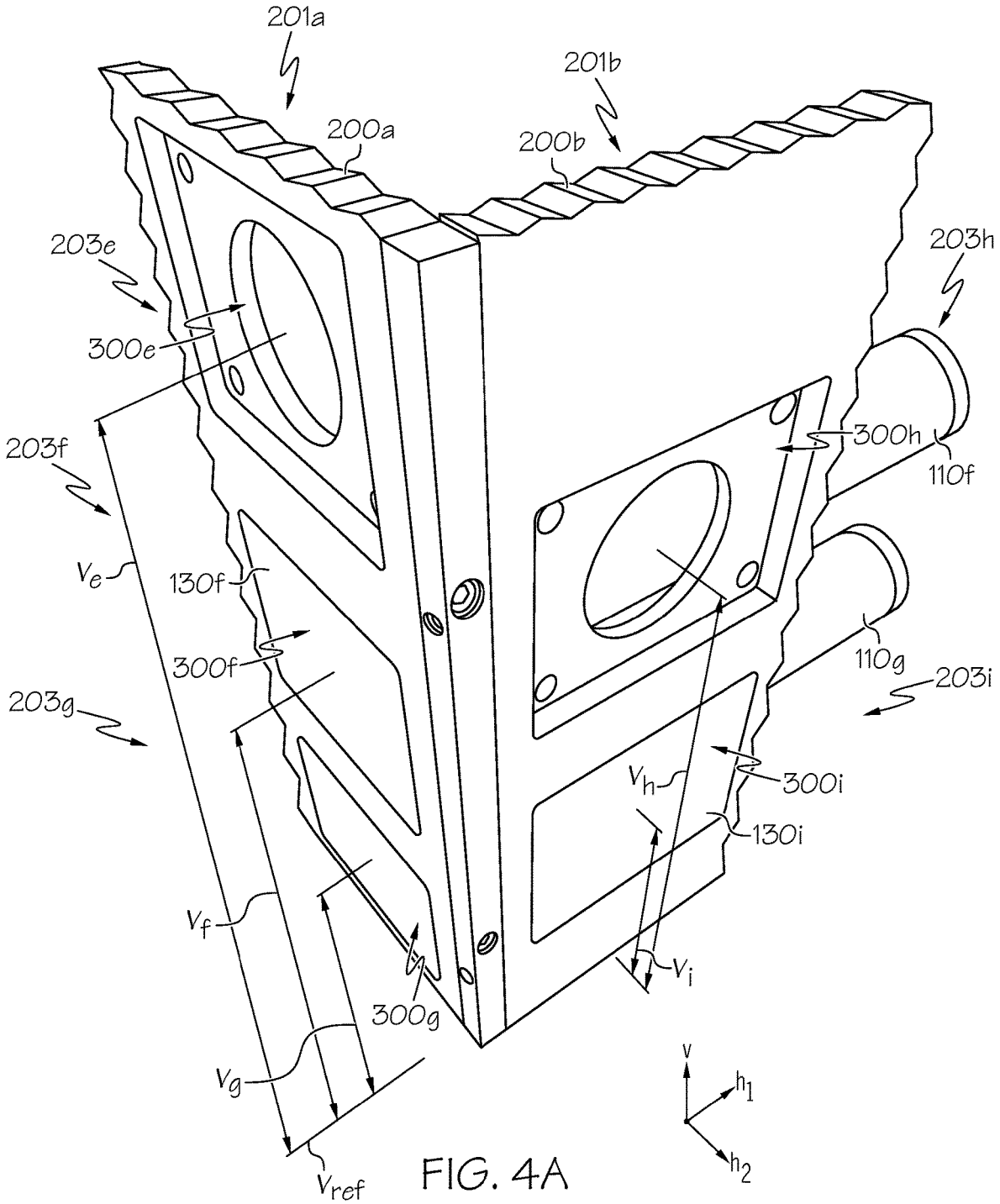
FIGS. 4A-4D illustrate a variety of perspective views of the repository panels, including storage receptacles mounted to certain ones of the memorial positions of the repository in accordance with embodiments of the present inventive concepts.
Figure 4B:
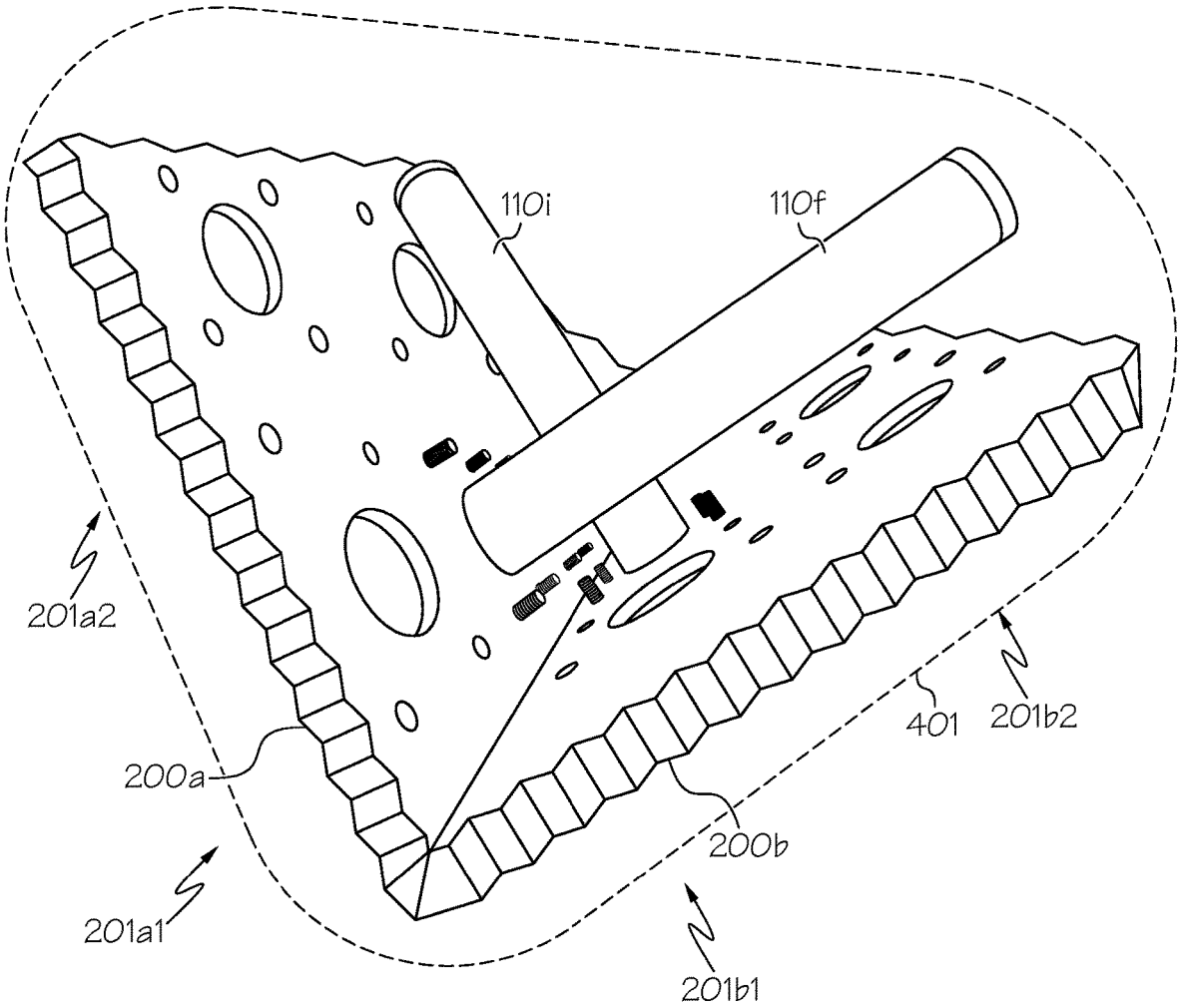
Figure 4D:
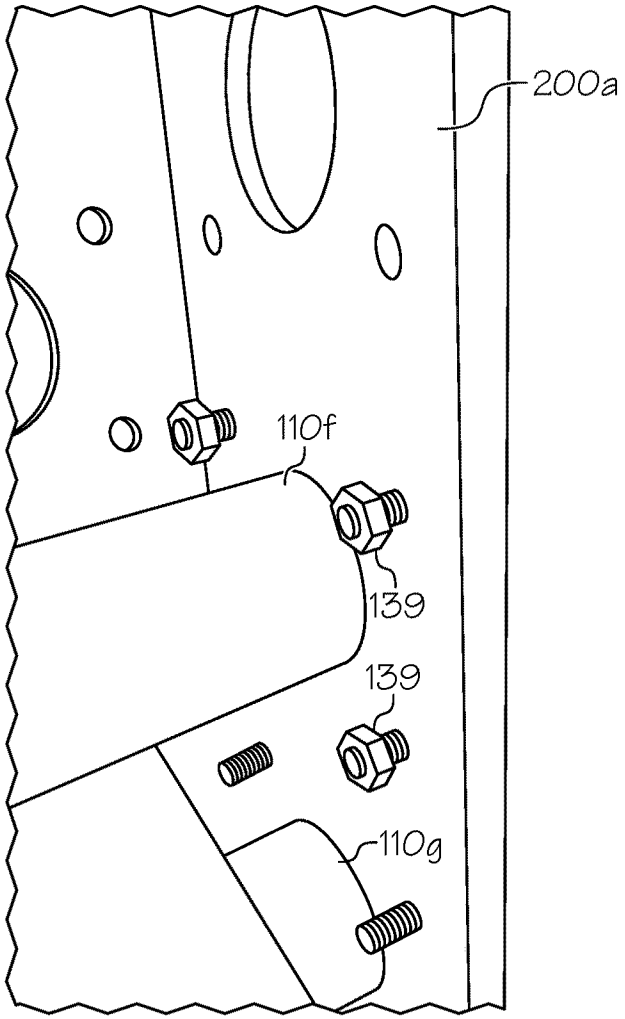

In some embodiments, when assembled, the storage receptacles 100 are inserted from the front of the repository system 10 at a front face of the repository panel, causing the capsule to pass through the corresponding memorial aperture 320. The storage receptacles are then tightened and secured within the repository system 10 from the back of the repository panel 200 at its rear face. In some embodiments, when inserted into the repository system 10, the plaque 130 aligns and lays flush against the repository panel 200, wherein the customized design, engraving, or etchings side of the plaque 130 will face in an outward direction, as shown in FIG. 4A. The capsule 110 extends through the memorial aperture, into the repository system 10. In some embodiments, the storage receptacle 100 is bolted and secured inside the repository system 10 using nuts (as shown in FIG. 4D).

Figure 4C:
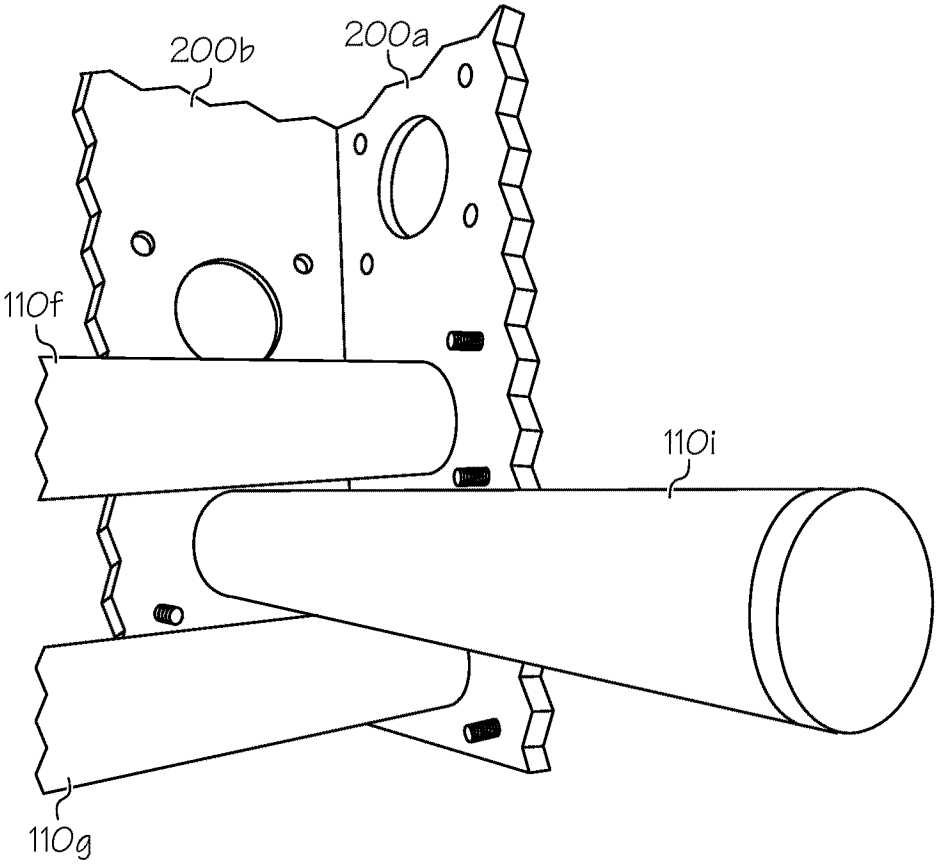

In some embodiments, the horizontal placement of the storage receptacles 100 allows for maximum storage of multiple storage receptacles in a small amount of space, as shown in FIG. 4C. In some embodiments, the spacing design of the repository system 10, the storage receptacles 100, and the plaques 130 allows for the storage receptacles 100 to be positioned within the repository 10 so their respective capsules 110 avoid touching each other, and thereby providing for safe, sterile, and secure storage as shown in the rear perspective views of FIGS. 4B and 4C.

FIG. 4A is a perspective view of the repository panels 200*a* and 200*b* shown in FIGS. 3A and 3B with storage receptacles 100 inserted in three of the five memorial positions 300 shown, in accordance with embodiments of the present inventive concepts. In the embodiment shown, storage receptacle 100*f* is inserted into memorial position 300*f*, storage receptacle 100*g* is inserted into memorial position 300*g*, and storage receptacle 100*i* is inserted into memorial position 300*i*.

In the embodiment shown in FIG. 4A, the five memorial positions shown are centered at five different vertical positions. Memorial position 300*e* is positioned at the highest vertical position Ve. Memorial position 300*f* is positioned at a different vertical position Vf. Memorial position 300*g* is positioned at a different vertical position Vg. In the present embodiment, the vertical positions are identified relative to a common reference position Vref.

On the second repository panel, memorial position 300*h* is at a different vertical position Vh. In the embodiments shown, the highest memorial position 300*h* on the second repository panel 200*b* is between the highest and second highest memorial positions 300*e*, 300*f* on the first repository panel 200*a*. The lowest memorial position 300*i* on the second repository panel 200*b* is between the second highest and third highest memorial positions 300*f*, 300*g* on the first repository panel 200*a*. In the present example, the respective vertical heights of the memorial positioned are measured relative to center points of their respective memorial apertures 320, and are measured with respect to a vertical reference position Vref that is common to the first and second panels 200*a*, 200*b*. In the present example, vertical position Vi is positioned between vertical positions Vf and Vg in the vertical direction along the vertical axis v. Similarly, vertical position Vh is positioned between vertical positions Ve and Vf in the vertical direction along the vertical axis v. It can be seen that the vertical axis v is orthogonal to the first and second horizontal axes h1, h2. In the present embodiment, columns 201*a*, 201*b* of the memorial apertures 320 extend in the vertical direction along the vertical axis v and rows 203*e*, 203*f*, 203*g*, 203*h*, 203*i* extend in the first and second horizontal directions along the horizontal axes h1, h2.

In some embodiments, the repository system 10 may comprise at least one memorial position 300. In embodiments with multiple memorial positions, the memorial positions 300 may be arranged in horizontal rows and vertical columns at the repository panels 200, as described herein.

In a case where the memorial positions 300 at the repository system 10 are arranged in rows and the vertical position of each row at one repository panel 200 is the same as the vertical position of each row on the neighboring repository panel 200, the capsules 110 of the storage receptacles 100 in the corner regions of the panels may interfere with each other. Each memorial position 300 may house a storage receptacle 100 and each storage receptacle 100 may include at least one capsule 110 that extends into the repository system 10 by a distance corresponding to the length of the capsule $L_C$. Accordingly, in the corner regions, the capsule 110 of one storage receptacle 100 may collide with the capsule 110 of a neighboring storage receptacle 100 of the neighboring repository panel. The region in which this collision may otherwise take place and the associated memorial positions is referred to herein as the "corner region". FIG. 4B shows a dashed circle 401 around the corner region for the two repository panels 200*a*, 200*b* described in FIG. 4A. It can be seen in the perspective top inner view of FIG. 4B that the corner region 401 of the repository system 10 can be considered to include more than one end column 201*a*1, 201*a*2, 21*b*1, 201*b*2 of the repository panel, and can include the second end column 201*a*2, 201*b*2, and other end columns as well. The expanse of the corner region 401 depends on a number of factors, including especially the lengths of the capsules 110. The expanse of the corner region 401 can also depend on the angle at which the panels 200*a*, 200*b* are positioned relative to each other.

In embodiments with additional repository panels, the corner region is extended to include the memorial positions 300 and storage receptacles 100 from those positions that may be involved in the above described collision. In some embodiments, the corner region may include a first corner portion that includes the memorial apertures of the first repository panel and a second corner portion that includes the memorial apertures of the second repository panel.

There are different ways of addressing interference of the capsules in the corner regions. In one embodiment, positioning of any memorial positions 300 in the corner region of one or more of the panels 200 can be avoided entirely. If neighboring capsules 110 aren't close enough to collide, there won't be any collisions. A disadvantage of such an approach is that the repository system 10 would have reduced density in that it would not not include as many memorial positions 300 as possible.

Figure 4E:
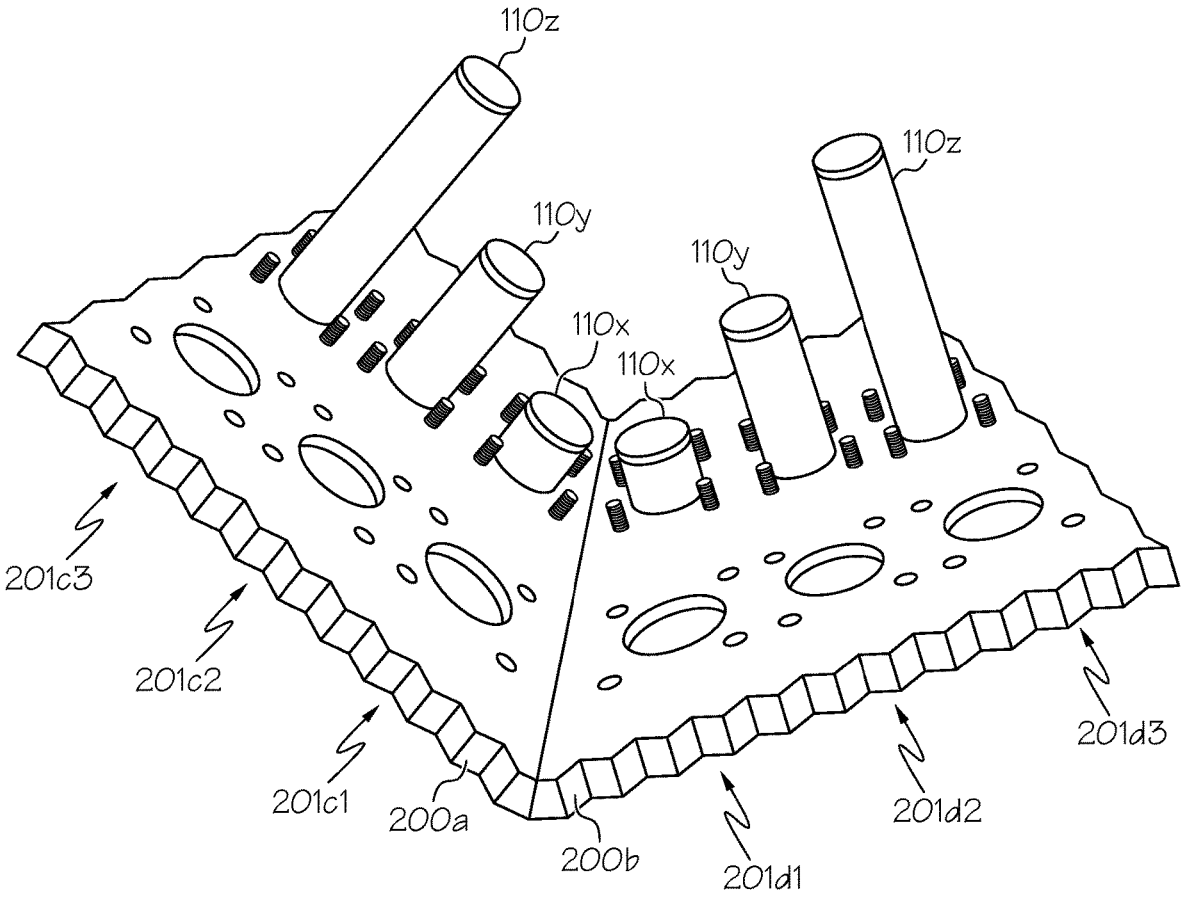
FIG. 4E is a perspective view of an another embodiment whereby the capsules are of a decreasing length in the direction toward the corners, in accordance with embodiments of the present inventive concepts.

In some embodiments, different capsules 110 in the repository system 10 may be different lengths. For example, in some embodiments, the capsules 110 near the corner region may be provided to have a shorter length Lc than capsules 110 further away from the corner region. As the length of the capsules Lc decreases, the size of the corner region decreases. As illustrated in the embodiment of FIG. 4E, the capsules 110*x*, associated with the columns 201*c*1, 201*d*1 nearest the corner are shorter in length than the capsules 110*y* associated with the second column 201*c*2, 201*d*2. Further, the capsules 110*y*, associated with the second columns 201*c*2, 201*d*2 are shorter in length than the capsules 110*z* associated with the third column 201*c*3, 201*d*3. If the capsules 110 at the corner are short enough, the previously described interference between columns may not be an issue.

Another way to address the potential for interference of the capsules 110 at the corner regions is to offset the vertical positions of the memorial positions 300 in neighboring panels 200. In some embodiments, the memorial apertures in a first corner portion and the memorial apertures in a second corner portion have vertical positions that are offset in the vertical direction. This approach is depicted in the example embodiment of FIGS. 4A-4D described herein. In some embodiments, the vertical position of the horizontal rows on one repository panel 200 may be offset in the vertical direction from the vertical position of the horizontal rows on a neighboring repository panel 200. This approach is depicted herein in connection with the embodiment shown in FIG. 1. It can be seen that the rows of memorial positions 300 of the first panel 200*a* are offset relative to the rows of memorial positions 300 of the second panel 200*b*. In some embodiments, one repository panel 200 may have one fewer row of memorial positions 300 than the neighboring repository panel 200. In some embodiments, one repository panel 200*b* may have one fewer row of memorial positions 300 than the neighboring repository panel 200*a* In some embodiments, the vertical positions of the horizontal rows are staggered or offset relative to each other An example of such a staggered arrangement is displayed in FIG. 4A. In FIG. 4A, memorial position 300*g* is the lowest memorial position on repository panel 200*a* and memorial position 300*i* is the lowest memorial position on the neighboring repository panel 200*b*. In FIG. 4A that the vertical position Vg of memorial position 300*g* is different than the vertical position Vi of memorial position 300*i*. Similarly, the second-lowest memorial position 300*f* on repository panel 200*a* has a different vertical height Vf than the second-lowest memorial position 300*h* on repository panel 200*b*.

FIG. 4B is a top view from behind repository panel 200*a* and repository panel 200*b* in accordance with embodiments of the present inventive concepts. Some of the space between capsule 110*f* of the storage receptacle 100*f* and capsule 110*g* of the storage receptacle 100*g* (below storage receptacle 110*f*) is occupied by capsule 110*i* of storage receptacle 100*i*.

FIG. 4C is a perspective view from behind repository panel 200*a* and repository panel 200*b* in accordance with embodiments of the present inventive concepts. In the embodiment shown, a first elongated capsule 110*f* is coupled to the first repository panel 200*a* and extends along a first axis of extension. A second elongated capsule 110*g* is also coupled to the first repository panel 200*a* and extends along a second axis of extension. A third elongated capsule 110*i* is coupled to the second repository panel 200*b* and extends in a third axis of extension. In the embodiment shown, a portion of the third elongated capsule 110*i* is positioned between a portion of the first elongated capsule 110*f* and a portion of the second elongated capsule 110*g*. In some embodiments, the first and second axes of extension may lie on a plane and the third axis of extension intersects the plane.

FIG. 4D is a perspective view from behind repository panel 200*a* in accordance with embodiments of the present inventive concepts. This view clearly shows that nuts 139 may be applied to the at least one threaded rod 138 in order to secure the storage receptacle 100*f* to the repository panel 200*a*. The nuts 139 can be anchored from a position at an interior region of the repository system 10, for example, an interior region surrounded by the repository panels 200.

Figure 5:
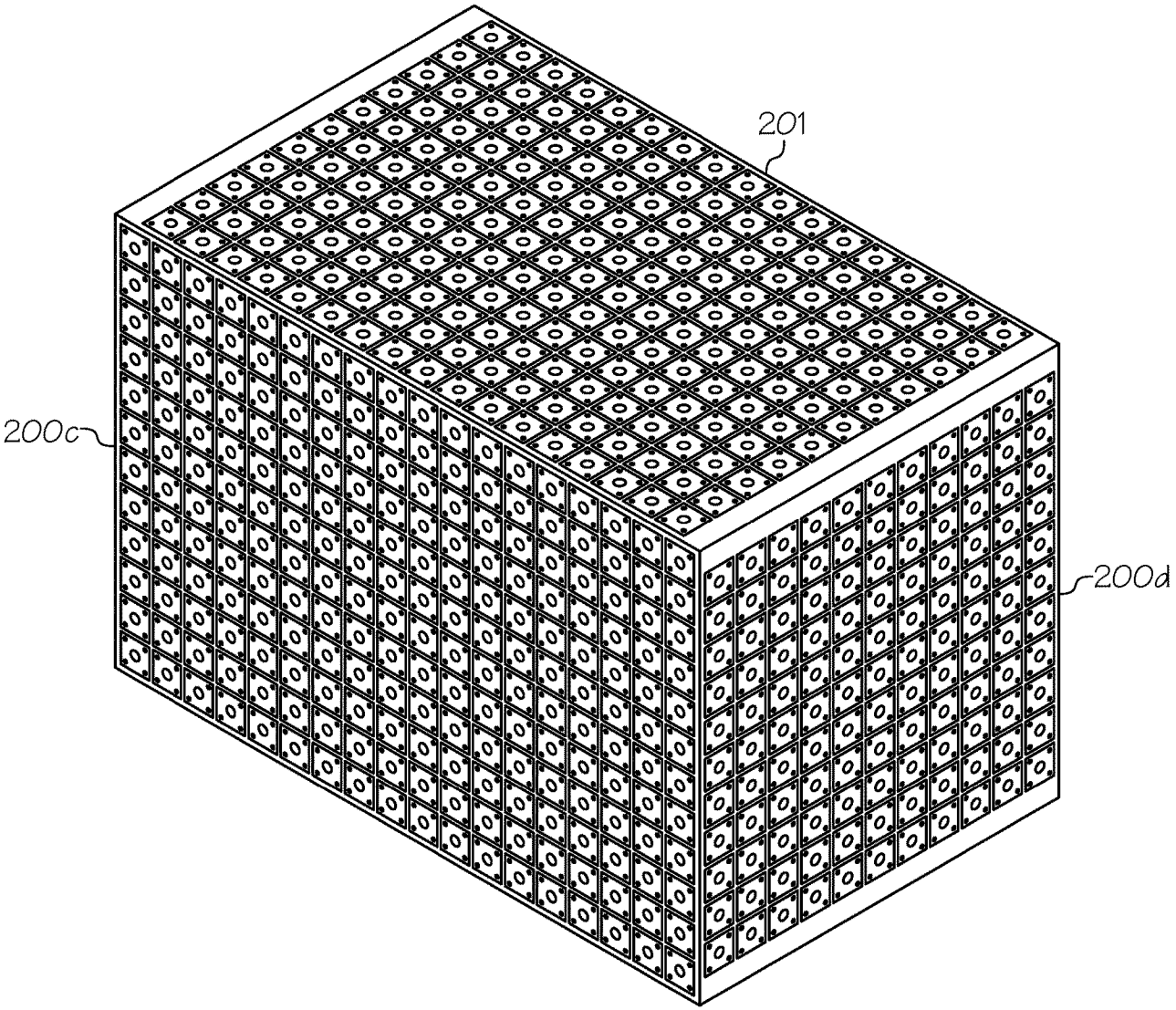
FIG. 5 is a perspective view of a repository system with memorial positions located at the at side panels and at the top panel in accordance with embodiments of the present inventive concepts.

FIG. 5 is a perspective view of a repository system 10 with memorial positions 300 located at the at side panels 200*c*, 200*d* and at the top panel 240 in accordance with embodiments of the present inventive concepts. In the embodiment shown in FIG. 5, the memorial positions 300 on the first repository side panel 200*c* are offset from the memorial positions 300 at the second repository side panel 200*d*. In the embodiment shown, the repository system 10 has four repository side panels 200 that are angled at approximately 90 degrees with respect to each other and form a closed side panel structure. In some embodiments, the repository system 10 may cover less than 100 square feet may hold approximately 1200 individual storage receptacles 100.

Figure 6A:
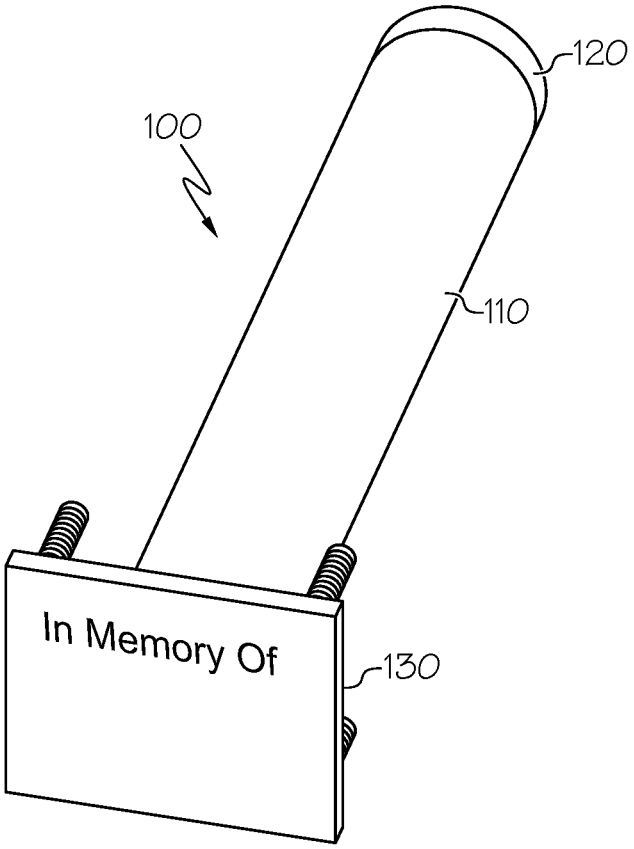
FIG. 6A is a front perspective view of an embodiment of the storage receptacle in accordance with embodiments of the present inventive concepts.

FIG. 6A is a front perspective view of an embodiment of the storage receptacle 100 in accordance with embodiments of the present inventive concepts.

Figure 6B:
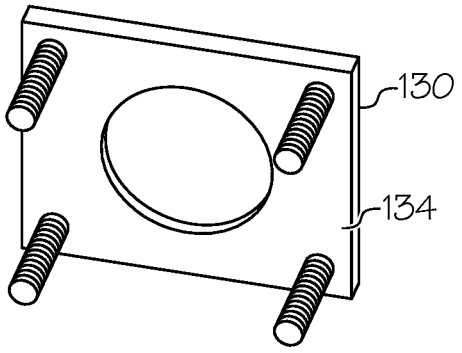
FIG. 6B is a rear perspective view of the rear face of the plaque of the storage receptacle of FIG. 6A, in accordance with embodiments of the present inventive concepts.

FIG. 6B is a rear perspective view of the rear face 134 of the plaque 130 of the storage receptacle 100 of FIG. 6A, in accordance with embodiments of the present inventive concepts. In this embodiment, in a case where the proximal end of the corresponding capsule 110 is open, and wherein the rear face of the plaque operates to seal the proximal end of the capsule, the cremains may make direct contact with the rear surface of the customizable plate 130.

Figure 7:
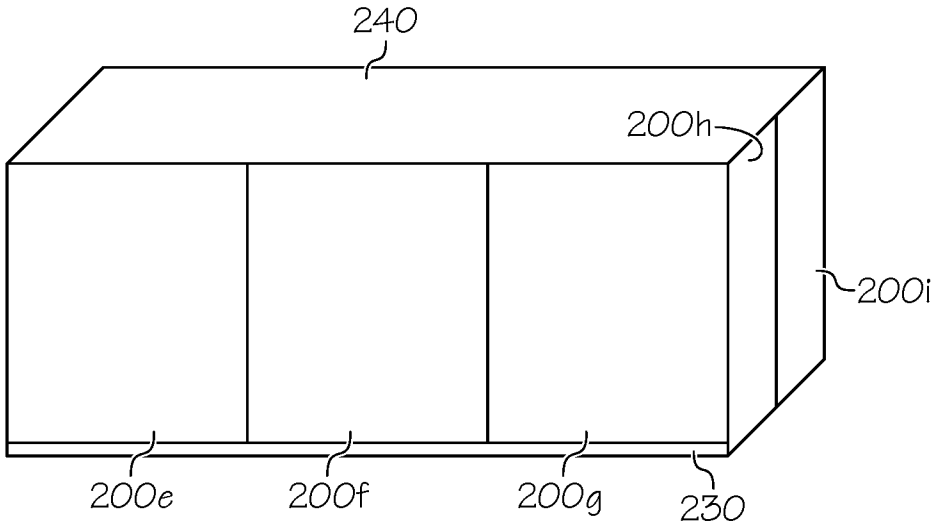
FIG. 7 is a perspective view of a repository system including three repository panels at a front portion, two repository panels at a side portion, and one repository panel at a top portion in accordance with embodiments of the present inventive concepts.

FIG. 7 is a perspective view of a repository system 10 including three repository panels at a front portion, two repository panels at a side portion, and one repository panel at a top portion in accordance with embodiments of the present inventive concepts. The embodiment shown is only an outline and does not show the individual storage receptacles 100 installed. In the embodiment shown in FIG. 7B, repository panels 200*e*, 200*f*, and 200*g* are coupled to a panel base 230. In some embodiments, the panel base 230 secures the repository panels into their appropriate positions. In some embodiments, the panel base 230 provides structural support. The panel base 230 may include an elongated slot that receives and secures a lower end of a repository panel 200.

Figure 8:
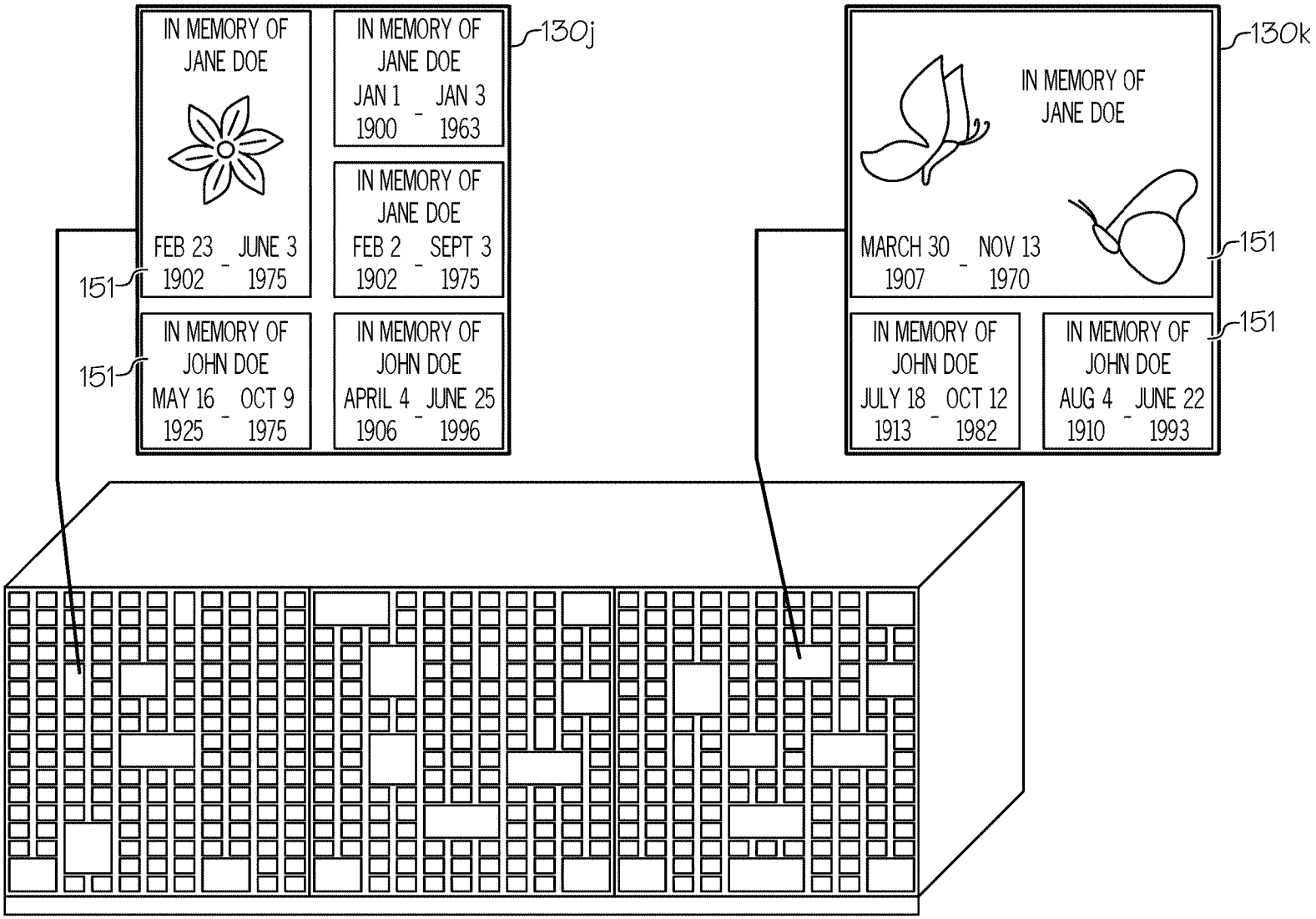
FIG. 8 is a perspective view of a repository system including a series of storage receptacles fully assembled and installed in accordance with embodiments of the present inventive concepts.

FIG. 8 is a perspective view of a repository system 10 including a series of storage receptacles 100 fully assembled and installed in accordance with embodiments of the present inventive concepts. In the embodiment shown in FIG. 8, the repository system 10 includes storage receptacles 100 mounted to the front repository panel 200. FIG. 8 shows examples of two different plaques. The first plaque 130*j* comprises five distinct regions and the second plaque 130*k* has three distinct regions. In other embodiments, the plaque 130 may be divided into a different number of distinct regions 151. In some embodiments, each of the regions 151 is related to a corresponding capsule 110 extending from a rear surface of the plaque 130 in that region 151.

Figure 9A:
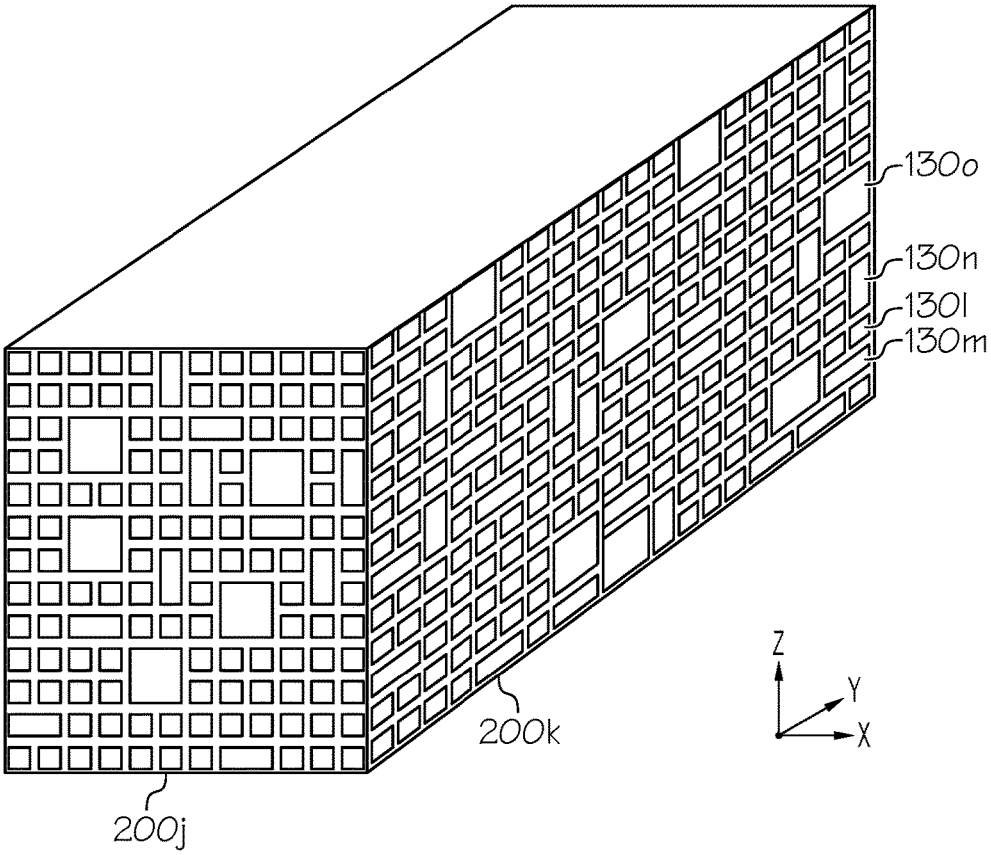
FIG. 9A is a perspective view of a repository system including a front repository panel and a side repository panel in accordance with embodiments of the present inventive concepts.

FIG. 9A is a perspective view of a repository system 10 including a front repository panel 200*j* and a side repository panel 200*k* in accordance with embodiments of the present inventive concepts. In this embodiment, the repository 10 includes plaques 130 of different sizes and shapes. For example, it includes a first type of plaque 130L that is a first size and square in shape. The repository 10 also includes a second type of plaque 130*m* that is a second size and is shaped as a rectangle with a long side oriented along the y direction. The repository 10 also includes a third type of plaque 130*n* that is a third size and is shaped as a rectangle with a long side oriented along the z direction. The repository 10 also includes a fourth type of plaque 130*o* that is a fourth size and is shaped as a square.

Figure 9B:
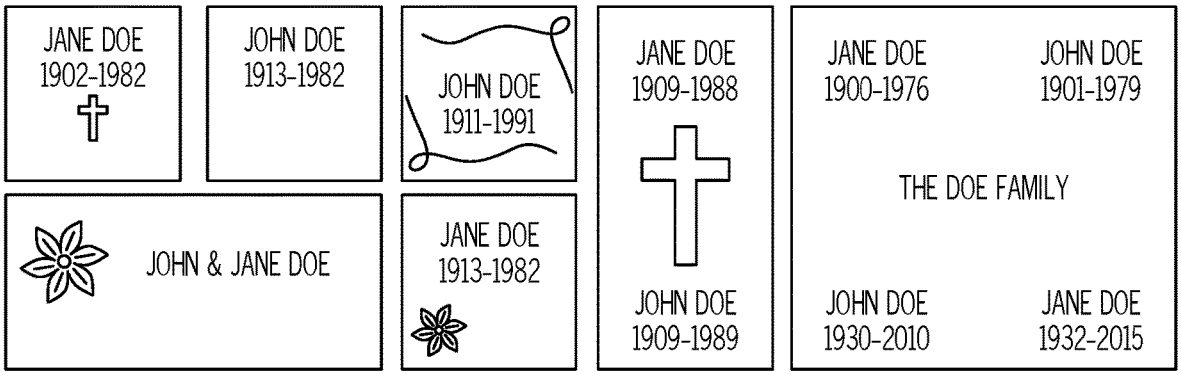
FIG. 9B is a front view of different plaques in accordance with embodiments of the present inventive concepts.

FIG. 9B is a front view of different plaques 130 in accordance with embodiments of the present inventive concepts. Each plaque 130 can include a unique and personal engraving.

Figure 10:
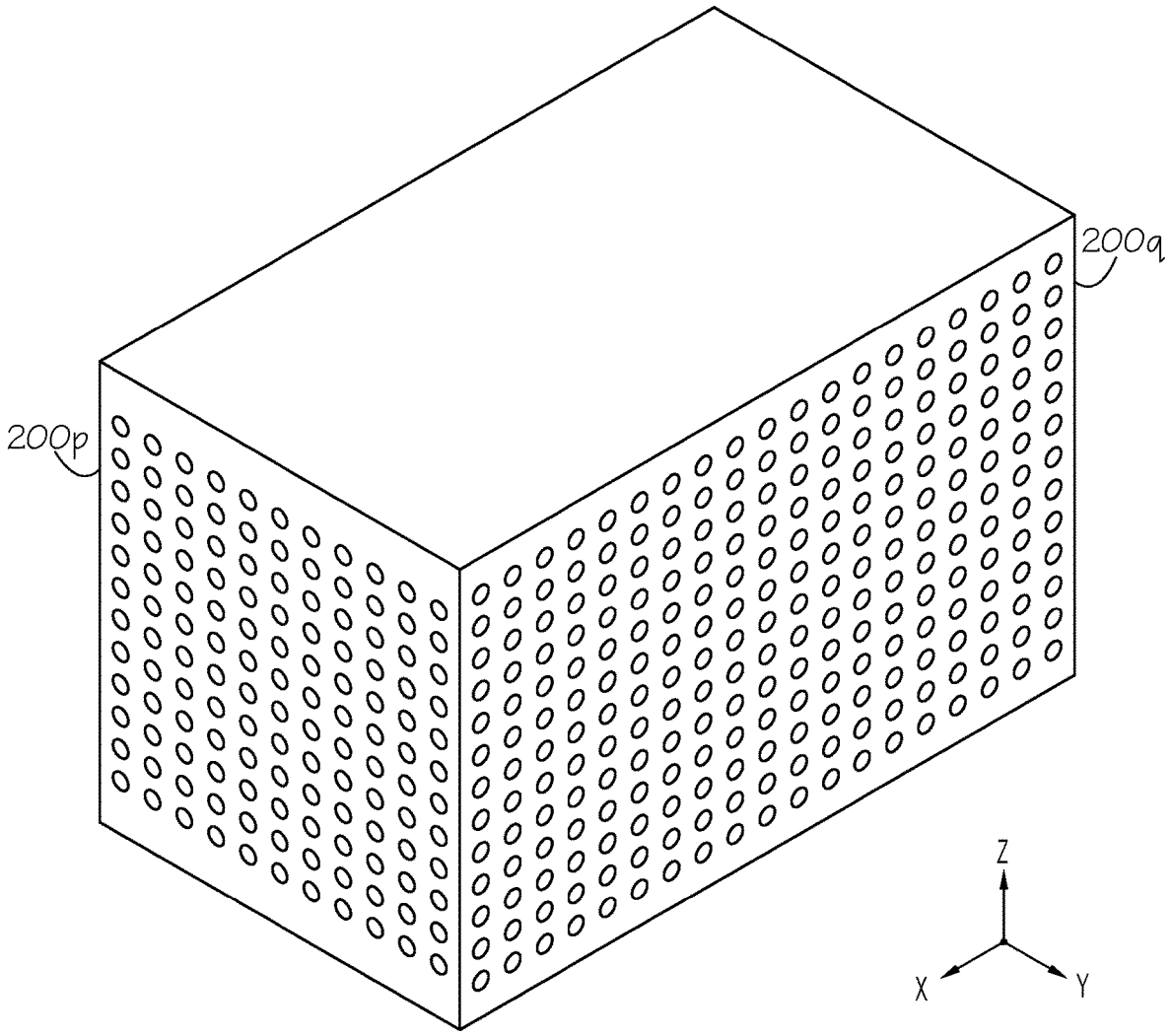
FIG. 10 is a perspective view of a repository system in accordance with embodiments of the present inventive concepts.

FIG. 10 is a perspective view of a repository system 10 in accordance with embodiments of the present inventive concepts. Two repository panels 200*p* and 200*q* are positioned at an angle with respect to each other. In the embodiment shown, the rows of memorial positions at repository panel 200*q* are offset in the z direction relative to the rows of memorial positions 300 at repository panel 200*p*. In this embodiment, repository panel 200*p* has one fewer row of memorial positions 300 than repository panel 200*q*. In the embodiment shown, the memorial positions do not have a recessed region 310 or bolt holes 330. In the embodiment shown the storage receptacles 100 can be welded to bonded to the repository panels 200. Alternatively, other suitable mechanisms can be employed to mount the storage receptacles 100 to the repository panels 200.

Figure 11:
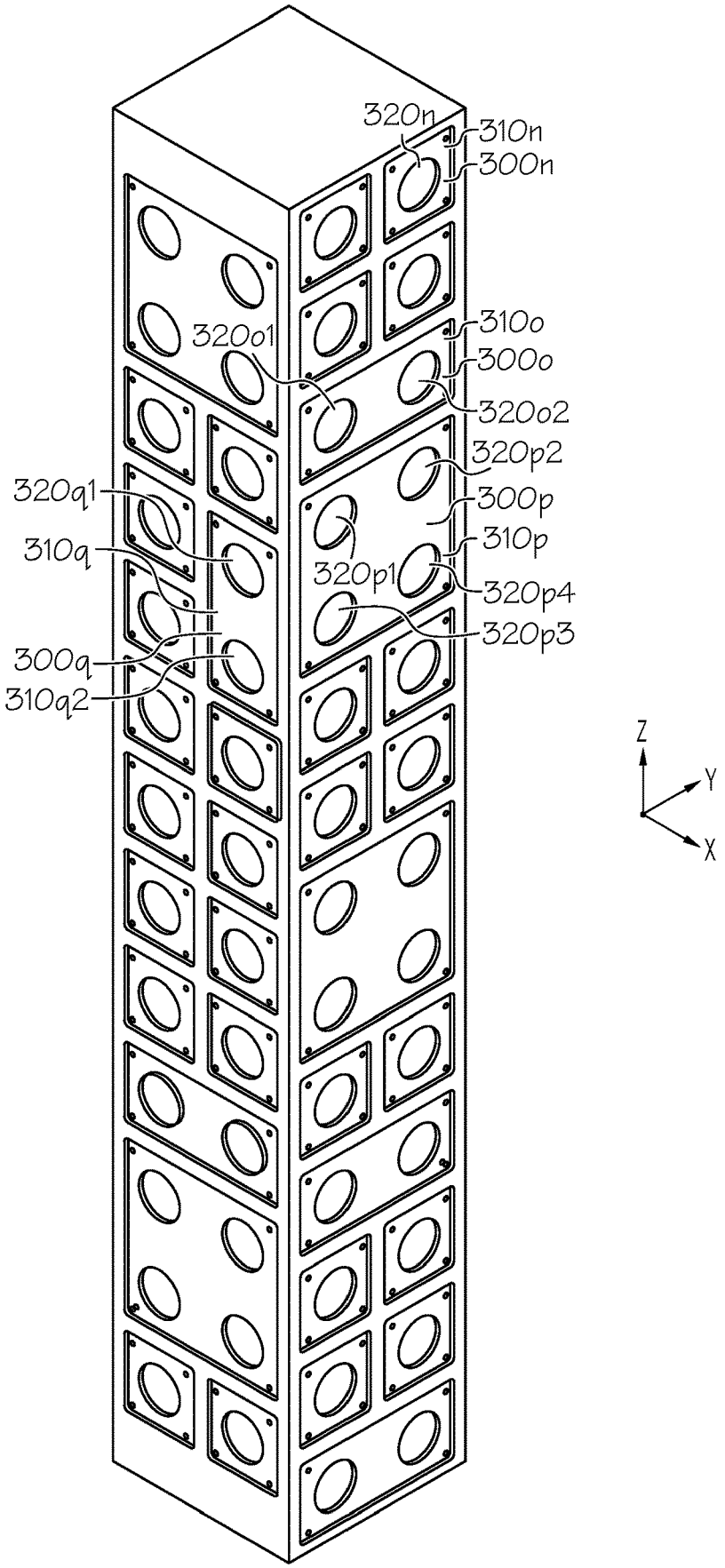
FIG. 11 is a perspective view of a repository system in accordance with embodiments of the present inventive concepts.

FIG. 11 is a perspective view of a repository system 10 in accordance with embodiments of the present inventive concepts. In the embodiment shown in FIG. 11, there are different types of memorial positions 300 shown. Memorial position 300*n* has a square recessed region 310*n* and one circular aperture 320*n*. Memorial position 300*o* has a rectangular recessed region 310*o*, oriented along the y direction, and two circular apertures 320*o*1, 320*o*2. Memorial position 300*p* has a square recessed region 310*p* and four circular apertures 320*p*1, 320*p*2, 320*p*3, 320*p*4. Memorial position 300*q* has a rectangular recessed region 310*q*, oriented along the z direction, and two circular apertures 320*q*1, 320*q*2.

Figure 12:
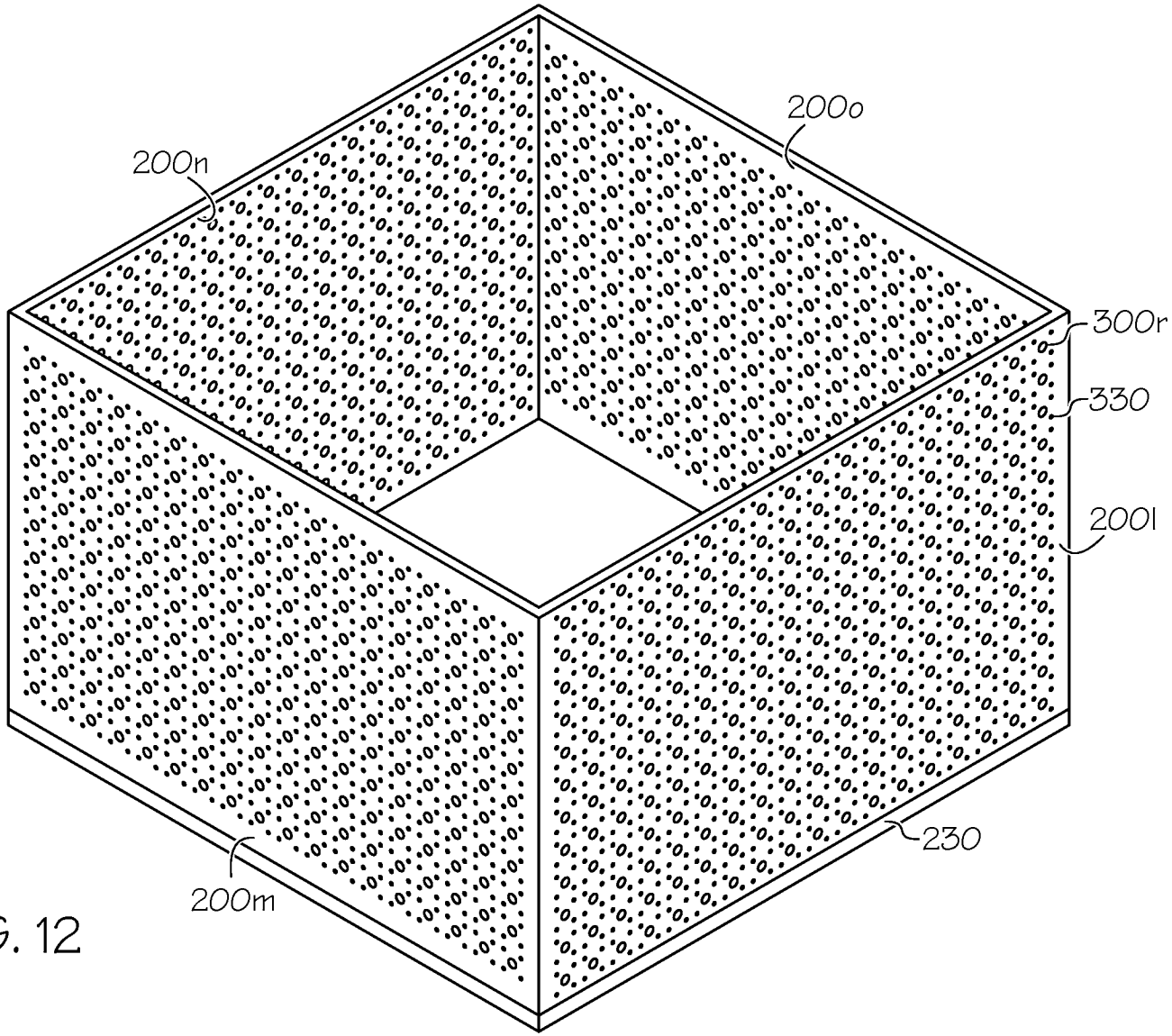
FIG. 12 is a perspective view of a repository system in accordance with embodiments of the present inventive concepts.

FIG. 12 is a perspective view of a repository system 10 in accordance with embodiments of the present inventive concepts. In the embodiment shown in FIG. 12, the repository 10 includes four repository panels 2001, 200*m*, 200*n*, 200*o*. An example memorial position 300*r* is shown in the upper right corner of the front panel. In this embodiment, the memorial positions 300 do not include recessed regions 310. In this embodiments, the memorial positions 300 include bolt holes 330. The repository system 10 shown in FIG. 12 has memorial positions arranged in horizontal rows at repository panels 200L, 200*m*, 200*n*, 200*o*. Repository panel 200*fm* and repository panel 200*o* each have one fewer row of memorial positions than repository panels 200L and 200*n*. The embodiment shown in FIG. 12 does not have a top panel 240. In the embodiment shown in FIG. 12, the panel base 230 extends around the repository system 10 at the bottom of each repository panel.

Figure 13A:
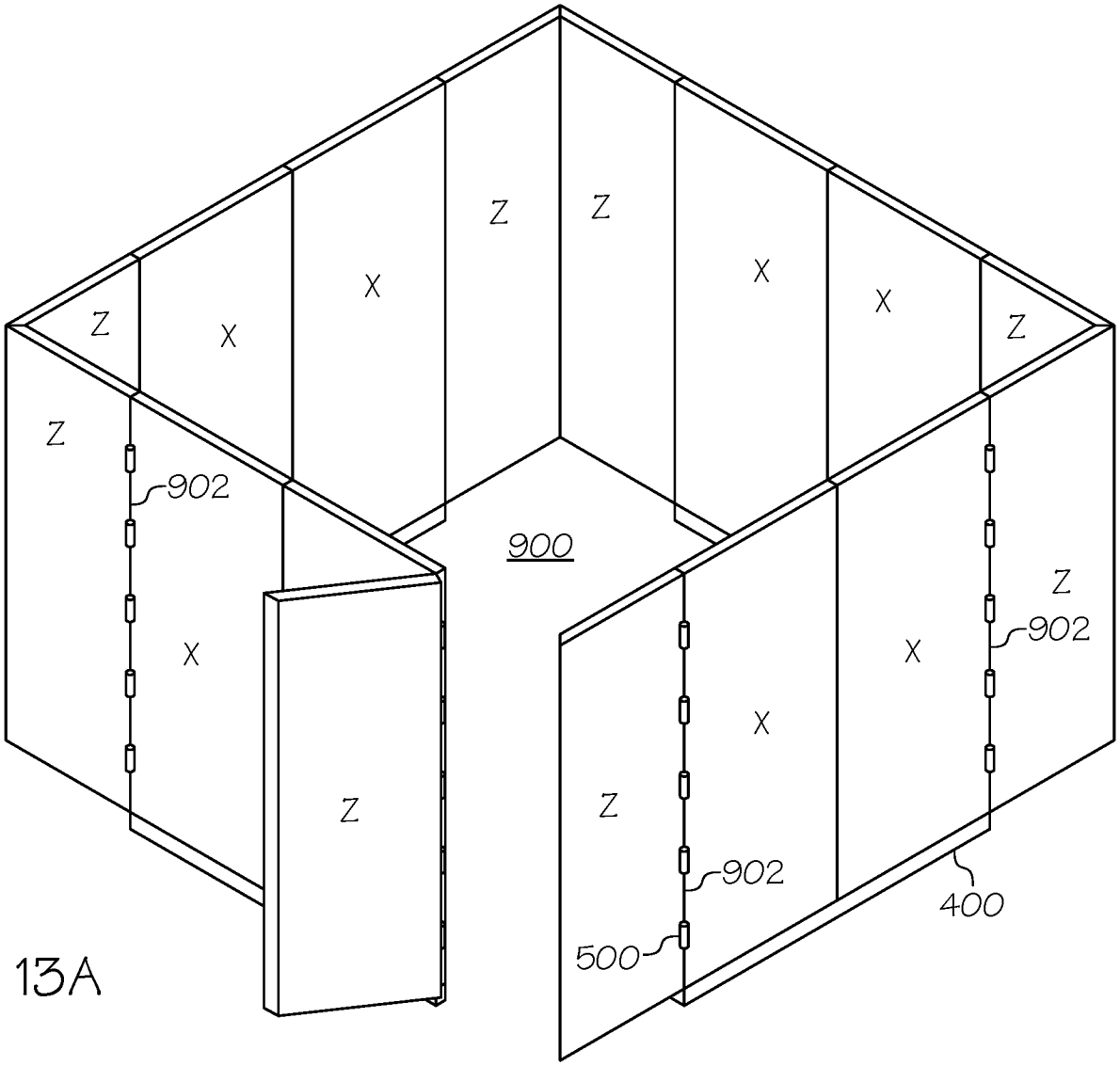
FIG. 13A is a perspective view of the repository system with some panels mounted on hinges in accordance with embodiments of the present inventive concepts.

FIG. 13A is a perspective view of the repository system 10 with some panels mounted on hinges 500 in accordance with embodiments of the present inventive concepts. In FIG. 13, repository panels labeled X are stationary and may provide structural support for the roof and the base. In FIG. 13, repository panels labeled Z are constructed and arranged to pivot horizontally outwards, allowing access to an interior region 900 of the repository system 10, surrounded by the repository panels 200. In some embodiments, hinges 500 may be positioned along certain boundaries 902 of the repository panels. In some embodiments, storage receptacles 100 are mounted at a certain subset of the panels labeled X. In some embodiments, storage receptacles 100 are mounted at a certain subset of the panels labeled Z. In some embodiments, storage receptacles 100 are mounted at both the X panels and Z panels.

Figure 13B:
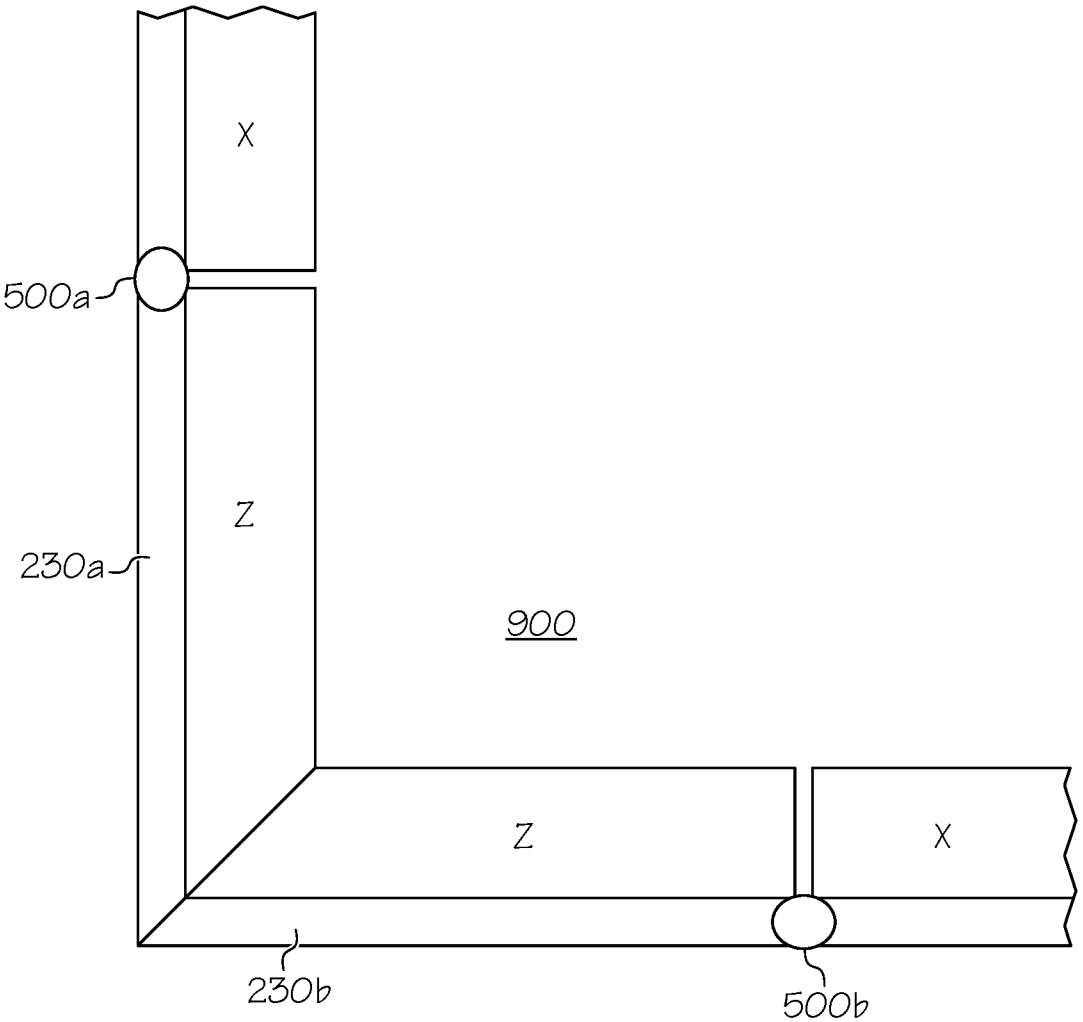
FIG. 13B is a top view of a repository system with one or more of the panels mounted to hinges in accordance with embodiments of the present inventive concepts.

FIG. 13B is a top view of a repository system 10 with one or more of the panels mounted to hinges 500 in accordance with embodiments of the present inventive concepts. In FIG. 13B, repository panels labeled X are stationary and repository panels labeled Z are constructed and arranged to swing outward, allowing access to an interior region 900 of the repository system 10.

In some embodiments, the Z panels may swing inward. In some embodiments, the memorial positions 300 near the hinges are constructed and arranged such that the rows at neighboring repository panels 200 are offset from one another, similar to the configuration previously described in connection with the rows in a corner region. In some embodiments, one or more of the repository panels 200 may be constructed and arranged to be locked.

In some embodiments, the X panels have a panel extension 400 that extends below a lower end of the Z panels. In some embodiments, the panel extension 400 may extend into the ground and provide support to the repository system 10. In some embodiments the panel extension 400 may couple with the panel base 230.

Figure 14:
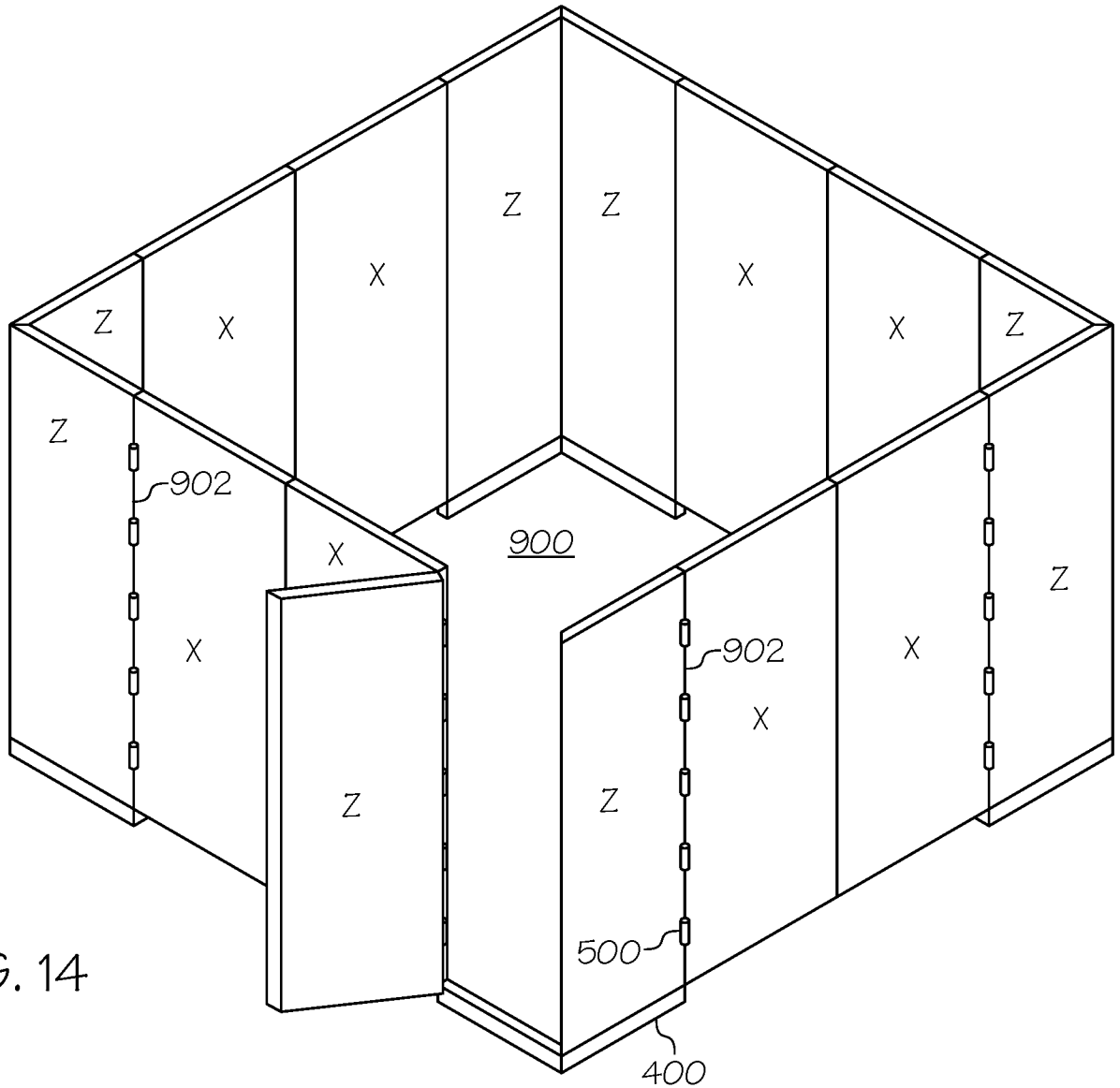
FIG. 14 is a perspective view of the repository system with some panels mounted on hinges in accordance with embodiments of the present inventive concepts.

FIG. 14 is a perspective view of the repository system 10 with some panels mounted on hinges 500 in accordance with embodiments of the present inventive concepts. In the embodiment shown in FIG. 14 is otherwise similar to the embodiment shown in FIG. 13A, except that the panel extension 400 is positioned below the Z panels.

Figure 15:
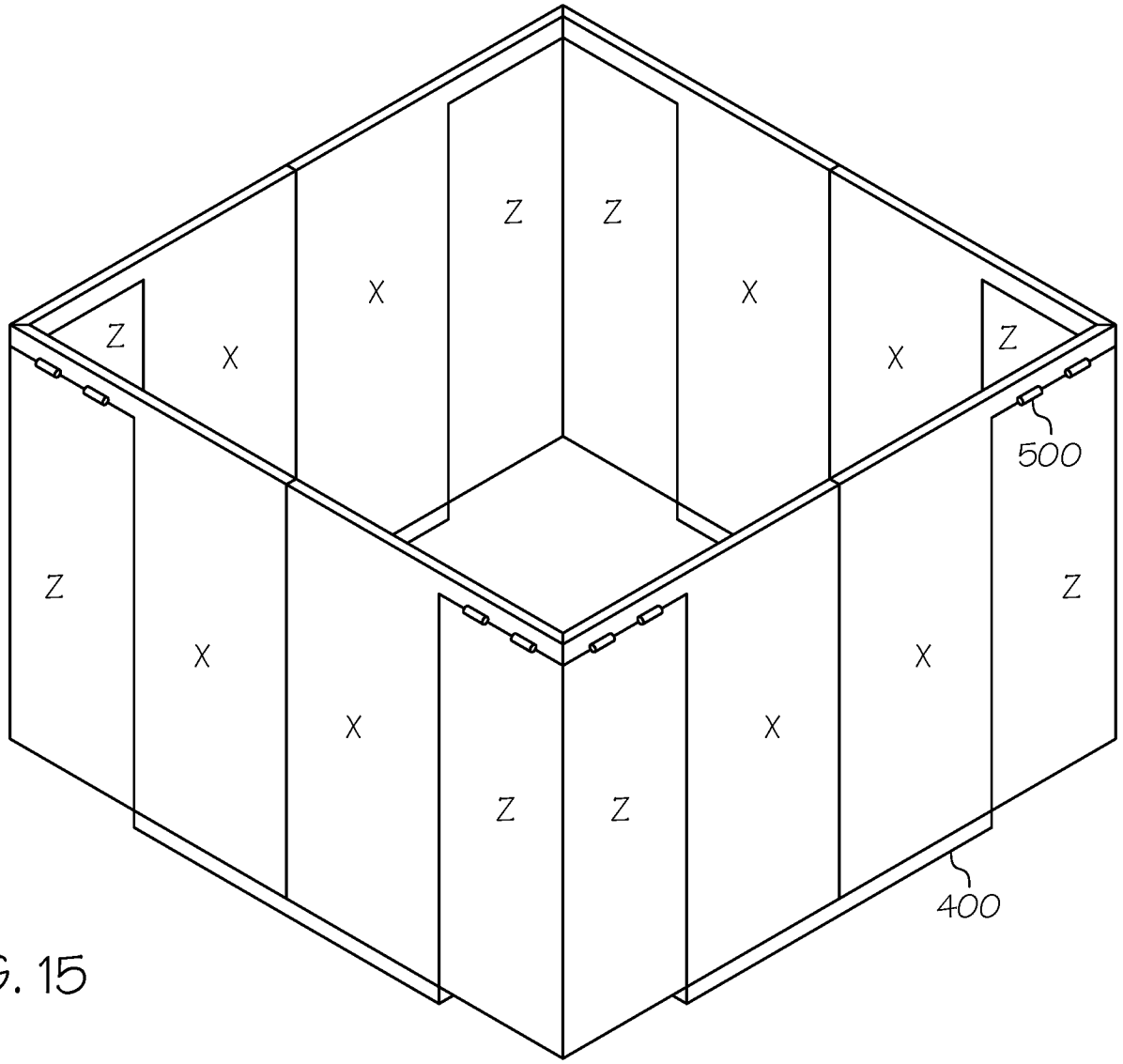
FIG. 15 is a perspective view of the repository system with hinges mounted near the top of some repository panels in accordance with embodiments of the present inventive concepts.

FIG. 15 is a perspective view of the repository system 10 with hinges 500 mounted near the top of some repository panels 200 in accordance with embodiments of the present inventive concepts. In this embodiment, the Z panels can pivot vertically in an upward direction to allow access to the interior of the repository system 10.

Figure 16:
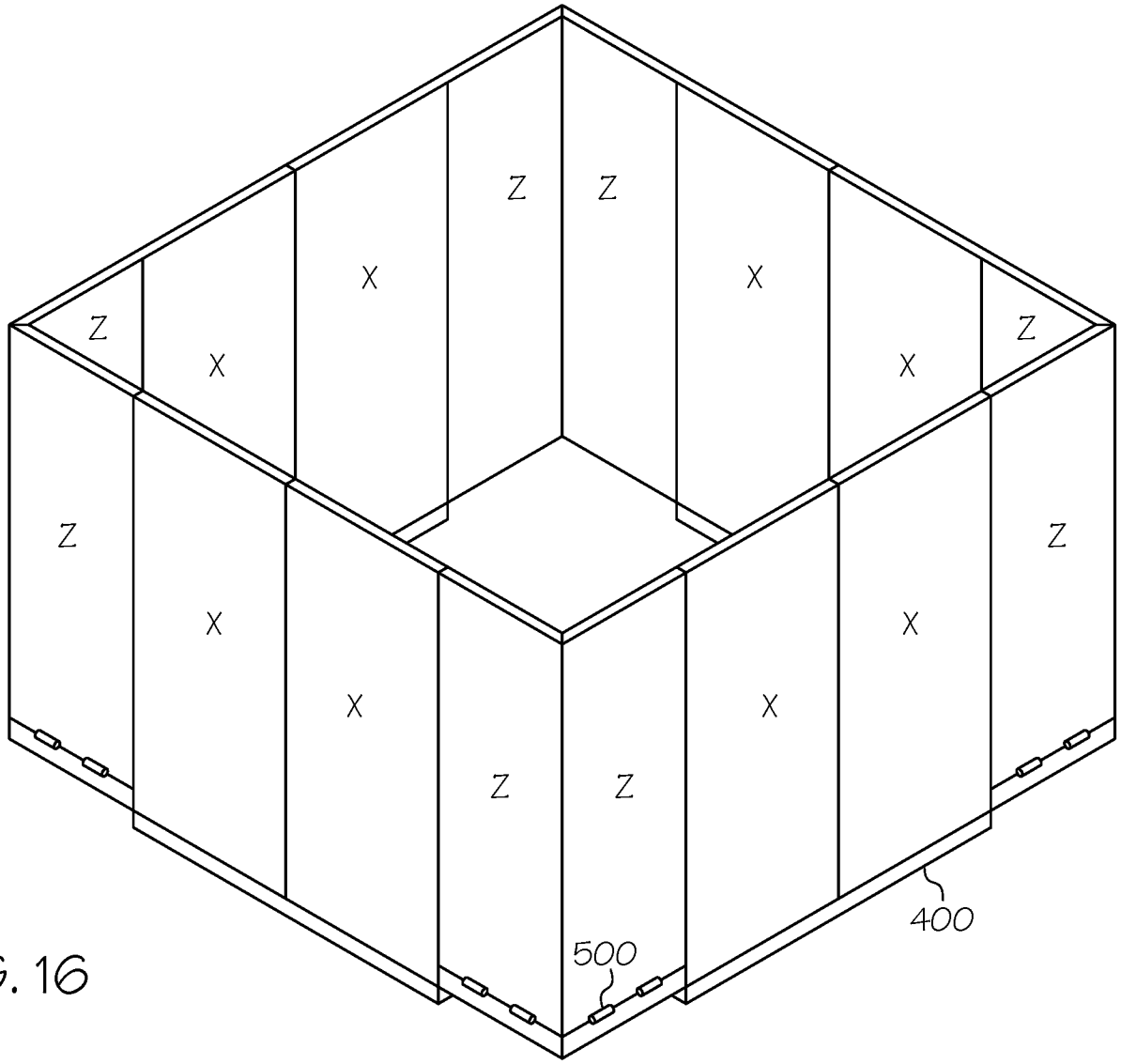
FIG. 16 is a perspective view of a repository system with hinges mounted near the bottom of some repository panels in accordance with embodiments of the present inventive concepts.

FIG. 16 is a perspective view of a repository system 10 with hinges 500 mounted near the bottom of some repository panels 200 in accordance with embodiments of the present inventive concepts. In this embodiment, the Z panels can pivot vertically in a downward direction to allow access to the interior of the repository system 10.

Figure 17:
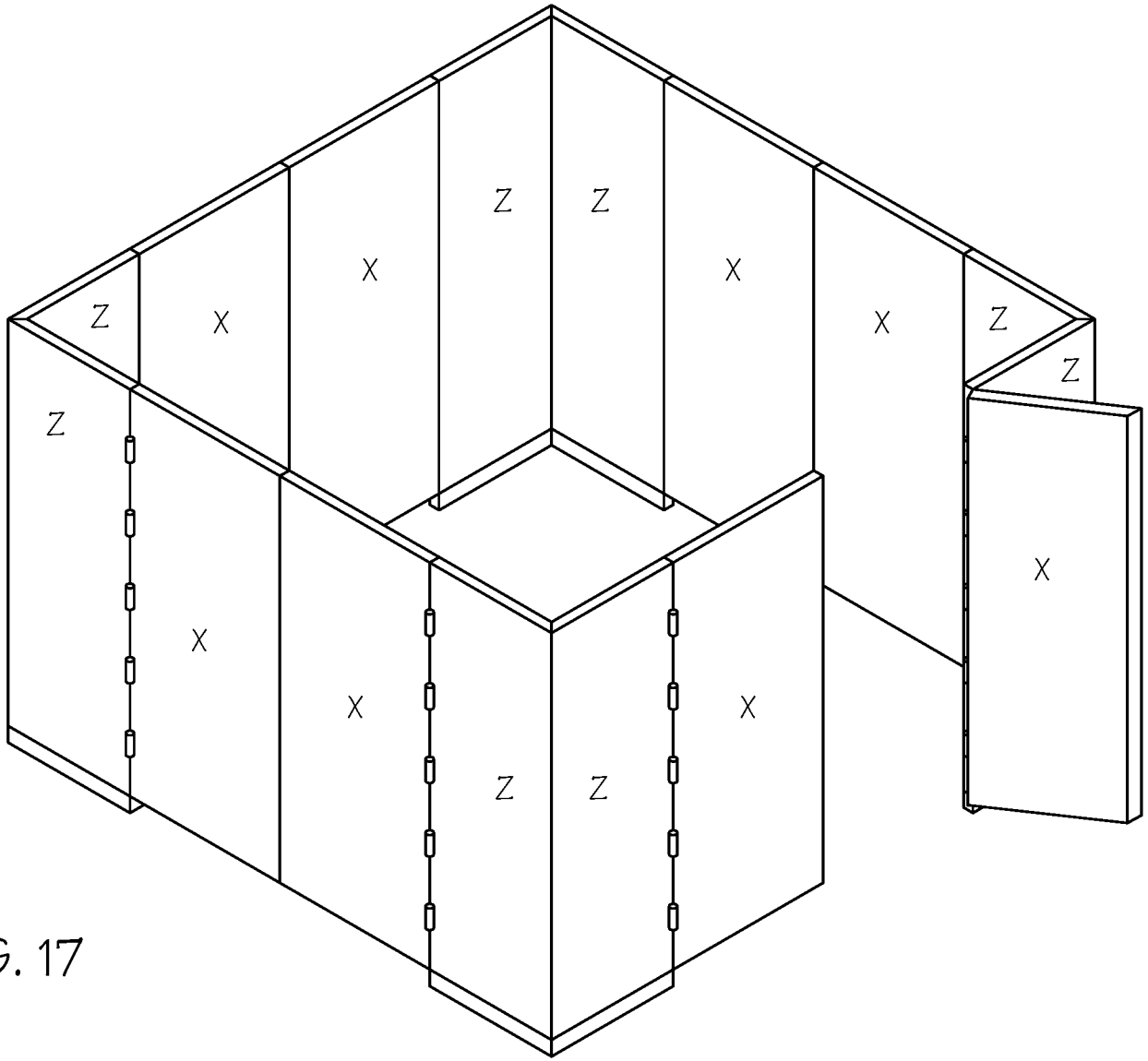
FIG. 17 is a perspective view of the repository system with some panels mounted on hinges in accordance with embodiments of the present inventive concepts.

FIG. 17 is a perspective view of the repository system 10 with some panels mounted on hinges 500 in accordance with embodiments of the present inventive concepts. In FIG. 17, repository panels labeled Z are stationary and may provide structural support for the roof and the base. In FIG. 17, repository panels labeled X are constructed and arranged to pivot horizontally outwards, allowing access to the inside of the repository system 10. In some embodiments, the capsules 100 near the hinges are arranged according to methods previously described to avoid collisions with neighboring capsules 100 and neighboring panels 200.

In some embodiments, access to the interior region 900 of the system can be provided through a stair system that enters the interior region from an external position. Fr example, a bulkhead can be provided at a position exterior the system 10 with a tunnel that leads to the interior region 900.

Figure 18A:
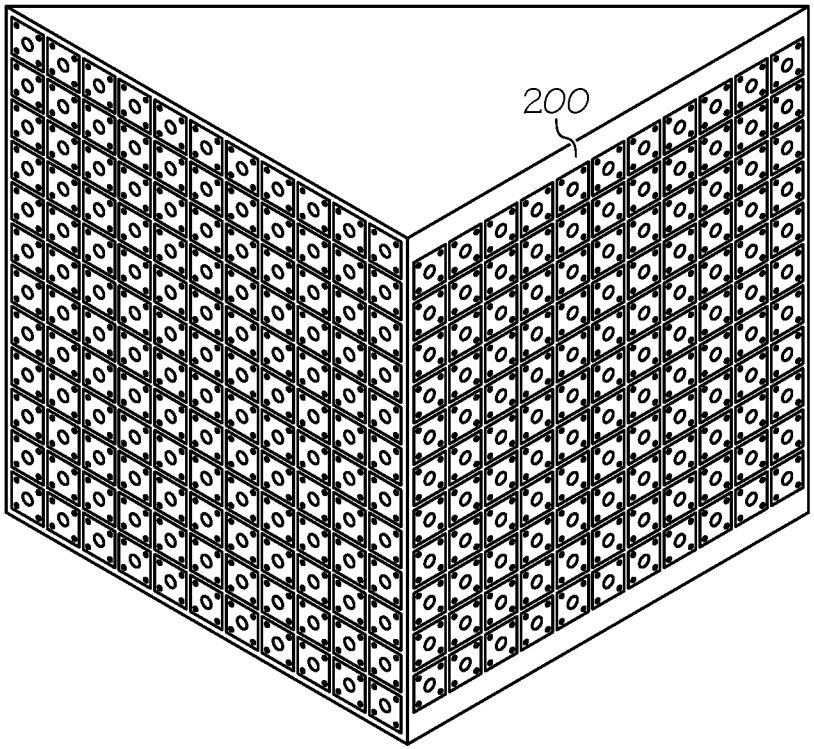
FIG. 18A, 18B, 18C are perspective views of repository systems in accordance with embodiments of the present inventive concepts.
Figure 18B:
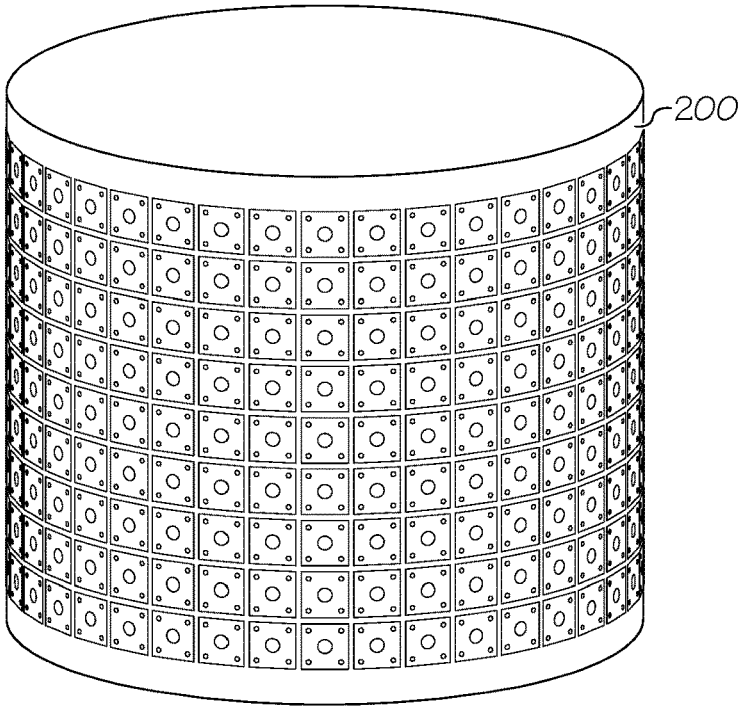
Figure 18C:
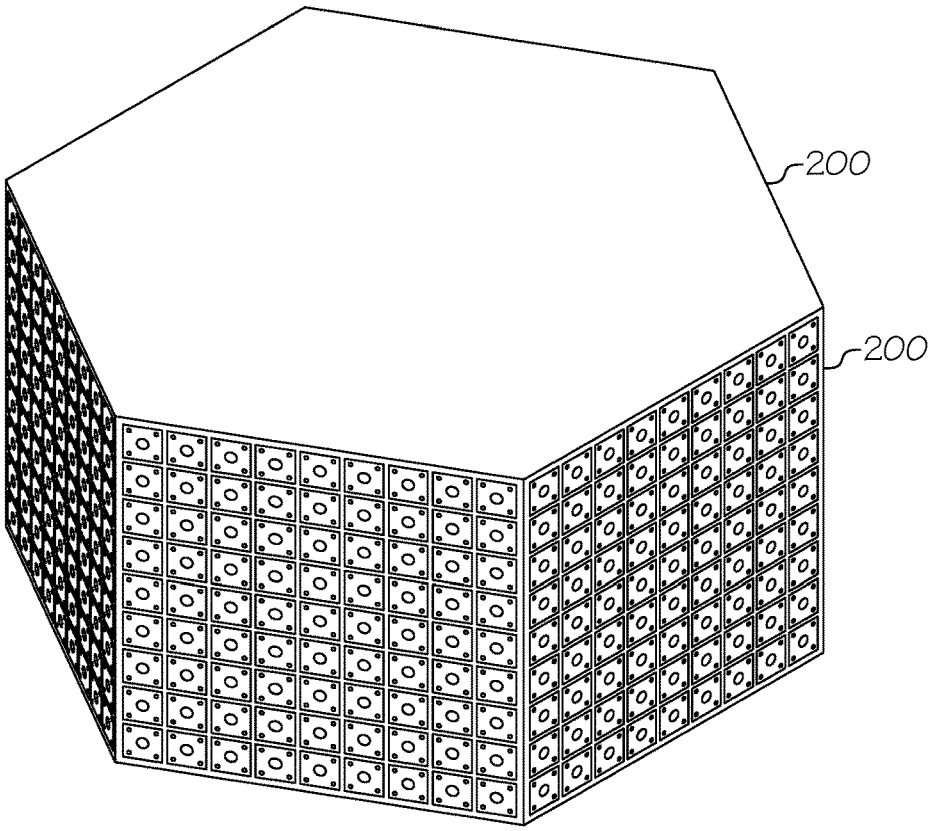

FIG. 18A, 18B, 18C are perspective views of repository systems 10 in accordance with embodiments of the present inventive concepts. The embodiments described above are generally described as being substantially rectangular or square in configuration. However, in other embodiments, the repository system 10 can take different shapes in accordance with the present inventive concepts. FIG. 18A illustrates a triangularly shaped repository system having three side repository panels 200. FIG. 18B illustrates a circularly shaped repository system 10. In this embodiment, the one or more side panels 200 are curved. FIG. 18C illustrates a repository system 10 in the shape of a hexagon. Possible configurations for the repository system 10 are not limited to these shapes and the repository system 10 could take the shape of any polygon or curved structure. The principles of the present inventive concepts apply equally well to the various configurations shown, and other configurations.

Figure 19A:
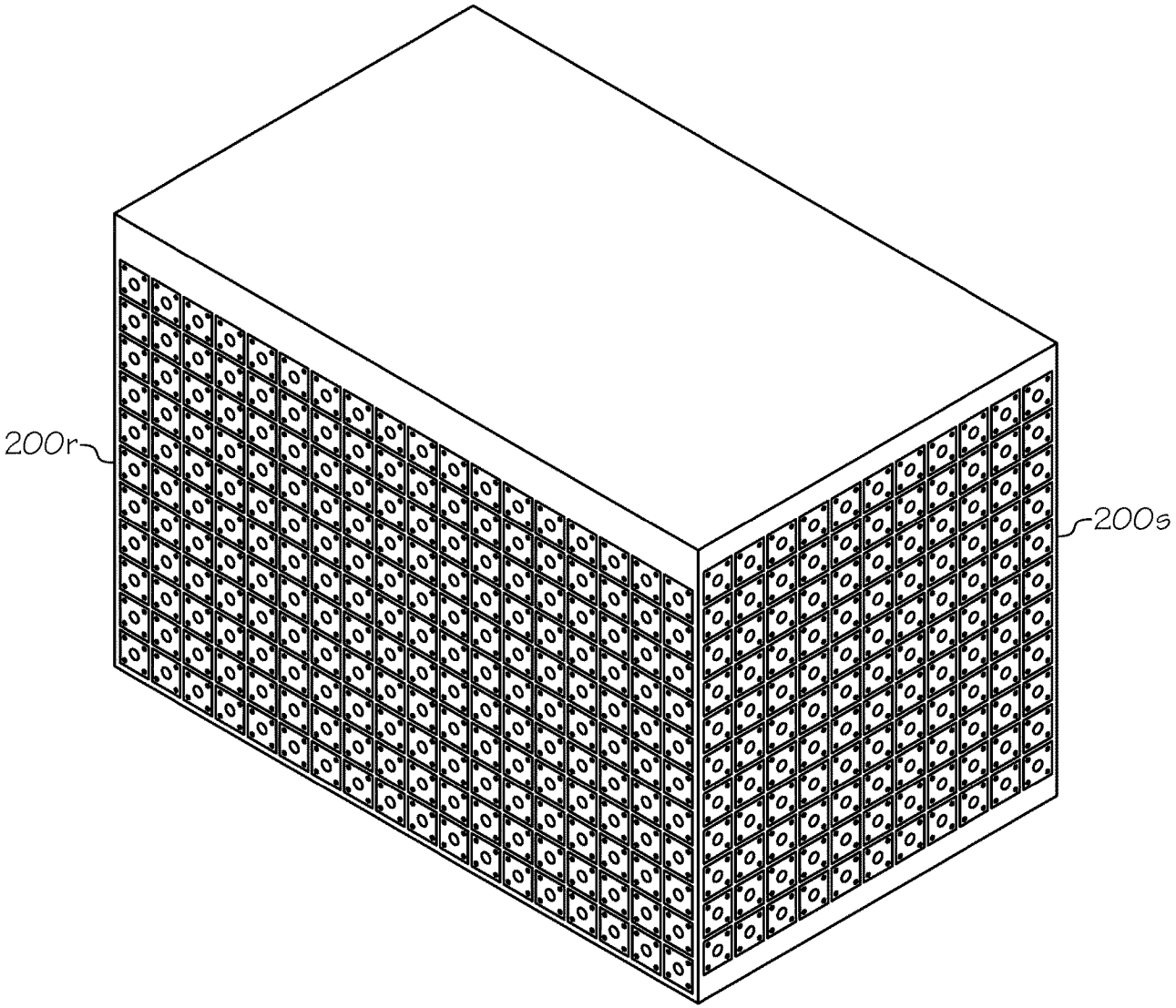
FIG. 19A is a perspective view of a repository system with the vertical position of the rows in neighboring repository panels offset in accordance with embodiments of the present inventive concepts.

FIG. 19A is a perspective view of a repository system 10 with the vertical position of the rows in neighboring repository panels 200 offset in accordance with embodiments of the present inventive concepts. Repository panel 200*r* has the same number of rows as the neighboring repository panel 200*s*. The rows in repository panel 200*s* are offset in the vertical direction relative to the rows in the repository panel 200*r*.

Figure 19B:
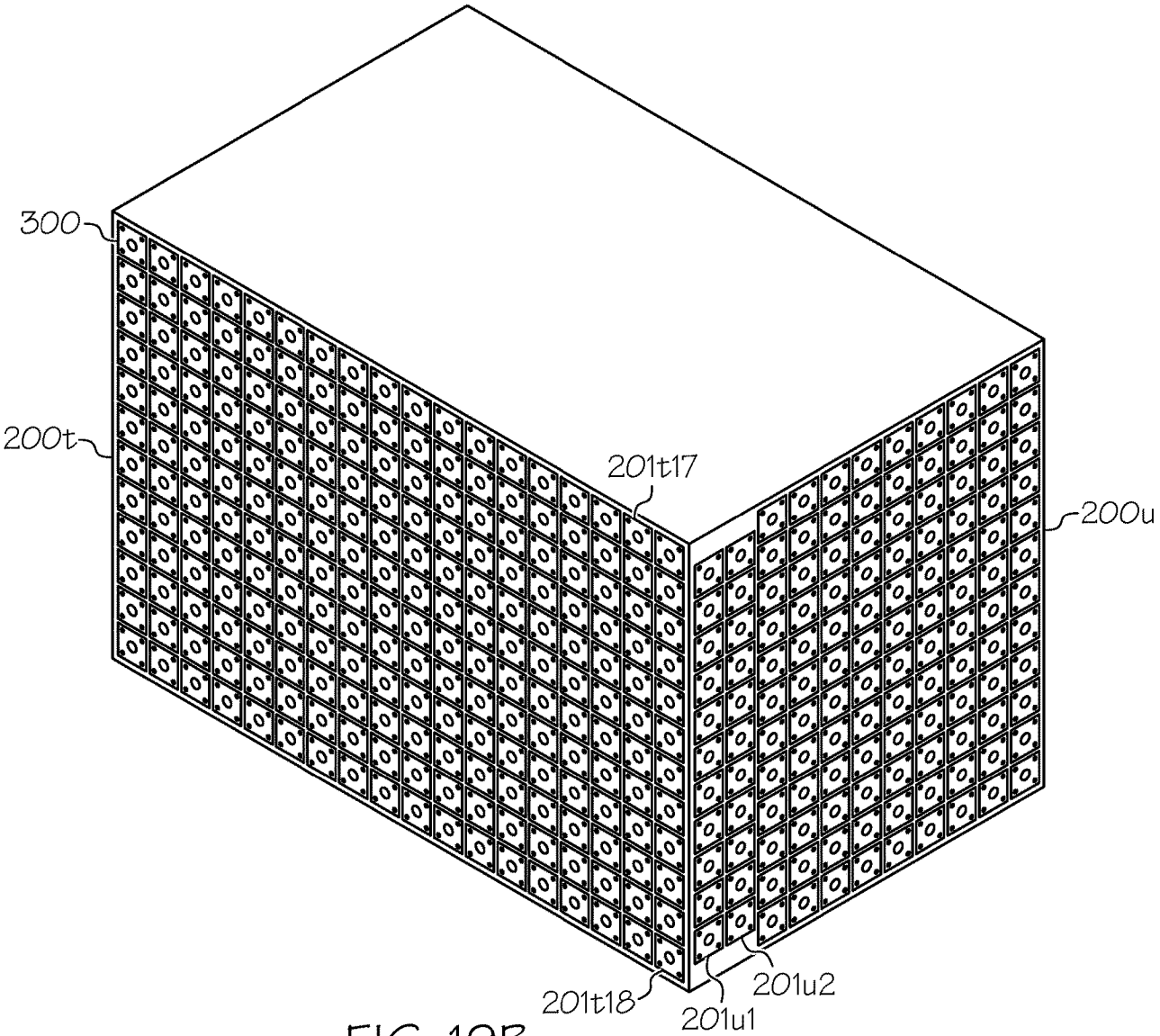
FIG. 19B is a perspective view of a repository system with the vertical position of the rows in neighboring repository panels offset in the corner region in accordance with embodiments of the present inventive concepts.

FIG. 19B is a perspective view of a repository system 10 with the vertical position of the rows in neighboring repository panels 200 offset in the corner region in accordance with embodiments of the present inventive concepts. In the embodiment shown in FIG. 19B, the corner region includes memorial positions 300 in columns 201*t*17, 201*t*18, 201*u*1, and 201*u*2. In the corner region, the vertical position of the rows in repository panel 200*u* are offset relative to the vertical position of the rows in repository panel 200*t*. In the corner region, repository panel 200*u* has one fewer row than repository panel 200*t*.

Figure 19C:
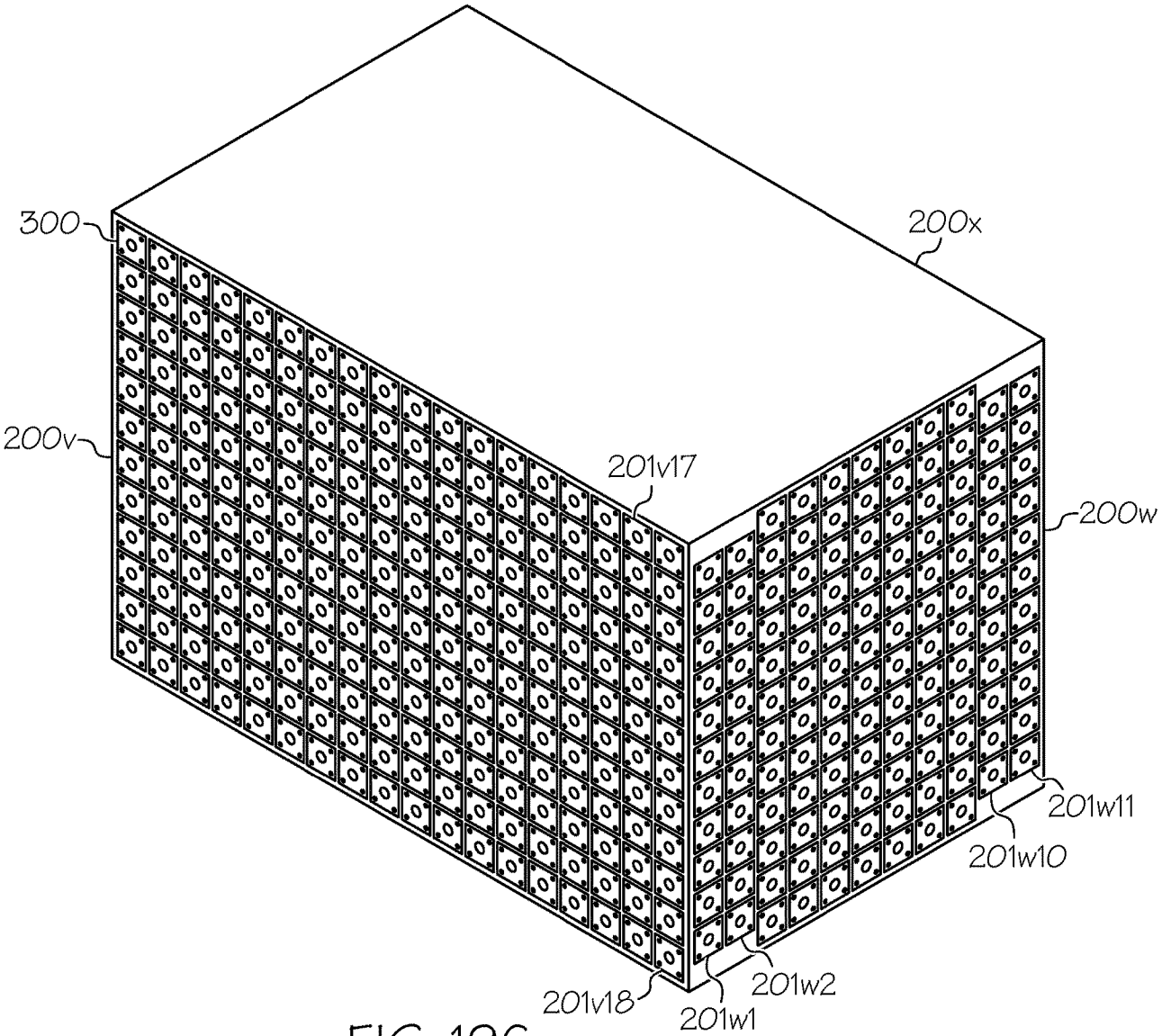
FIG. 19C is a perspective view of a repository system with the vertical position of the rows in neighboring repository panels offset in two corner regions in accordance with embodiments of the present inventive concepts.

FIG. 19C is a perspective view of a repository system 10 with the vertical position of the rows in neighboring repository panels 200 offset in two corner regions in accordance with embodiments of the present inventive concepts. In the embodiment shown in FIG. 19C, the first corner region includes memorial positions 300 in columns 201*v*17, 201*v*18, 201*w*1, and 201*w*2. In the first corner region, the vertical position of the rows in repository panel 200*v* are offset relative to the vertical position of the rows in repository panel 200*w*. In the first corner region, repository panel 200*w* has one fewer row than repository panel 200*v*.

In the embodiment shown in FIG. 19C, the second corner region includes memorial positions 300 in columns 201*w*10, 201*w*11, and columns that are hidden from view. In the second corner region, the vertical position of the rows in repository panel 200*w* are offset relative to the vertical position of the rows in repository panel 200*v* and the vertical position of the rows in the corner region of repository panel 200*x*. In the second corner region, repository panel 200*w* has one fewer row than repository panel 200*v*.

Figure 20:
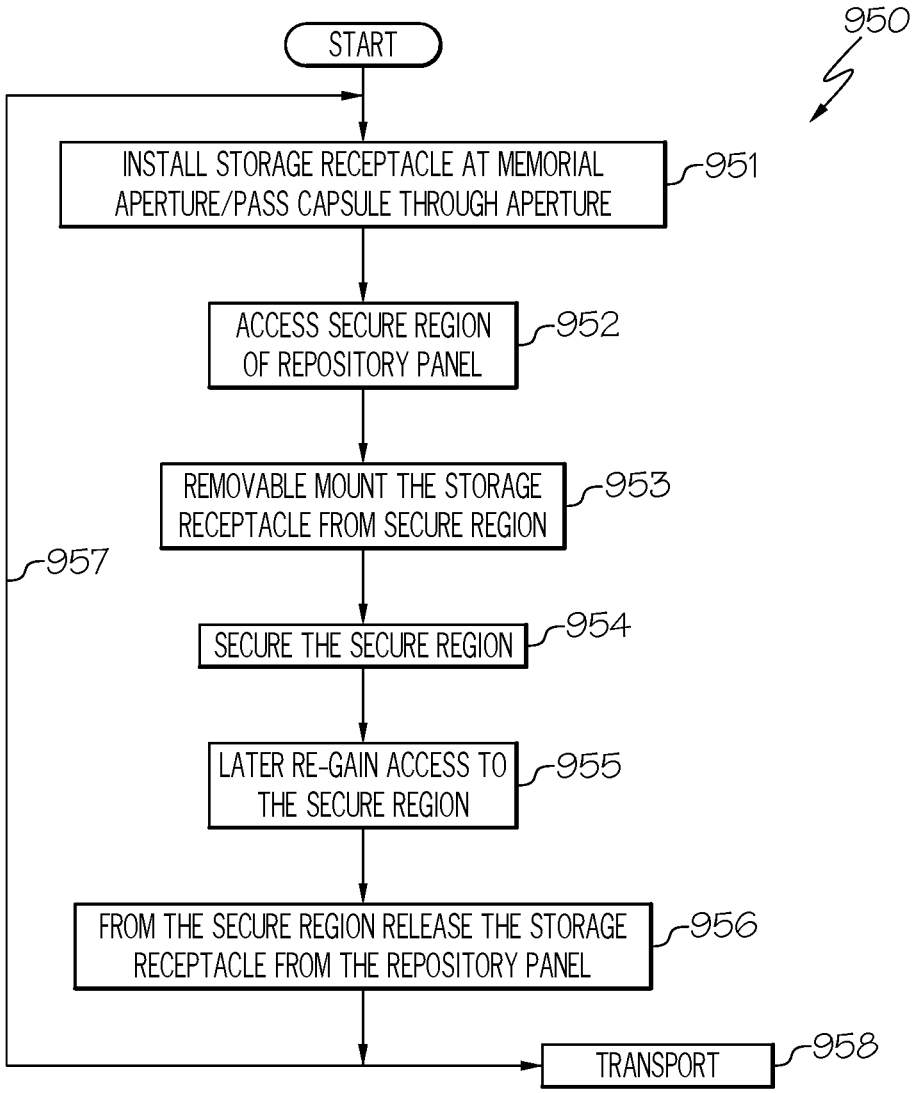
FIG. 20 is a flow diagram of a method of operating a repository system in accordance with the present inventive concepts.

FIG. 20 is a flow diagram of a method of operating a repository system in accordance with the present inventive concepts.

A storage receptacle is installed 951 at one of a plurality of memorial apertures of a repository panel. The plurality of memorial apertures extend through a front face to a rear face of the repository panel. The storage receptacle includes a plaque having a front face and a rear face and a capsule having a first end coupled to the rear face of the plaque;

A secure region of the repository panel is accessed 952. The storage receptacle is removably mounted to the front face of the repository panel from within the secure region 953 so that the rear face of the plaque of the storage receptacle contacts the front face of the repository panel. The capsule extends through the corresponding memorial aperture to extend from the rear face of the repository panel, wherein the capsule is coupled exclusively to the rear face of the plaque and extends into the secure region.

The secure region is secured 954 to prevent unauthorized access to the secure region.

Later, access to the secure region is regained 955.

The storage receptacle is released 956 from the repository panel from the secure region; and the capsule of the storage receptacle is passed back through the memorial aperture to remove the storage receptacle from the repository panel.

The released storage receptacle can be transported to be located at another repository system 958, and the memorial aperture can be designated for re-use 957 by another storage receptacle.

A repository system is provided as an effective way to store cremated remains in a space-efficient manner. The repository system may be constructed to withstand environmental exposure. At the same time, environmental impact is mitigated. Storage capsules can be removed and transported.

The above-described embodiments should be understood to serve only as illustrative examples; further embodiments are envisaged. Any feature described herein in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A repository system for storing cremains, comprising:

a first elongated capsule adapted to store cremains coupled to a first repository panel, the first elongated capsule extending in a first axis of extension;

a second elongated capsule adapted to store cremains coupled to the first repository panel, the second elongated capsule extending in a second axis of extension; and a third elongated capsule adapted to store cremains coupled to a second repository panel, the third elongated capsule extending in a third axis of extension;

wherein a portion of the third elongated capsule is positioned between a portion of the first elongated capsule and a portion of the second elongated capsule.

2. The repository system of claim 1 wherein the first axis of extension and the second axis of extension lie on a plane and wherein the third axis of extension intersects the plane.

3. The repository system of claim 1 wherein the portion of the third elongated capsule is positioned directly between the portion of the first elongated capsule and the portion of the second elongated capsule.

4. The repository system of claim 1 wherein the first repository panel and the second repository panel each comprise a side panel of the repository system.

5. The repository system of claim 1 wherein the first repository panel comprises a side panel of the repository system and wherein the second repository panel comprises a top panel of the repository system.

6. The repository system of claim 1 wherein the first repository panel includes a plurality of first memorial apertures and wherein the second repository panel includes a plurality of second memorial apertures.

7. The repository system of claim 6 wherein the plurality of first memorial apertures of the first repository panel are arranged in horizontal rows and vertical columns, and wherein the second memorial apertures of the second repository panel are arranged in horizontal rows and vertical columns.

8. The repository system of claim 6, further comprising at least one storage receptacle comprising:

a plaque having a front face and a rear face; and one of the capsules, the one of the capsules having a first end coupled to the rear face of the plaque.

9. The repository system of claim 8 wherein the capsule has an interior chamber constructed and arranged to store material.

10. The repository system of claim 9 wherein the material comprises cremains.

11. The repository system of claim 8 wherein the capsule further includes a sealing cap at a second end thereof.

12. The repository system of claim 8, wherein, for each of the at least one storage receptacle:

the plaque is coupled to a first face of the corresponding first or second repository panel; and the capsule extends through a corresponding one of the plurality of first memorial apertures or a corresponding one of the plurality of second memorial apertures.

13. The repository system of claim 12, wherein the capsule is coupled exclusively to the plaque.

14. The repository system of claim 12, wherein the capsule is coupled exclusively to the plaque and contacts at least a portion of the aperture through which the capsule extends.

15. The repository system of claim 12, wherein a portion of the capsule extending from the memorial aperture is suspended above a neighboring capsule.

16. The repository system of claim 12, wherein a portion of the capsule extending from the memorial aperture is cantilevered.

17. The repository system of claim 8, wherein the first and second repository panels interface at a corner region, wherein capsules of the storage receptacles positioned in the corner region avoid contact with each other.

18. The repository system of claim 8 wherein the at least one storage receptacle further comprises multiple capsules coupled to a common plaque.

19. The repository system of claim 18 wherein the multiple capsules are positioned on the common plaque to correspond with multiple ones of the memorial apertures to which the storage receptacle is positioned.

20. The repository system of claim 8 wherein the first and second repository panels further comprise recesses at a first face of the corresponding repository panel, wherein the recesses surround the memorial apertures, and wherein the plaque is seated in one of the recesses.

21. The repository system of claim 6 wherein the memorial apertures are spaced apart from each other.

22. The repository system of claim 6 further comprising at least one additional repository panel, and wherein the at least one additional repository panel forms a closed repository panel structure with the first and second repository panels.

23. The repository system of claim 6 further comprising third and fourth repository panels, and wherein the third and fourth repository panels form a closed side panel structure with the first and second repository walls.

24. The repository system of claim 23 further comprising at least one hinge positioned on at least one of the first and second repository panels to permit at least a portion of the at least one repository panels to pivot relative to a remainder portion of the at least one repository panels.

* * * * *